US006593069B2

(12) United States Patent
Oya et al.

(10) Patent No.: US 6,593,069 B2
(45) Date of Patent: Jul. 15, 2003

(54) PHOTOTHERMOGRAPHIC MATERIAL AND METHOD FOR FORMING IMAGES

(75) Inventors: Toyohisa Oya, Minami-ashigara (JP); Kazunobu Katoh, Minami-ashigara (JP); Shigeo Hirano, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/809,024

(22) Filed: Mar. 16, 2001

(65) Prior Publication Data

US 2002/0098449 A1 Jul. 25, 2002

(51) Int. Cl.[7] ..... G03C 1/34; G03C 1/498; G03C 1/35; G03C 7/407; G03C 7/32

(52) U.S. Cl. ..... 430/351; 430/364; 430/380; 430/543; 430/544; 430/551; 430/552; 430/553; 430/554; 430/555; 430/556; 430/557; 430/558; 430/965

(58) Field of Search ..... 430/351, 364, 430/380, 965, 543, 544, 552–558, 551

(56) References Cited

U.S. PATENT DOCUMENTS 3,994,732 A * 11/1976 Winslow ..... 430/965
4,021,240 A * 5/1977 Cerquone et al. ..... 430/203

(List continued on next page.)

FOREIGN PATENT DOCUMENTS

EP 0 785 463 A1 7/1997
JP 2000310842 11/2000
JP 200166745 3/2001

*Primary Examiner*—Richard L. Schilling
(74) *Attorney, Agent, or Firm*—Birch, Stewart, Kolasch & Birch, LLP

(57) ABSTRACT

A photothermographic material comprising at least (a) a photosensitive silver halide, (b) a reducible silver salt, (c) a reducing compound represented by the following formula (1) or (2), (d) a binder and (e) a coupler compound on the same side of a support:

(1)

wherein, in the formula (1), $V^1$ to $V^4$ each independently represent hydrogen atom or a substituent, and $V^5$ represents a substituted or unsubstituted alkyl group, aryl group or heterocyclic group:

$$Q^1\text{—NHNH—}V^6 \quad (2)$$

wherein, in the formula (2), $Q^1$ represents a 5- to 7-membered unsaturated ring bonding to NHNH—$V^6$ at a carbon atom, and $V^6$ represents a carbamoyl group, an acyl group, an alkoxycarbonyl group, an aryloxycarbonyl group, a sulfonyl group or a sulfamoyl group.

The photothermographic material of the present invention shows good photographic properties including sensitivity, fog and so forth, and enables control of color tone of the photothermographic material in an arbitrary wavelength region even as a monosheet type photothermographic material.

30 Claims, 1 Drawing Sheet

U.S. PATENT DOCUMENTS 4,108,665 A * 8/1978 Gutman et al. ..... 430/607
4,510,236 A 4/1985 Gutman ..... 430/619
4,585,734 A * 4/1986 Weigel ..... 430/965
4,756,999 A * 7/1988 Swain et al. ..... 430/613
5,340,712 A * 8/1994 Dunn et al. ..... 430/619
5,464,737 A * 11/1995 Sakizadeh et al. ..... 430/619
5,716,772 A * 2/1998 Taguchi ..... 430/380
5,756,275 A * 5/1998 Takizawa et al. ..... 430/380
5,780,210 A * 7/1998 Takeuchi et al. ..... 430/351
5,874,203 A * 2/1999 Morita
5,888,704 A * 3/1999 Kikuchi ..... 430/380
6,013,421 A * 1/2000 Nakamura et al. ..... 430/380

* cited by examiner

PHOTOTHERMOGRAPHIC MATERIAL AND METHOD FOR FORMING IMAGES

TECHNICAL FIELD

The present invention relates to a photothermographic material. In particular, the present invention relates to a novel photothermographic material that enables control of image color tone and reduction of silver amount to be used by forming dye images by heat development.

BACKGROUND OF THE INVENTION

Methods for forming images by heat development are described in, for example, U.S. Pat. Nos. 3,152,904 and 3,457,075 and D. Klosterboer, "Thermally Processed Silver Systems", Imaging Processes and Materials, Neblette, 8th ed., compiled by J. Sturge, V. Walworth and A. Shepp, Chapter 9, p. 279, (1989). Such photothermographic materials comprise a reducible non-photosensitive silver source (e.g., silver salt of an organic acid), a photocatalyst (e.g., silver halide) in a catalytically active amount and a reducing agent for silver, which are usually dispersed in an organic binder matrix. While the photosensitive materials are stable at an ordinary temperature, when they are heated to a high temperature (e.g., 80° C. or higher) after light exposure, silver is produced through an oxidation-reduction reaction between the reducible silver source (which functions as an oxidizing agent) and the reducing agent. The oxidation-reduction reaction is accelerated by catalytic action of a latent image generated upon exposure. The silver produced from the reaction of the reducible silver salt in the exposed areas shows black color and provides contrast with respect to the non-exposed areas, and thus images are formed.

A method of releasing or forming diffusible dyes image-wise by heat development and transferring these diffusible dyes to an image-receiving material was proposed. In this method, either of a negative dye image and a positive dye image can be obtained by changing the kind of dye-donating compound or the kind of silver halide to be used. Further details are disclosed in U.S. Pat. Nos. 4,500,626, 4,483,914, 4,503,137, 4,559,290, Japanese Patent Laid-open Publication (Kokai, hereinafter referred to as JP-A) 58-149046, JP-A-60-133449, JP-A-59-218443, JP-A-61-238056, EP220746A2, Journal of Technical Disclosure (Kokai Giho) No. 87-6199 and EP210660A2 and so forth.

Various methods have been proposed as for methods of obtaining positive color images by heat development. For example, U.S. Pat. No. 4,559,290 discloses a method in which a so-called dye releasing redox compound (hereinafter also referred to as a DRR compound) converted into a compound of oxidized form having no dye-releasing ability is used together with a reducing agent or a precursor thereof, so that the reducing agent should be oxidized in proportion to the exposure amount of silver halide by heat development, and the compound is reduced with the remaining reducing agent not oxidized so that diffusible dyes are released. Further, EP220746A and JIII Journal of Technical Disclosure (Kokai Giho) No. 87-6199 (vol. 12, No. 22,) disclose color photothermographic materials using, as a compound that releases diffusible dyes by a similar mechanism, a compound which releases diffusible dyes by reductive cleavage of N—X bond (X represents an oxygen atom, a nitrogen atom or a sulfur atom).

As a method for forming dye images for photographic materials, the method utilizing a coupling reaction of a coupler and an oxidation product of developing agent is most commonly used, and color photothermographic materials utilizing this method are described in U.S. Pat. Nos. 3,761,270, 4,021,240, JP-A-59-231539, JP-A-60-128438 and so forth. In the techniques disclosed in the aforementioned patent documents, p-sulfonamidophenol is used as a developing agent. Because, in the photosensitive materials of coupling type, the couplers do not show absorption in the visible region before development, they are more favorable in view of sensitivity, as compared with the photosensitive materials which utilize the aforementioned color materials, and they are considered to have an advantage that they can be used not only as printing materials but also as image-capturing materials.

These methods for obtaining dye images by heat development are suitable for photothermographic materials utilizing thermal transfer, diffusion transfer or sublimation type thermal transfer from a photosensitive layer to an image-receiving layer. However, for obtaining dye images as photothermographic materials of monosheet type, they do not always have suitable characteristics as for image-forming temperature, image stability and color tone.

In photothermographic materials, compounds called "color tone adjusters" are added to the photosensitive materials as required, in order to improve image density (image concentration) of silver images, silver color tone, and heat developability.

In photothermographic materials utilizing silver salts of an organic acid, various types of color tone adjusters can be used. Examples of the color tone adjuster are disclosed in, for example, JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, Japanese Patent Publication (Kokoku, hereinafter referred to as JP-B) 49-10727, JP-B-54-20333, U.S. Pat. Nos. 3,080,254, 3,446,648, 3,782,941, 4,123,282 and 4,510,236, British Patent No. 1,380,795, Belgian Patent No. 841,910, JP-B-1-25050 and so forth.

Specific examples of the color tone adjuster include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and a certain kind of photobleaching agents such as N,N-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative such as phthalic acid, 4-methylphthalic acid, 4-nitrophthalic acid, tetrachlorophthalic acid anhydride and homophthalic acid; phthalazine, phthalazine derivatives such as 4-(1-naphthyl)

phthalazine, 6-chlorophthalazine, 5,7-dimethoxyphthalazine, 6-isopropylphthalazine, 6-isobutylphthalazine, 6-tert-butylphthalazine, 5,7-dimethylphthalazine and 2,3-dihydrophthalazine, and metal salts thereof; combinations of phthalazine or a derivative thereof and a phthalic acid derivative such as phthalic acid, 4-methylphthalic acid, 4-nitrophthalic acid, tetrachlorophthalic acid anhydride and homophthalic acid; quinazolinedione, benzoxazine and naphthoxazine derivatives; rhodium complexes that function not only as a color tone adjuster but also as a halide ion source for the formation of silver halide at the site, such as ammonium hexachlororhodate(III), rhodium bromide, rhodium nitrate and potassium hexachlororhodate(III); inorganic peroxides and persulfates such as ammonium disulfide peroxide and hydrogen peroxide; benzoxazine-2,4-diones such as 1,3-benzoxazine-2,4-dione, 8-methyl-1,3-benzoxazine-2,4-dione and 6-nitro-1,3-benzoxazine-2,4-dione; pyrimidines and asymmetric triazines such as 2,4-dihydroxpyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene and so forth.

These color tone adjusters have been searched in view of desired performances (image density, silver color tone, improvement of heat developability), properties of volatilization, sublimation or the like from photosensitive materials, properties of photosensitive materials comprising them in combination with other additives such as antifoggants, and many color tone adjusters have been reported. It is known that, among those, superior results can be obtained by combinations of phthalazine compounds and phthalic acid derivatives.

However, if these color tone adjusters are used in order to control color tone of photosensitive materials in a specific wavelength region, the relationship between types and structures of color tone adjusters and obtainable silver color tone may readily be fluctuated by various factors including combination with other additives, production conditions of photosensitive materials, development temperature, lapse of time and so forth, and it has constituted an important problem in designing of photothermographic materials. Therefore, there has been desired a photothermographic material that can solve this problem.

DISCLOSURE OF THE INVENTION

An object of the present invention is to solve the aforementioned problems of the prior art. That is, the object to be achieved by the present invention is to provide a novel photothermographic material that shows good photographic properties including sensitivity, fog and so forth, and enables control of color tone of the photothermographic material in an arbitrary wavelength region even as a monosheet type photothermographic material.

The inventors of the present invention assiduously studied in order to achieve the aforementioned object. As a result, they found that photothermographic materials that exhibit superior performance could be obtained by using a reducing compound having a particular structure and a coupler compound, and thus accomplished the present invention.

That is, the present invention provides a photothermographic material comprising at least (a) a photosensitive silver halide, (b) a reducible silver salt, (c) a reducing compound represented by the following formula (1) or (2), (d) a binder and (e) a coupler compound on the same side of a support.

(1)

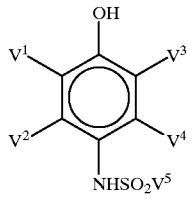

In the formula (1), $V^1$ to $V^4$ each independently represent hydrogen atom or a substituent, and $V^5$ represents a substituted or unsubstituted alkyl group, aryl group or heterocyclic group.

$$Q^1—NHNH—V^6 \quad (2)$$

In the formula (2), $Q^1$ represents a 5- to 7-membered unsaturated ring bonding to NHNH—$V^6$ at a carbon atom, and $V^6$ represents a carbamoyl group, an acyl group, an alkoxycarbonyl group, an aryloxycarbonyl group, a sulfonyl group or a sulfamoyl group.

Preferably, the photothermographic material of the present invention comprises a reducing compound represented by the formula (2) as (c) the reducing compound represented by the formula (1) or (2).

Preferably, the coupler compound is a compound represented by any one of the following formulas (3) to (17).

(3)

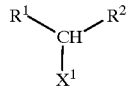

(4)

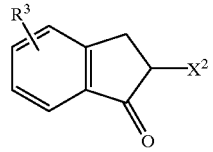

(5)

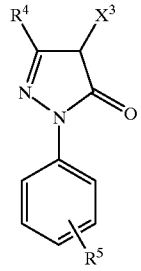

(6)

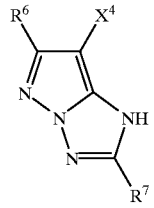

-continued (7)

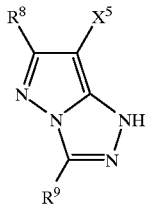

(8)

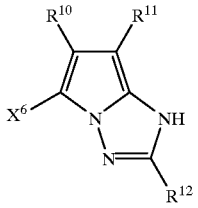

(9)

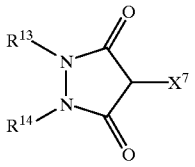

(10)

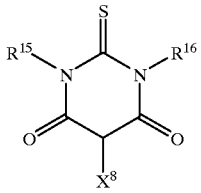

(11)

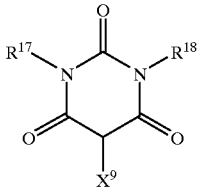

(12)

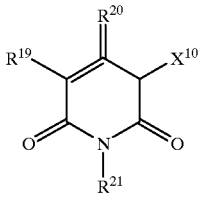

(13)

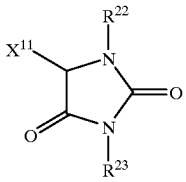

-continued (14)

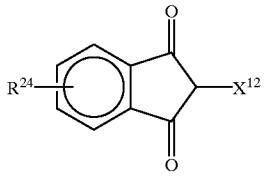

(15)

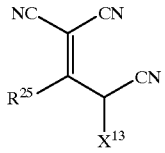

(16)

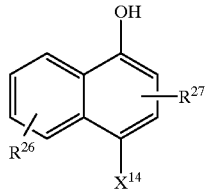

(17)

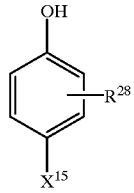

In the formulas (3) to (17), $X^1$ to $X^{15}$ each independently represent hydrogen atom or a substituent. In the formula (3), $R^1$ and $R^2$ each independently represent an electron-withdrawing group. In the formulas (3) to (17), $R^3$to $R^{28}$ each independently represent hydrogen atom or a substituent.

Preferably, the photothermographic material of the present invention further comprises (f) an organopolyhalogen compound represented by the formula (18) on the side of the support having the components (a) to (e).

$$Q^2\text{-}(Y)_n\text{-}CZ^1Z^2X \qquad (18)$$

In the formula (18), $Q^2$ represents an alkyl group, aryl group or heterocyclic group, which may have one or more substituents, Y represents a divalent bridging group, n represents 0 or 1, $Z^1$ and $Z^2$each independently represent a halogen atom, and X represents hydrogen atom or an electron-withdrawing group.

Preferably, the photothermographic material of the present invention further comprises (g) a compound represented by the formula (19) on the side of the support having the components (a) to (e).

(19)

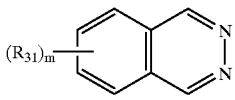

In the formula (19), $R^{31}$ represents hydrogen atom or a monovalent substituent, and m represents an integer of 1 to 6. $(R^{31})m$ means that 1–6 of $R^{31}$ independently exist on the phthalazine ring, and when m is 2 or more, adjacent two of $R^{31}$ may form an aliphatic ring or an aromatic ring.

Preferably, the photothermographic material of the present invention further comprises (h) at least one kind of a compound represented by any of the formulas (20), (21) and (22) on the side of the support having the components (a) to (e).

(20)

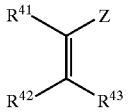

(21)

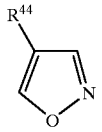

(22)

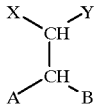

In the formula (20), $R^{41}$ to $R^{43}$ each independently represent hydrogen atom or a substituent, and Z represents an electron-withdrawing group or a silyl group. $R^{41}$ and Z, $R^{42}$ and $R^{43}$, $R^{41}$ and $R^{42}$, or $R^{43}$ and Z may combine with each other to form a ring structure.

In the formula (21), $R^{44}$ represents a substituent.

In the formula (22), X and Y independently represent hydrogen atom or a substituent, A and B each independently represent an alkoxy group, an alkylthio group, an alkylamino group, an aryloxy group, an arylthio group, an anilino group, a heterocyclyloxy group, a heterocyclylthio group or a heterocyclylamino group, and X and Y, or A and B may be combined with each other to form a ring structure.

Preferably, the photothermographic material of the present invention further comprises (i) at least one kind of a compound represented by the formula (23) or (24) on the side of the support having the components (a) to (e).

(23)

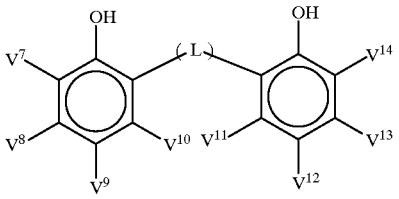

(24)

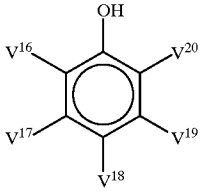

In the formula (23), $V^7$ to $V^{14}$ each independently represent hydrogen atom or a substituent. L represents a bridging group consisting of —CH($V^{15}$)— or —S—. $V^{15}$ represents hydrogen atom or a substituent. In the formula (24), $V^{16}$ to $V^{20}$ each independently represent hydrogen atom or a substituent.

Preferably, the coupler compound is a development inhibitor-releasing coupler.

Preferably, the photothermographic material of the present invention is a monosheet type photosensitive material.

According to another aspect of the present invention, there is provided a photothermographic material comprising (b) a reducible silver salt, (c) a compound represented by the formula (1) or (2) as defined in claim 1, (d) a binder and (j) a development inhibitor-releasing coupler represented by the following formula (24) on at least one same side of a support:

$$A\text{-}(TIME)_n\text{-}DI \qquad (24)$$

wherein, in the formula (24), A represents a coupler residue which releases $(TIME)_n$-DI by a coupling reaction with an oxidized form of the compound represented by the formula (1) or (2), TIME represents a timing group which releases $(TIME)_{n-1}$-DI after being released from A by a coupling reaction or a timing group which releases $(TIME)_{n-2}$-DI after being released from TIME, n represents an integer of 0–3, and when n is 2 or more, plural TIMEs may be the same or different, and DI represents a group which functions as a development inhibitor after being released from A or TIME.

According to another aspect of the present invention, there is provided a method for forming images, which comprises developing the aforementioned photothermographic material of the present invention by heating.

According to a further aspect of the present invention, there is provided a method for forming images, which comprises developing the aforementioned photothermographic material of the present invention by heating to obtain a dye image.

According to a sill further aspect of the present invention, there is provided a method for forming images, which comprises using the aforementioned photothermographic material of the present invention to obtain an overlapped image of dye image and silver image.

DETAILED EXPLANATION OF THE INVENTION

Figure 1:
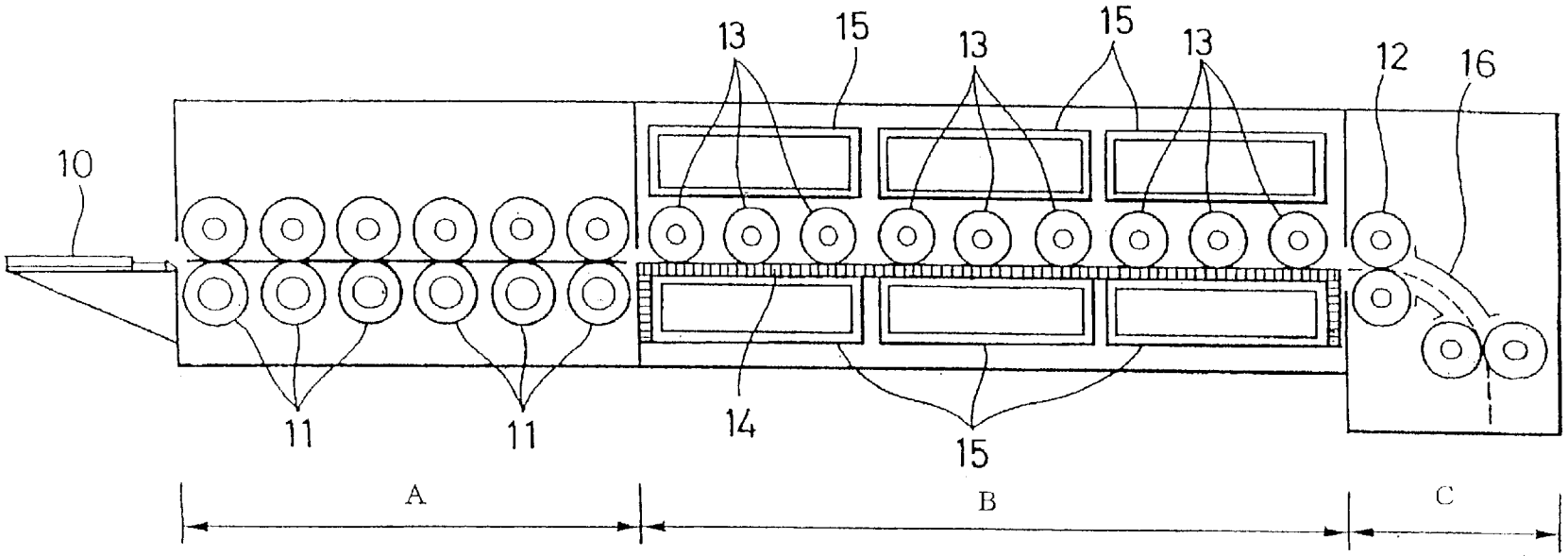
FIG. 1 is a side view of an exemplary heat development apparatus used for heat development of the photothermographic material of the present invention. In the FIGURE, there are shown a photothermographic material 10, carrying-in roller pairs 11, carrying-out roller pairs 12, rollers 13, a flat surface 14, heaters 15, and guide panels 16. The apparatus consists of a preheating section A, a heat development section B, and a gradual cooling section C.

The photothermographic material of the present invention is described in detail below. In the present specification, ranges indicated with "–" mean ranges including the numerical values before and after "–" as the minimum and maximum values. The entire disclosures of Japanese Patent Application Nos. 2000-76016, 2000-76053, 2000-76141, 2000-76173, 2000-85810, 2000-132181 and 2000-132270, based on which the present application claims Convention Priorities, are incorporated herein by reference.

The photothermographic material of the present invention comprises, on the same side of a support, an image-forming layer containing a silver salt of an organic acid, which is a reducible silver salt, and a binder, and a photosensitive silver halide emulsion layer (photosensitive layer) containing a photosensitive silver halide on the side of the image-forming layer side. The image-forming layer preferably serves also as the photosensitive layer. The material further contains a reducing compound in a layer on the image-forming layer side, and it is preferably an ultrahigh contrast photosensitive material containing an ultrahigh contrast agent. The photothermographic material of the present invention further comprises a coupler compound, and thus it can be a photothermographic material that enables control of color tone without reduction of maximum density (Dmax) or sensitivity, or without increasing fog (Dmin) in unexposed areas.

The photothermographic material of the present invention comprises a reducing compound represented by the aforementioned formula (1) or (2) on the same side of a support as the photosensitive silver halide and the reducible silver salt.

The reducing compounds represented by the formula (1) are developing agents collectively called sulfonamidophenol developing agents. In the formula, $V^1$to $^4$ each independently represent hydrogen atom or a substituent. Preferred examples of $V^1$ to $V^4$ include hydrogen atom, a halogen atom, an alkyl group, an aryl group, a carbonamido group, an alkylsulfonamido group, an arylsulfonamido group, an alkoxy group, an aryloxy group, an alkylthio group, an arylthio group, an acyl group, an alkoxycarbonyl group, an aryloxycarbonyl group, a carbamoyl group, cyano group, a sulfamoyl group, an alkylsulfonyl group, an arylsulfonyl group and an acyloxy group. Among $V^1$ to $V^4$, $V^2$ and $V^4$ preferably represent hydrogen atom. The sum of the Hammett's $\sigma_p$ values of $V^1$ to $V^4$ is preferably 0 or more, more preferably 0.2 or more, with the upper limit being preferably 1.2, more preferably 0.8. When the group represented by any of $V^1$ to $V^4$ is a group that can have a substituent, the group may be substituted, and preferred examples of the substituent are the same as those mentioned as $V^1$ to $V^4$.

$V^5$ represents a substituted or unsubstituted alkyl group, aryl group or heterocyclic group. Among these, $V^5$ preferably represents an aryl group, particularly preferably a substituted aryl group. Preferred examples of the substituent of aryl group include a halogen atom, an alkyl group, an aryl group, a carbonamido group, an alkylsulfonamido group, an arylsulfonamido group, an alkoxy group, an aryloxy group, an alkylthio group, an arylthio group, a carbamoyl group, a sulfamoyl group, cyano group, an alkylsulfonyl group, an arylsulfonyl group, an alkoxycarbonyl group, an aryloxycarbonyl group and an acyl group. If these substituent can have a substituent, they may further have one or more substituents, and preferred examples of the substituents are the same as those mentioned as $V^1$ to $V^4$. Further, these groups may be bonded together to form a ring. $V^5$ is further preferably an aryl group having at least one substituent at the ortho-position with respect to the carbon atom to which —$NHSO_2$— is bonded.

The compound represented by the formula (1) may have a ballast group. The ballast group used herein means a hydrophobic group, and it is a group containing a hydrophobic partial structure having 8–80 carbon atoms, preferably 10–40 carbon atoms.

Specific examples of the compounds represented by the formula (1) will be listed below. However, the compounds used for the present invention are not limited by these specific examples.

D-1

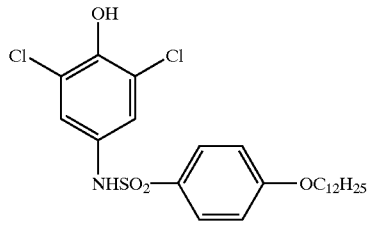

D-2

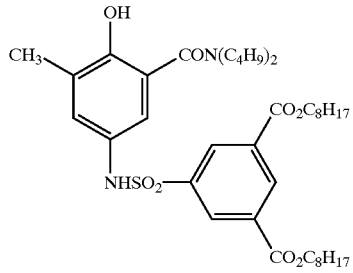

D-3

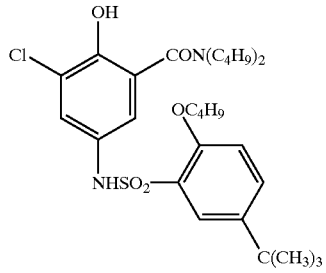

D-4

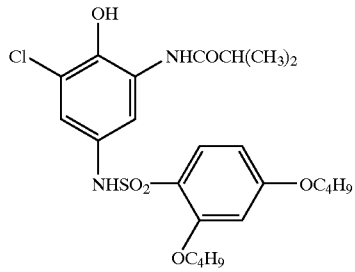

D-5

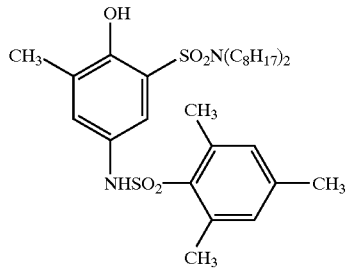

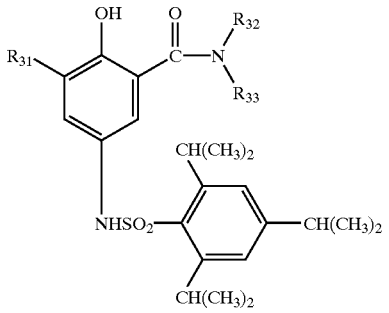
| | $R_{31}$ | $R_{32}$ | $R_{33}$ |
|---|---|---|---|
| D-6 | $CH_3$— | —$C_2H_5$ | —$C_2H_5$ |
| D-7 | $(CH_3)_3C$— | —$C_2H_5$ | —$C_2H_5$ |
| D-8 | $(CH_3)_2CH$— | —$C_3H_7$ | —$C_3H_7$ |
| D-9 | $CH_3$— | —$C_4H_9$ | —$C_4H_9$ |
| D-10 | $CH_3$— | —$C_6H_{13}$ | —$C_6H_{13}$ |
| D-11 | $CH_3$— | —$C_8H_{17}$ | —$C_8H_{17}$ |
| D-12 | $CH_3$— | —$C_{18}H_{37}$ | —$C_{18}H_{37}$ |
| D-13 | $CH_3$— | —$C_{18}H_{37}$ | —$CH_3$ |
| D-14 | $CH_3$— | —$CH_2CH_2OCH_3$ | —$CH_2CH_2OCH_3$ |
| D-15 | $CH_3$— | —$C_6H_{13}$ | —H |
| D-16 | $(CH_3)_3C$— | —$C_4H_9$ | —H |
| D-17 | $(CH_3)_2CH$— | —$C_4H_9$ | —H |
| D-18 | $CH_3$— | —$C_8H_{17}$ | —H |
| D-19 | $CH_3CONH$— | —$C_2H_5$ | —$C_2H_5$ |
| D-20 | $CH_3CON(CH_3)$— | —$C_2H_5$ | —$C_2H_5$ |
D-21
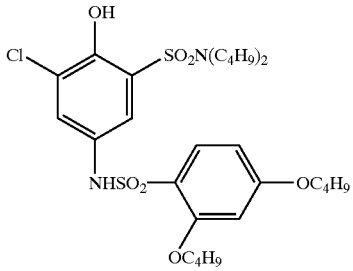
D-22
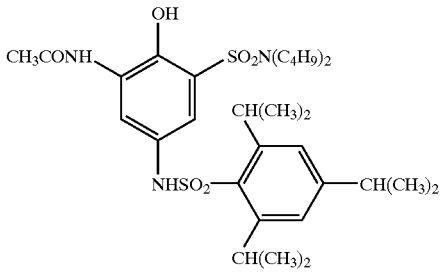
D-23
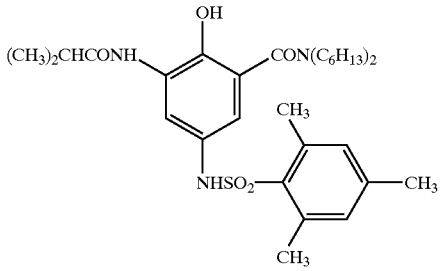
-continued
D-24
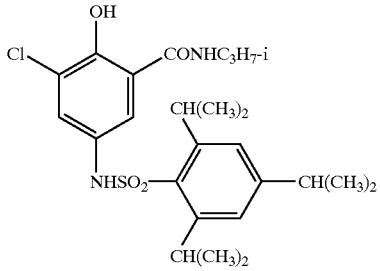
D-25
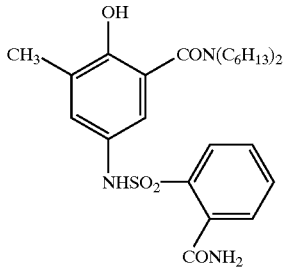
D-26
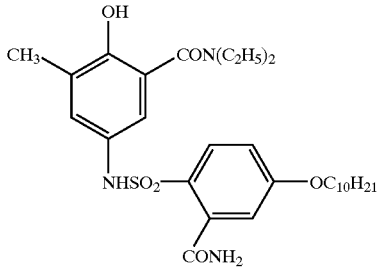
D-27
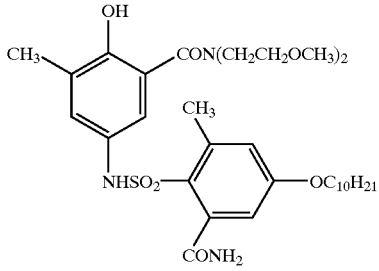
D-28
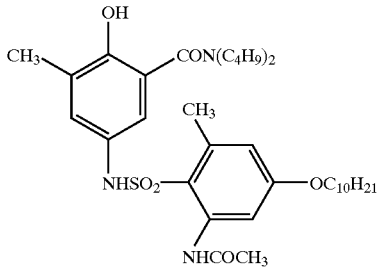

-continued

D-29

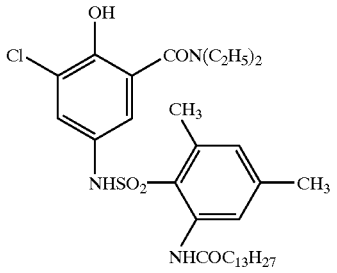

D-30

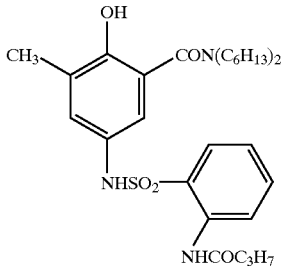

The compounds represented by the formula (1) can be synthesized by known methods described in, for example, JP-A-9-146248.

The reducing compounds represented by the formula (2) are developing agents collectively called hydrazine developing agents. In the formula, $Q^1$ represents a 5- to 7-membered unsaturated ring bonding to NHNH—$V^6$ at a carbon atom, and $V^6$ represents a carbamoyl group, an acyl group, an alkoxycarbonyl group, an aryloxycarbonyl group, a sulfonyl group or a sulfamoyl group.

Preferred examples of the 5- to 7-membered unsaturated ring represented by $Q^1$ include benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isoxazole ring, thiophene ring and so forth. Condensed rings in which these rings are condensed together are also preferred. These rings may have, as substituents, one or more of the groups mentioned above as preferred substituents of the aryl group. When they have two or more substituents, those substituents may be identical or different from each other or one another.

The carbamoyl group represented by $V^6$ has preferably 1–50 carbon atoms, more preferably 6–40 carbon atoms. Examples thereof include, for example, unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl and N-benzylcarbamoyl.

The acyl group represented by $V^6$ has preferably 1–50 carbon atoms, more preferably 6–40 carbon atoms. Examples thereof include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl and 2-hydroxymethylbenzoyl.

The alkoxycarbonyl group represented by $v^6$has preferably 2–50 carbon atoms, more preferably 6–40 carbon atoms. Examples thereof include, for example, methoxycarbonyl, ethoxycarbonyl, isobutyloxycarbonyl cyclohexyloxycarbonyl, dodecyloxycarbonyl and benzyloxycarbonyl.

The aryloxycarbonyl group represented by $V^6$ has preferably 6–50 carbon atoms, more preferably 6–40 carbon atoms. Examples thereof include, for example, phenoxycarbonyl, 4-octyloxyphenoxycarbonyl, 2-hydroxymethylphenoxycarbonyl and 4-dodecyloxyphenoxycarbonyl.

The sulfonyl group represented by $V^6$ has preferably 1–50 carbon atoms, more preferably 6–40 carbon atoms. Examples thereof include, for example, methylsulfonyl, butylsulfonyl, octylsulfonyl, 2-hexadecylsulfonyl, 3-dodecyloxypropylsulfonyl, 2-octyloxy-5-tert-octylphenylsulfonyl and 4-dodecyloxyphenylsulfonyl.

The sulfamoyl group represented by $V^6$ has preferably 0–50 carbon atoms, more preferably 6–40 carbon atoms. Examples thereof include, for example, unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl and N-(2-tetradecyloxyphenyl)sulfamoyl.

The groups represented by $V^6$ may further have at substitutable positions one or more of the groups mentioned above as preferred substituents of the aryl group represented by $V^5$. When they have two or more substituents, those substituents may be identical or different from each other or one another.

The preferred compounds represented by the formula (2) will be explained hereinafter.

Among the compounds represented by the formula (2), those having a 5- or 6-membered unsaturated ring as $Q^1$ are preferred. More preferably, $Q^1$ is benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thiazole ring, oxazole ring, isothiazole ring, isoxazole ring or a ring consisting of any of these rings condensed with benzene ring or unsaturated heterocyclic ring. $V^6$ is preferably a carbamoyl group. Particularly preferably, $V^6$ is a carbamoyl group having hydrogen atom on the nitrogen atom.

Specific examples of the reducing compounds represented by the formula (2) will be listed below. However, the compounds used for the present invention are not limited by these specific examples.

D-101
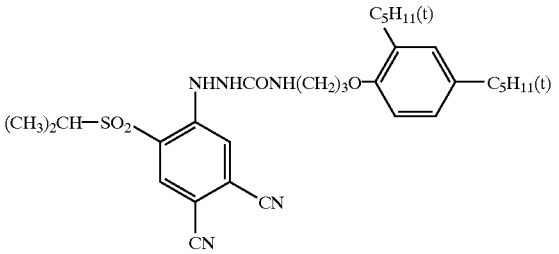
D-102
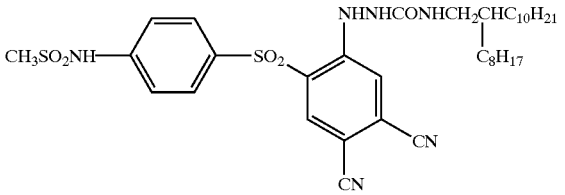
D-103
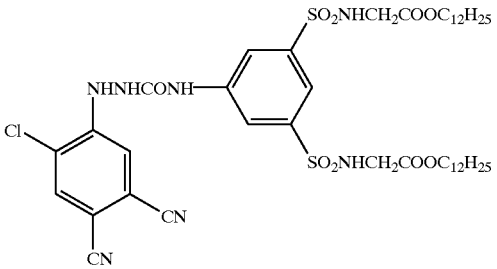
D-104
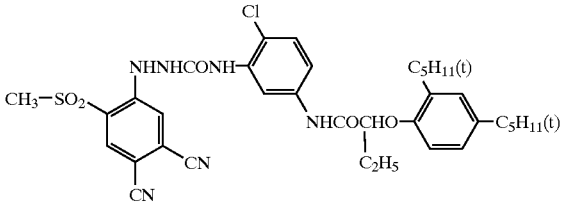
D-105
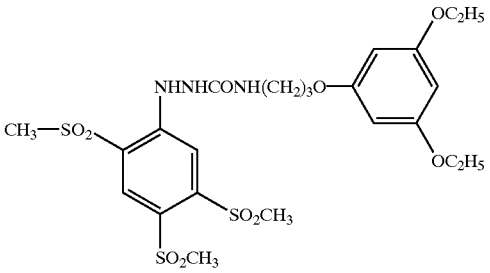
D-106
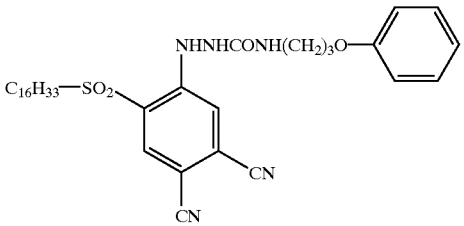
D-107
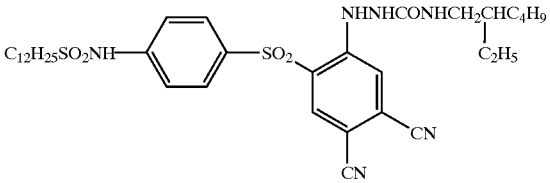
D-108
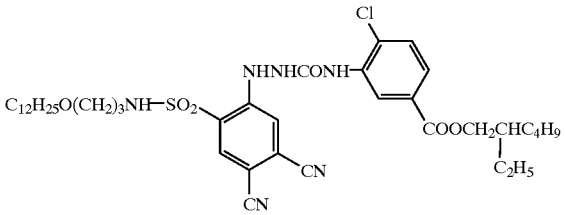
D-109
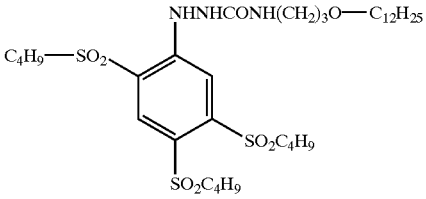
D-110
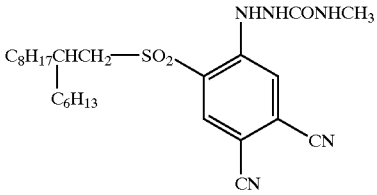
D-111
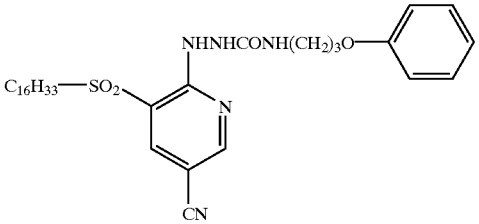
D-112
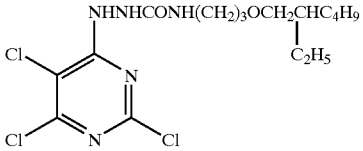

-continued
D-113
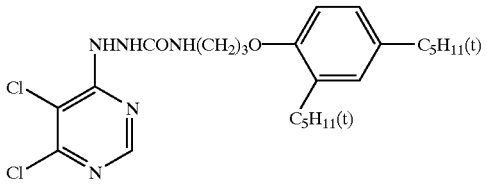
D-114
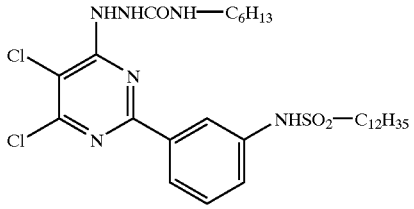
D-115
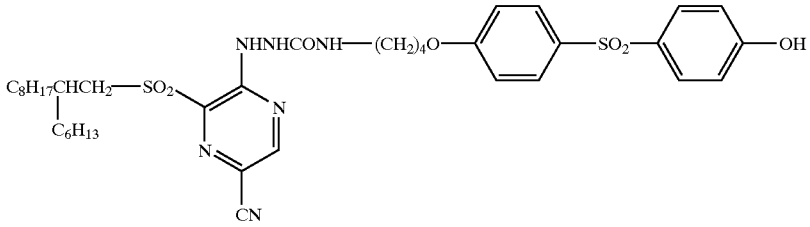
D-116
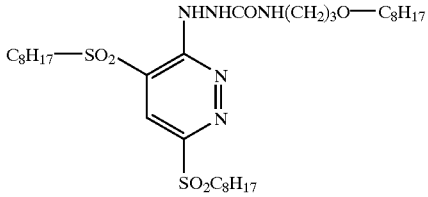
D-117
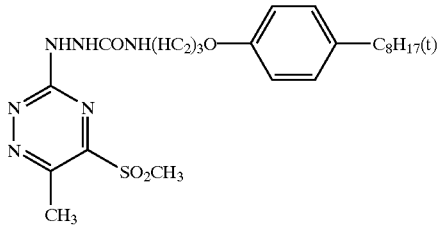
D-118
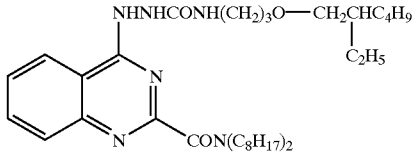
D-119
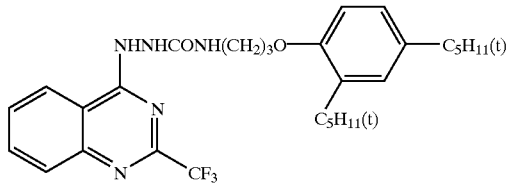
D-120
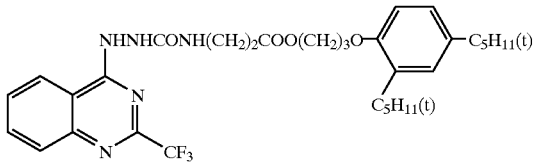
D-121
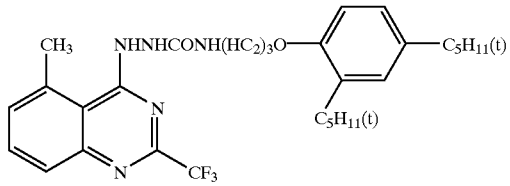
D-122
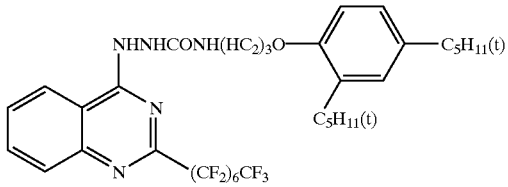
D-123
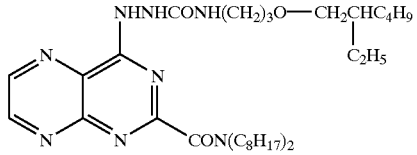
D-124
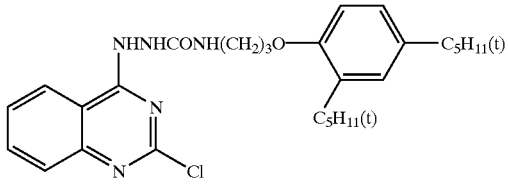
D-125
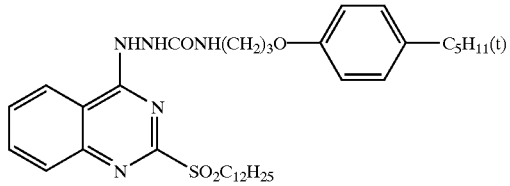

-continued
D-126
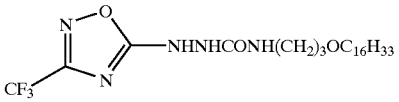
D-127
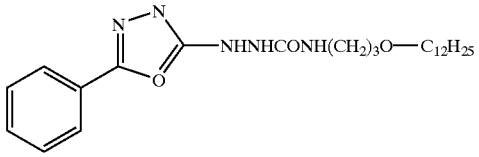
D-128
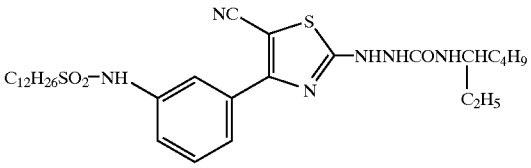
D-129
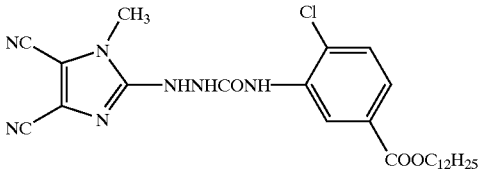
D-130
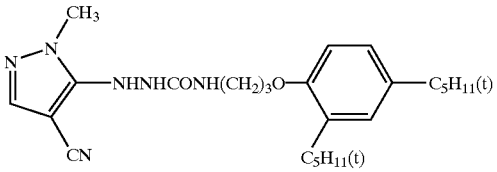
D-131
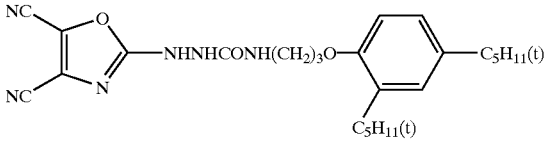
D-132
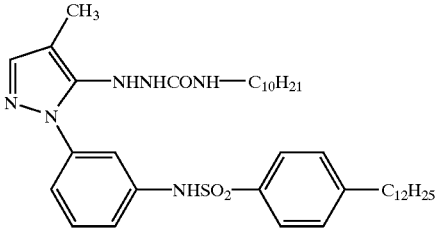
D-133
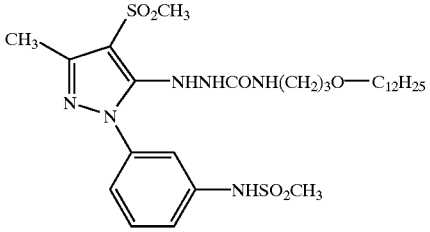
D-134
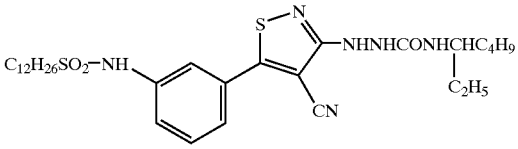
D-135
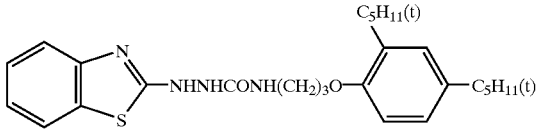
D-136
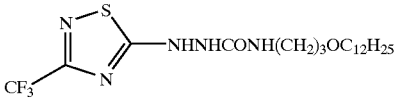
D-137
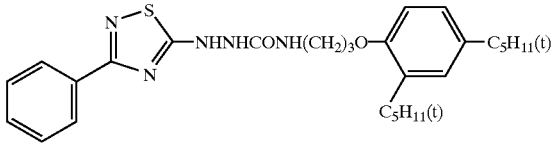
D-138
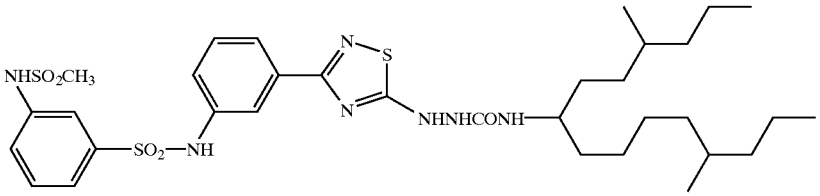
D-139
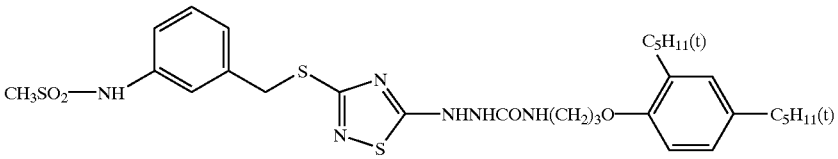

-continued
D-140
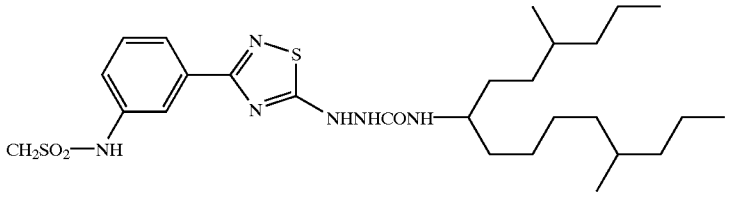
D-141
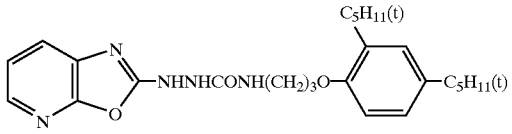
D-142
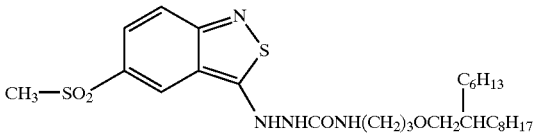
D-143
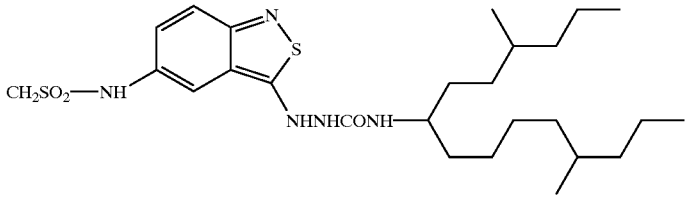
D-144
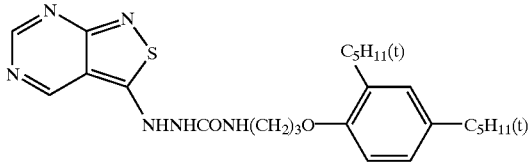
D-145
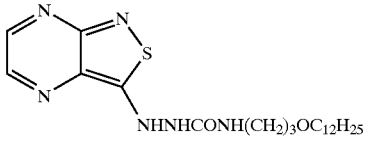
D-146
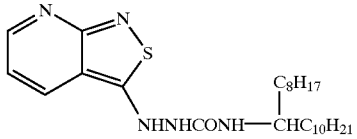
D-147
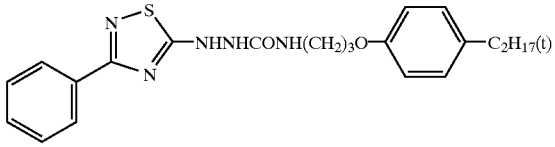
D-148
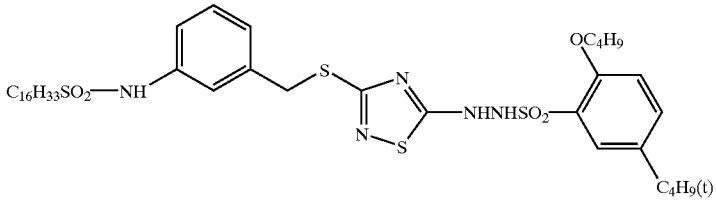
D-149
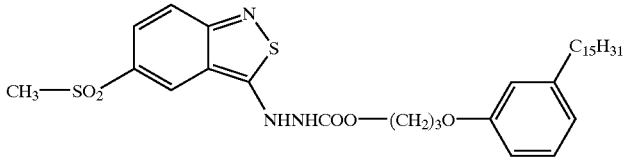
D-150
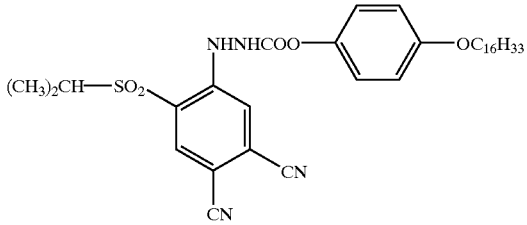
D-151
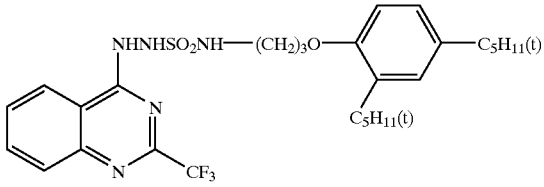

-continued

D-152

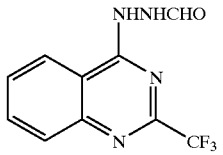

D-153

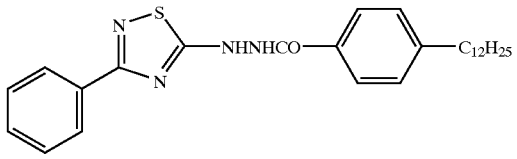

D-154

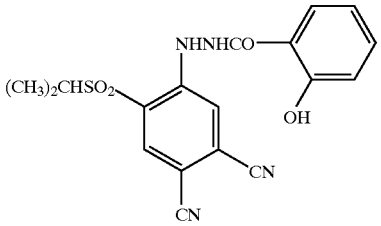

The compounds represented by the formula (2) can be synthesized according to the methods described in JP-A-9-152702, JP-A-8-286340, JP-A-9-152700, JP-A-9-152701, JP-A-9-152703, JP-A-9-152704 and so forth.

While the amount of the reducing compound represented by the formula (1) or (2) may be selected within a wide range, it is preferably 0.01–100 times, more preferably 0.1–10 times, of the coupler compound in mole.

The reducing compound represented by the formula (1) or (2) may be added to a coating solution in any form, for example, as a solution, powder, solid microparticle dispersion, emulsion, oil-protected dispersion and so forth. The solid microparticle dispersion can be formed by a known pulverization means (for example, a ball mill, vibration ball mill, sand mill, colloid mill, jet mill, roller mill etc.). Further, when solid microparticle dispersion is prepared, a dispersing aid may be used.

The photothermographic material of the present invention contains a coupler compound on the same side of the support as the photosensitive silver halide and reducible silver salt. As the coupler compound used for the present invention, divalent or tetravalent couplers known in the photographic art can be used. Examples of the couplers include couplers having the functions explained in N. Furutachi, "Organic Compounds for Conventional Color Photography", Journal of The Society of Synthetic Organic Chemistry, Japan, Vol. 41, p. 439, 1983). Among those, any of the compounds represented by the aforementioned formulas (3) to (17) is preferably used.

In the formulas (3) to (17), $X^1$ to $X^{15}$ each independently represent hydrogen atom or a substituent. Examples of the substituents represented by $X^1$ to $X^{15}$ include a halogen atom (for example, fluorine atom, chlorine atom, bromine atom and iodine atom), an aryl group having preferably 6–30 carbon atoms, more preferably 6–20 carbon atoms, further preferably 6–12 carbon atoms (for example, phenyl, p-methylphenyl, naphthyl etc.), an alkoxy group having preferably 1–20 carbon atoms, more preferably 1–12 carbon atoms, further preferably 1–8 carbon atoms (for example, methoxy, ethoxy, butoxy etc.), an aryloxy group having preferably 6–20 carbon atoms, more preferably 6–16 carbon atoms, further preferably 6–12 carbon atoms (for example, phenyloxy, 2-naphthyloxy etc.), an alkylthio group having preferably 1–20 carbon atoms, more preferably 1–16 carbon atoms, further preferably 1–12 carbon atoms (for example, methylthio, ethylthio, butylthio etc.), an arylthio group having preferably from 6 to 20 carbon atoms, more preferably from 6 to 16 carbon atoms, further preferably from 6 to 12 carbon atoms (for example, phenylthio, naphthylthio etc.), an acyloxy group having preferably 1–20 carbon atoms, more preferably 2–16 carbon atoms, further preferably 2–10 carbon atoms (for example, acetoxy, benzoyloxy etc.), an alkoxycarbonyloxy group having preferably 2–32 carbon atoms, more preferably 3–23 carbon atoms (for example, ethoxycarbonyloxy, dodecyloxycarbonyloxy, hexadecyloxycarbonyloxy, 2-hexyldecyloxycarbonyloxy etc.), a carbamoyloxy group having preferably 1–32 carbon atoms, more preferably 3–23 carbon atoms (for example, N,N-dimethylcarbamoyloxy, N-methyl-N-octadecylcarbamoyloxy, morpholinocarbonyloxy etc.), an acylamino group having preferably 2–20 carbon atoms, more preferably 2–16 carbon atoms, further preferably 2–10 carbon atoms (for example, N-methylacetylamino, benzoylamino etc.), a sulfonylamino group having preferably 1–20 carbon atoms, more preferably 1–16 carbon atoms, further preferably 1–12 carbon atoms (for example, methanesulfonylamino, benzenesulfonylamino etc.), a carbamoyl group having preferably 1–20 carbon atoms, more preferably 1–16 carbon atoms, further preferably 1–12 carbon atoms (for example, carbamoyl, N,N-diethylcarbamoyl, N-phenylcarbamoyl etc.), an acyl group having preferably 2–20 carbon atoms, more preferably 2–16 carbon atoms, further preferably 2–12 carbon atoms (for example, acetyl, benzoyl, formyl, pivaloyl etc.), an alkoxycarbonyl groups having preferably 2–20 carbon atoms, more preferably 2–16 carbon atoms, further preferably 2–12 carbon atoms (for example, methoxycarbonyl etc.), a sulfo group, a sulfonyl group having preferably 1–20 carbon atoms, more preferably 1–16 carbon atoms, further preferably 1–12 carbon atoms (for example, mesyl, tosyl etc.), a sulfonyloxy group having preferably 1–20 carbon atoms, more preferably 1–16 carbon atoms, further preferably 1–12 carbon atoms (for example, methanesulfonyloxy, benzenesulfonyloxy etc.), an azo group, a heterocyclic group, a heterocyclylmercapto group, a cyano group and so forth. The heterocyclic group used herein represents a saturated or unsaturated heterocyclic group, and examples thereof include, for example, pyridyl group, quinolyl group, quinoxalinyl group, pyrazinyl group, benzotriazolyl group, pyrazolyl group, imidazolyl group, benzimidazolyl group, tetrazolyl group, hydantoin-1-yl group, succinimido group, phthalimido group and so forth.

As the substituents represented by $X^1$ to $X^{15}$, those known as leaving groups of divalent couplers for photography are preferred among those mentioned above, and examples thereof include, for example, hydrogen atom, a halogen atom, an alkoxy group, an aryloxy group, an alkylthio group, an arylthio group, a heterocyclic group bonding at nitrogen atom, a heterocyclylmercapto group, an acyloxy group, an alkoxycarbonyloxy group, a carbamoyloxy group and so forth. A halogen atom is particularly preferred.

The substituents represented by $X^1$ to $X^15$ may further be substituted with one or more other substituents, and such substituents may be any substituents so long as they do not degrade the photographic performance.

In the formula (3), $R^1$ and $R^2$ each independently represent an electron-withdrawing group. The electron-withdrawing group used herein means a substituent that gives a positive value of the Hammett's substituent constant σp, and specific examples thereof include a cyano group, an alkoxycarbonyl group, an aryloxycarbonyl group, a carbamoyl group, an imino group, a thiocarbonyl group, an alkylsulfonyl group, an arylsulfonyl group, a nitro group, a halogen atom, an acyl group, a benzoyl group, a formyl group, a phosphoryl group, a carboxyl group (or a salt thereof), a sulfo group (or a salt thereof), a heterocyclic group and so forth. The heterocyclic group is a saturated or unsaturated heterocyclic group, and examples thereof include pyridyl group, quinolyl group, quinoxalinyl group, pyrazinyl group, benzotriazolyl group, imidazolyl group, benzimidazolyl group, hydantoin-1-yl group, succinimido group, phthalimido group, indolynyl group and so forth. The electron-withdrawing group represented by $R^1$ or $R^2$ in the formula (4) preferably has 30 carbon atoms or less, more preferably 20 carbon atoms or less.

$R^1$ and $R^2$ preferably represent a cyano group, an alkoxycarbonyl group, an aryloxycarbonyl group, a carbamoyl group, an imino group, an acyl group, benzoyl group or a heterocyclic group.

$R^1$ and $R^2$ may be the same or different from each other, or may be bonded together to form a saturated or unsaturated carbon ring or heterocycle.

In the formulas (4) to (17), $R^3$ to $R^{28}$ each independently represent hydrogen atom or a substituent. As the substituents represented by $R^3$to $R^{28}$, any of substituents that do not degrade photographic performance may be used. Examples thereof include, for example, a halogen atom (for example, fluorine atom, chlorine atom, bromine atom and iodine atom), a linear, branched or cyclic alkyl group or an alkyl group consisting of a combination thereof having preferably 1–20 carbon atoms, more preferably 1–16 carbon atoms, further preferably 1–13 carbon atoms (for example, methyl, ethyl, n-propyl, isopropyl, sec-butyl, tert-butyl, tert-octyl, n-amyl, tert-amyl, n-dodecyl, n-tridecyl, cyclohexyl etc.), an alkenyl group having preferably 2–20 carbon atoms, more preferably 2–16 carbon atoms, further preferably 2–12 carbon atoms (for example, vinyl, allyl, 2-butenyl, 3-pentenyl etc.), an aryl group having preferably 6–30 carbon atoms, more preferably 6–20 carbon atoms, further preferably 6–12 carbon atoms (for example, phenyl, p-methylphenyl, naphthyl etc.), an alkoxy group having preferably 1–20carbon atoms, more preferably 1–16 carbon atoms, further preferably 1–12 carbon atoms (for example, methoxy, ethoxy, propoxy, butoxy etc.), an aryloxy group having preferably 6–30 carbon atoms, more preferably 6–20carbon atoms, further preferably 6–12 carbon atoms (for example, phenyloxy, 2-naphthyloxy etc.), an acyloxy group having preferably 2–20 carbon atoms, more preferably 2–16 carbon atoms, further preferably 2–12 carbon atoms (for example, acetoxy, benzoyloxy etc.) an amino group having preferably 0–20 carbon atoms, more preferably 1–16 carbon atoms, further preferably 1–12 carbon atoms (for example, dimethylamino group, diethylamino group, dibutylamino group, anilino group etc.), an acylamino group having preferably 2–20 carbon atoms, more preferably 2–16 carbon atoms, further preferably 2–13 carbon atoms (for example, acetylamino, tridecanoylamino, benzoylamino etc.), a sulfonylamino group having preferably 1–20 carbon atoms, more preferably 1–16 carbon atoms, further preferably 1–12 carbon atoms (for example, methanesulfonylamino, butanesulfonylamino, benzenesulfonylamino etc.), a ureido group having preferably 1–20 carbon atoms, more preferably 1–16 carbon atoms, further preferably 1–12 carbon atoms (for example, ureido, methylureido, phenylureido etc.), a carbamate group having preferably 2–20 carbon atoms, more preferably 2–16 carbon atoms, further preferably 2–12 carbon atoms (for example, methoxycarbonylamino, phenyloxycarbonylamino etc.), a carboxyl group, a carbamoyl group having preferably 1–20 carbon atoms, more preferably 1–16 carbon atoms, further preferably 1–12 carbon atoms (for example, carbamoyl, N,N-diethylcarbamoyl, N-dodecylcarbamoyl, N-phenylcarbamoyl etc.), an alkoxycarbonyl group having preferably 2–20 carbon atoms, more preferably 2–16 carbon atoms, further preferably 2–12 carbon atoms (for example, methoxycarbonyl, ethoxycarbonyl, butoxycarbonyl etc.), an acyl group having preferably 2–20 carbon atoms, more preferably 2–16 carbon atoms, further preferably 2–12 carbon atoms (for example, acetyl, benzoyl, formyl, pivaloyl etc.), a sulfo group, a sulfonyl group having preferably 1–20 carbon atoms, more preferably 1–16 carbon atoms, further preferably 1–12 carbon atoms (for example, mesyl, tosyl etc.), a sulfamoyl group having preferably 0–20 carbon atoms, more preferably 0–16 carbon atoms, further preferably 0–12 carbon atoms (for example, sulfamoyl, methylsulfamoyl, dimethylsulfamoyl, phenylsulfamoyl, etc.), a cyano group, a nitro group, a hydroxyl group, a mercapto group, an alkylthio group having preferably 1–20 carbon atoms, more preferably 1–16 carbon atoms, further preferably 1–12 carbon atoms (for example, methylthio, butylthio etc.), a heterocyclic group having preferably 2–20 carbon atoms, more preferably 2–16 carbon atoms, further preferably 2–12 carbon atoms (for example, pyridyl, imidazoyl, pyrrolidyl etc.) and so forth. These substituents may be further substituted with other substituents.

Preferred examples of the substituents represented by $R^3$ to $R^{28}$ are, among those mentioned above, a halogen atom, an alkyl group, an aryl group, an alkoxy group, an aryloxy group, an acyloxy group, an anilino group, an acylamino group, a sulfonylamino group, a carboxyl group, a carbamoyl group, an acyl group, a sulfo group, a sulfonyl group, a sulfamoyl group, a cyano group, a hydroxyl group, a mercapto group, an alkylthio group and a heterocyclic group.

Among the compounds represented by the formulas (3) to (17) preferably used as the coupler compound, more preferred are those compounds represented by the formula (3), (5), (6), (7), (8), (9), (13), (15), (16) or (17), and particularly preferred are those compounds represented by the formula (3), (5), (6), (7), (8), (16) or (17).

Specific examples of the compounds represented by the formulas (3) to (17) will be shown below. However, the coupler compounds used for the present invention are not limited to these specific examples.

(A-101)
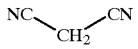
(A-102)
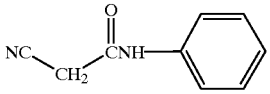
(A-103)
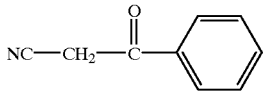
(A-104)
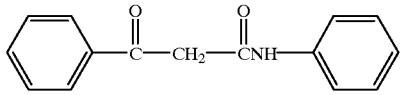
(A-105)
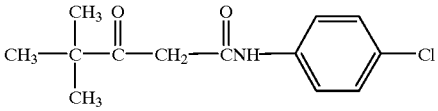
(A-106)
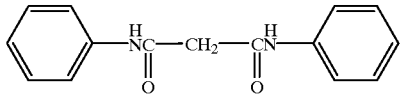
(A-107)
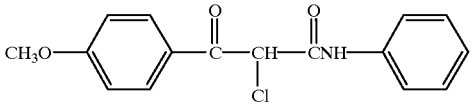
(A-108)
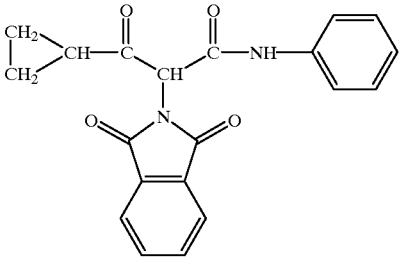
(A-109)
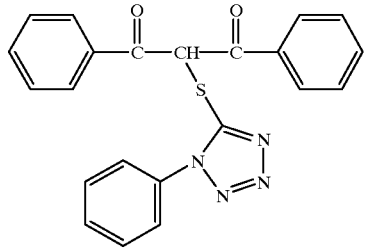
(A-110)
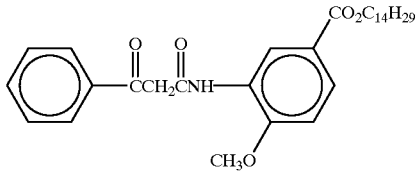
(A-111)
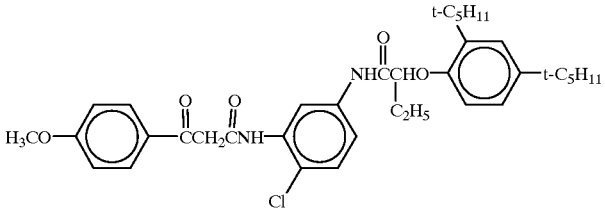
(A-112)
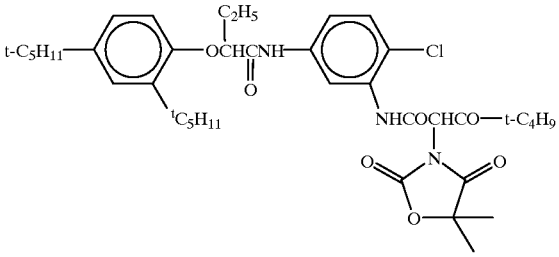
(A-113)
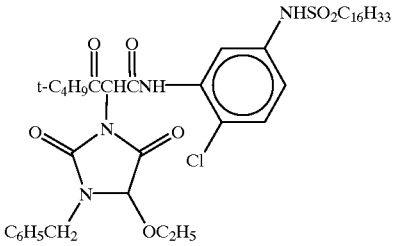
(A-114)
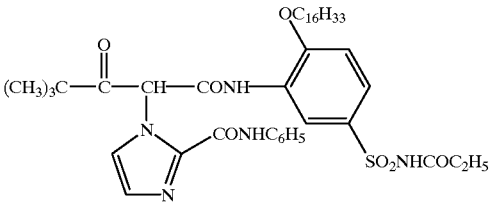

-continued
(A-115)
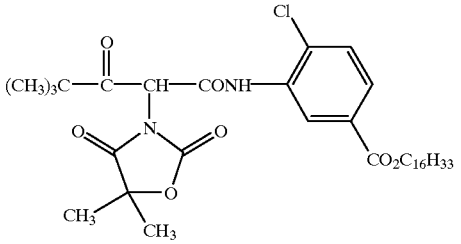
(A-116)
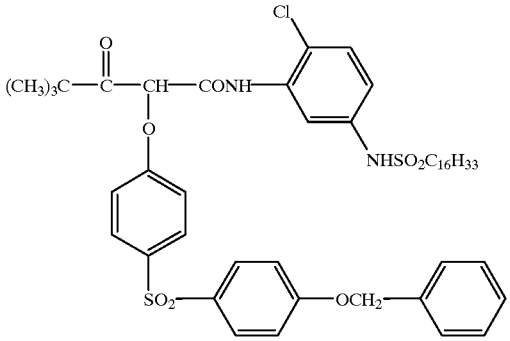
(A-117)
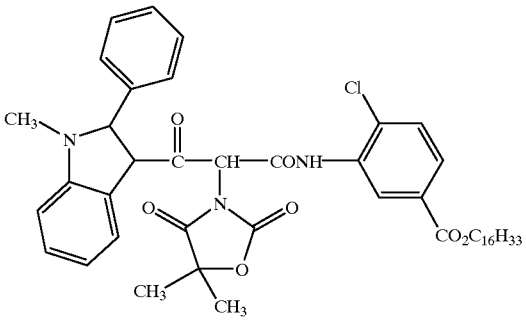
(A-118)
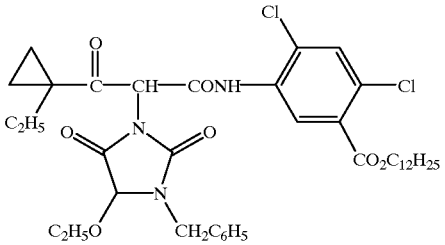
(A-119)
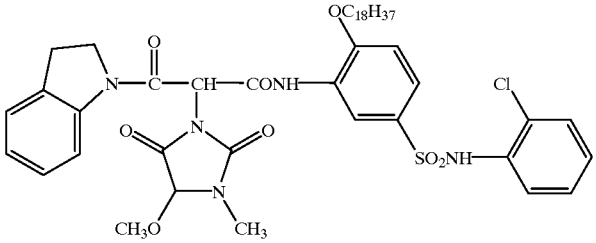
(A-120)
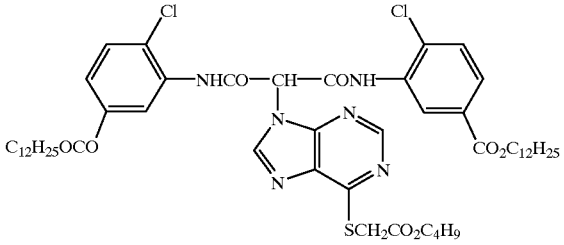
(A-121)
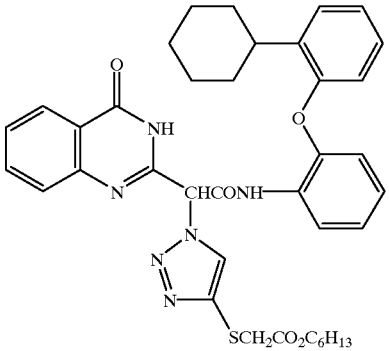

-continued
(A-122)
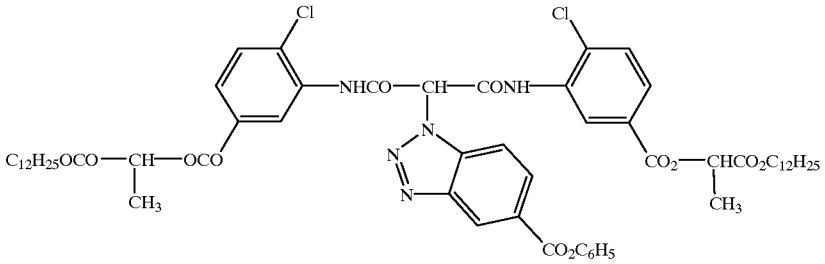
(A-201)
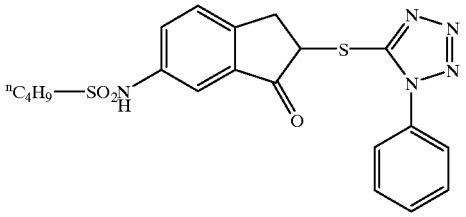
(A-202)
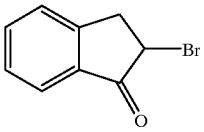
(A-203)
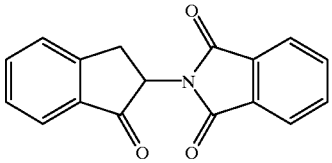
(A-204)
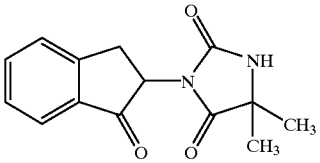
(A-205)
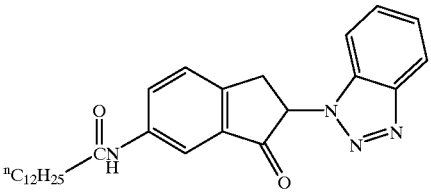
(A-206)
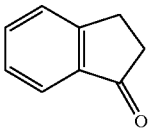
(A-207)
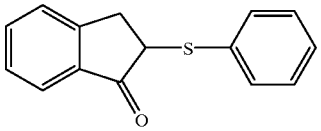
(A-208)
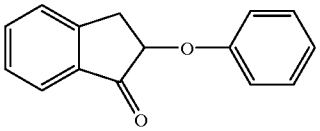
(A-209)
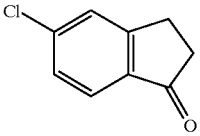
(A-301)
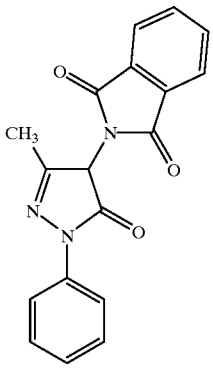

-continued
(A-302)
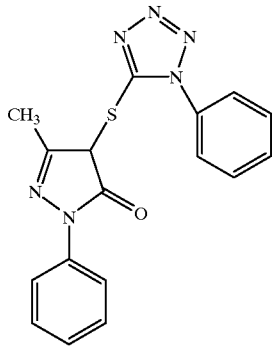
(A-303)
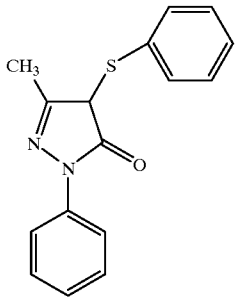
(A-304)
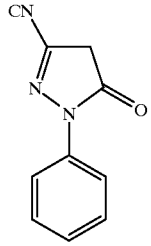
(A-305)
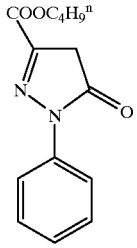
(A-306)
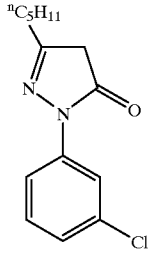
(A-307)
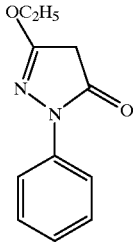
(A-308)
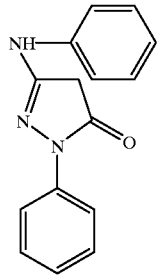
(A-309)
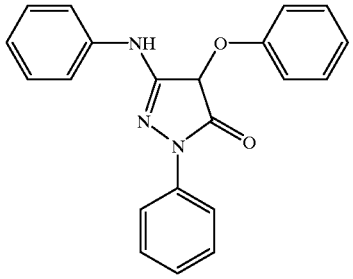
(A-310)
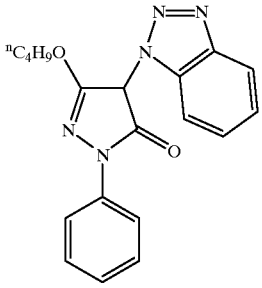
(A-311)
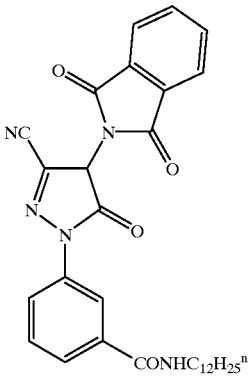

-continued
(A-312)
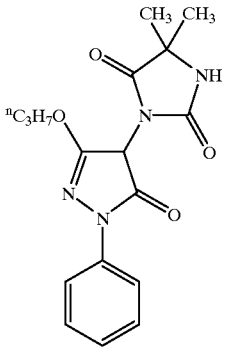
(A-313)
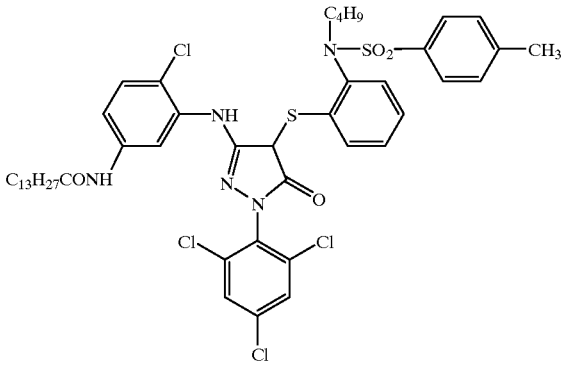
(A-314)
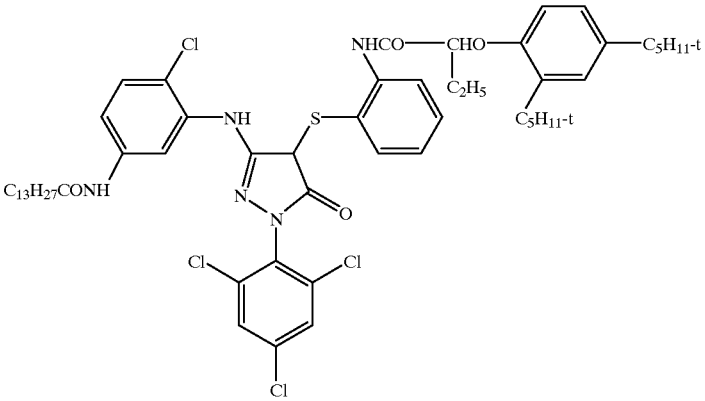
(A-315)
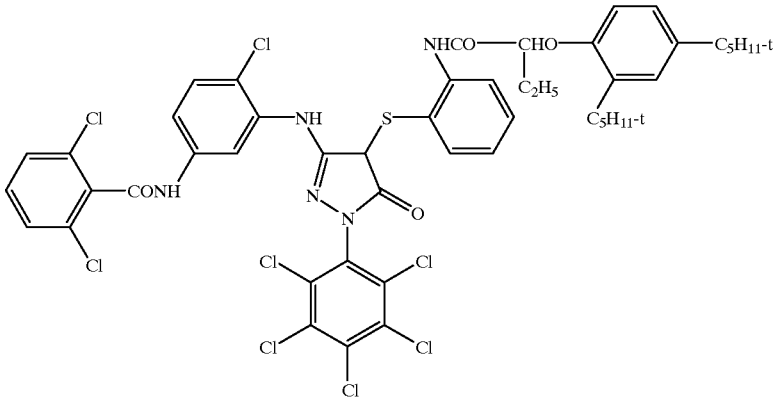
(A-316)
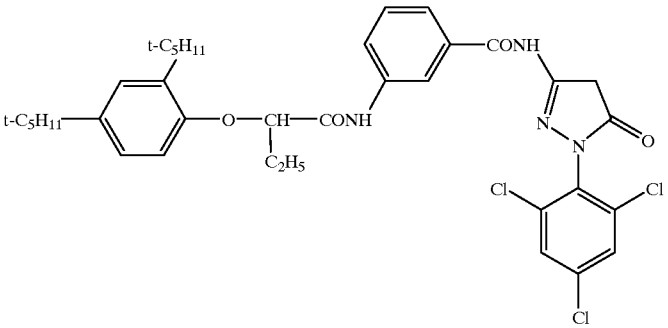

-continued
(A-317)
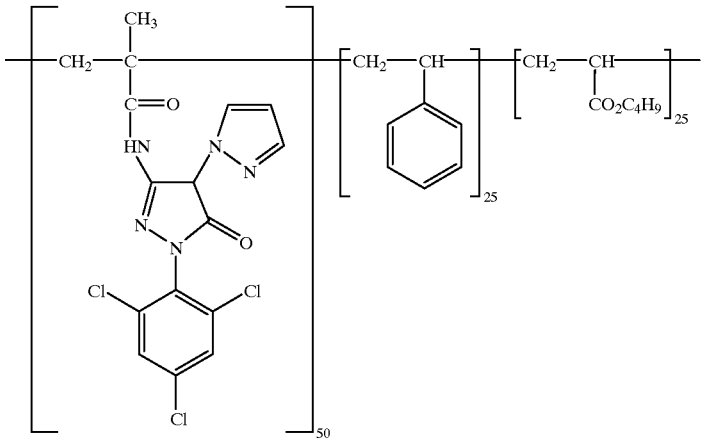
(A-401)
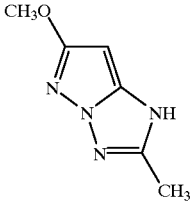
(A-402)
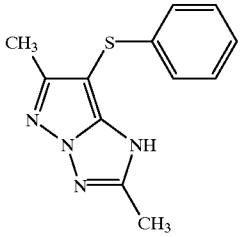
(A-403)
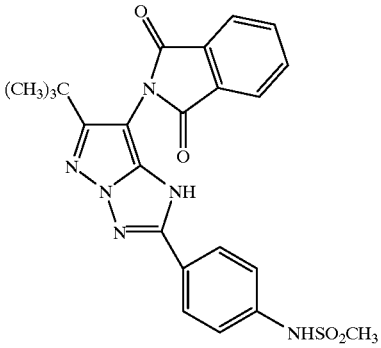
(A-404)
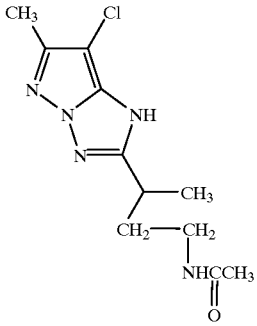
(A-405)
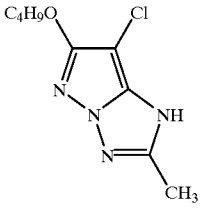
(A-406)
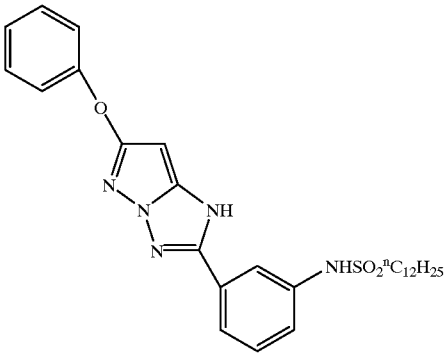

-continued
(A-407)
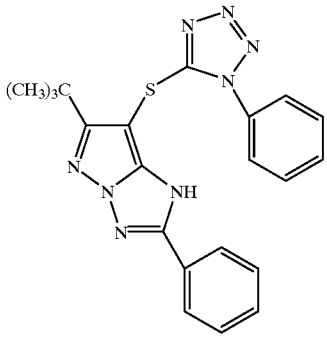
(A-408)
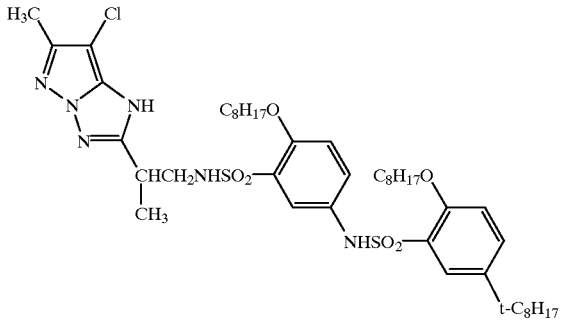
(A-409)
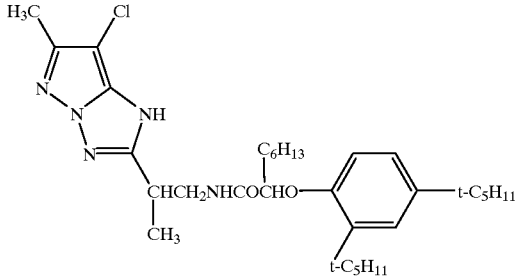
(A-410)
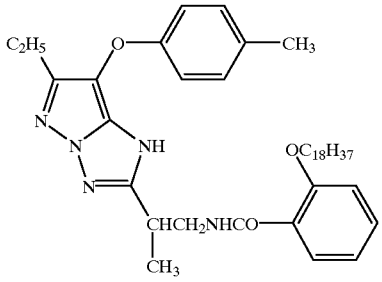
(A-411)
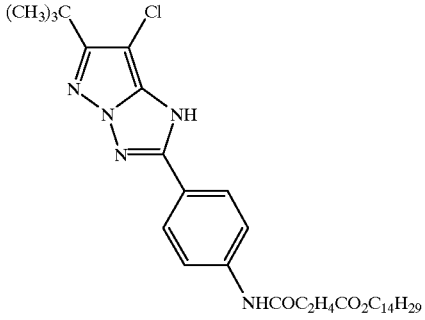
(A-412)
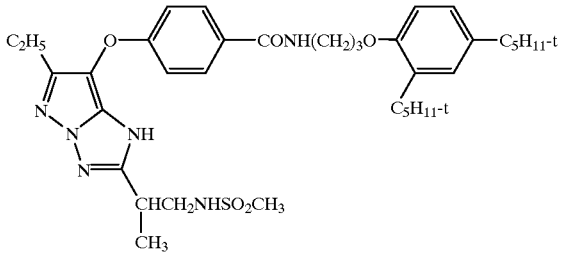
(A-413)
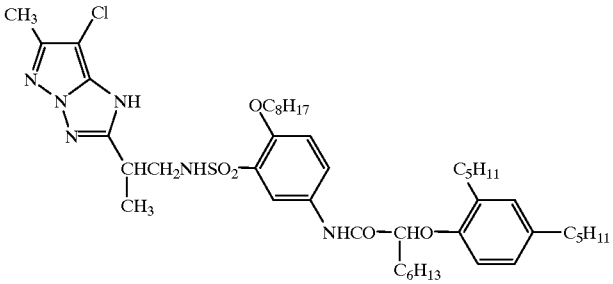
(A-414)
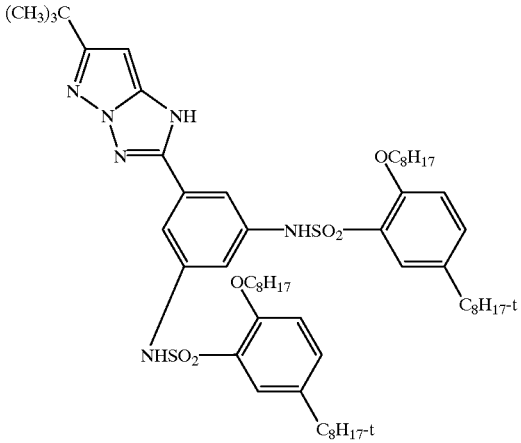

-continued
(A-415)
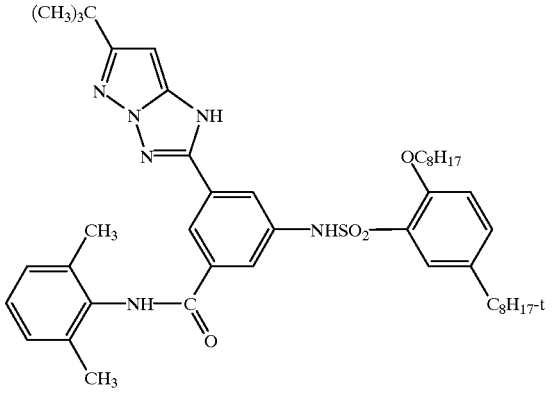
(A-501)
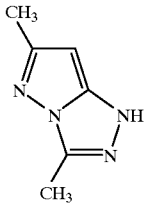
(A-502)
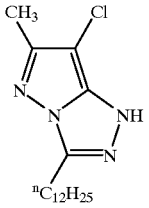
(A-503)
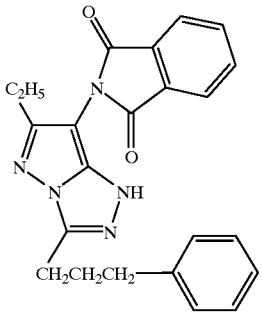
(A-504)
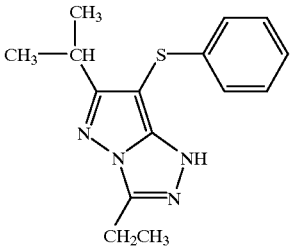
(A-505)
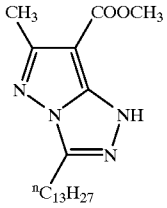
(A-506)
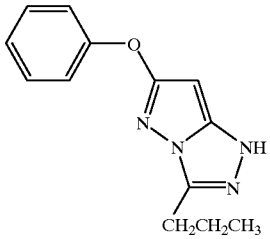
(A-507)
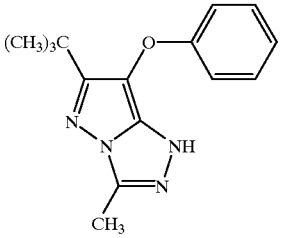
(A-508)
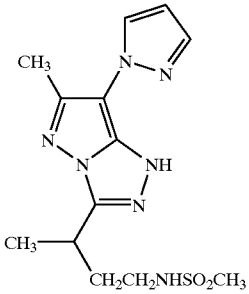
(A-509)
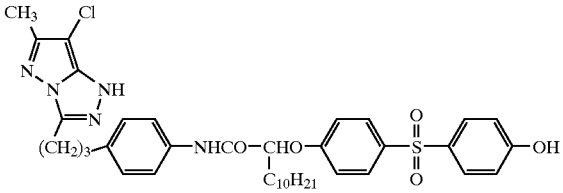

-continued
(A-510)
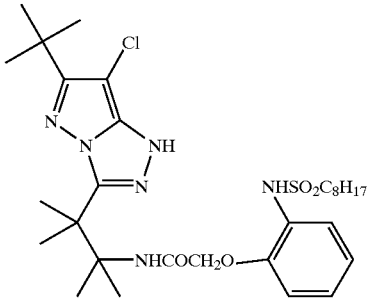
(A-511)
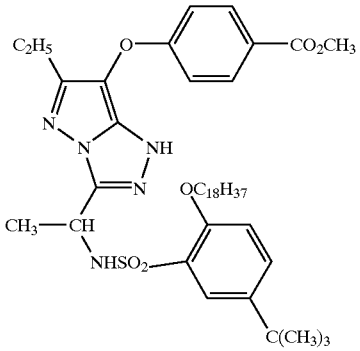
(A-512)
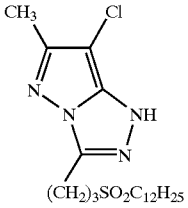
(A-513)
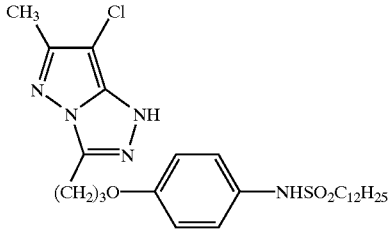
(A-601)
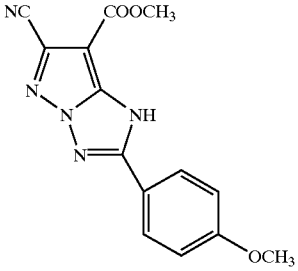
(A-602)
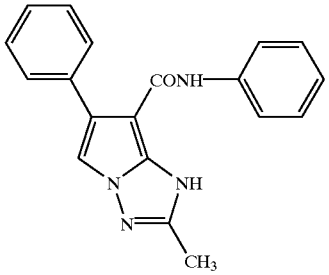
(A-603)
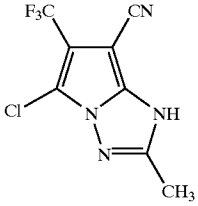
(A-604)
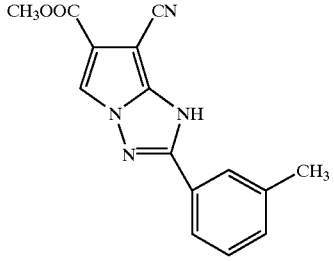
(A-605)
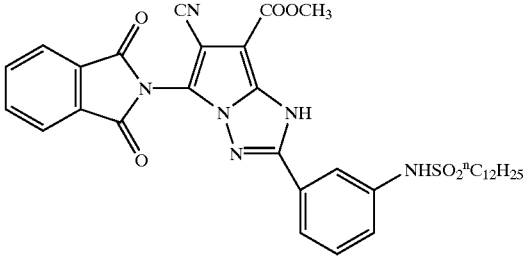
(A-606)
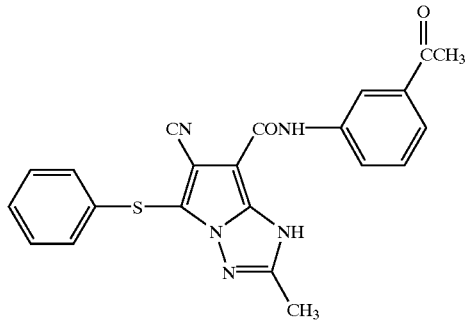

-continued
(A-607)
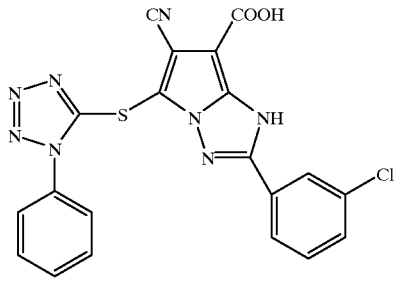
(A-608)
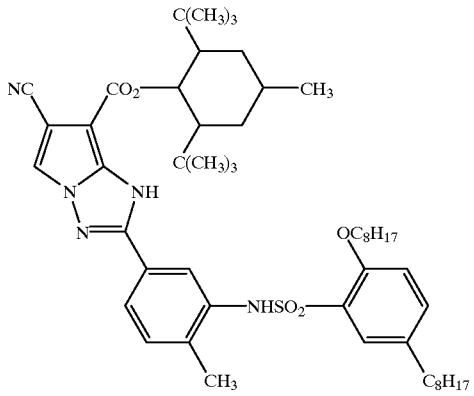
(A-609)
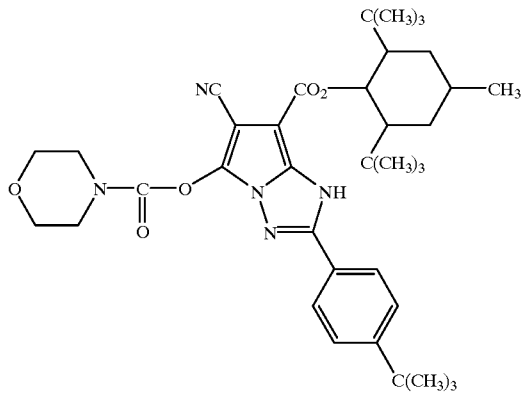
(A-701)
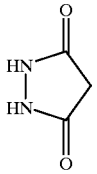
(A-702)
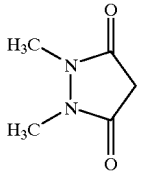
(A-703)
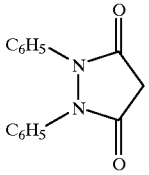
(A-704)
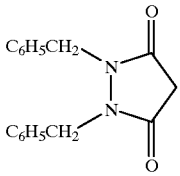
(A-705)
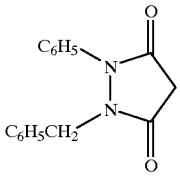
(A-706)
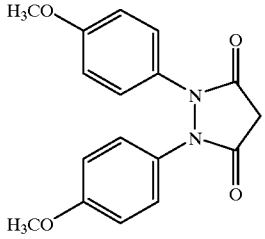
(A-707)
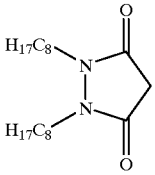

-continued
(A-708)
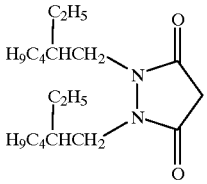
(A-709)
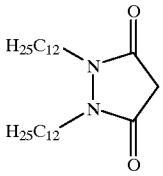
(A-710)
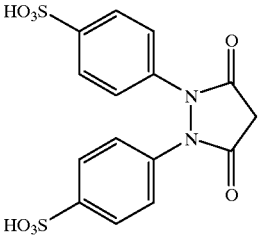
(A-711)
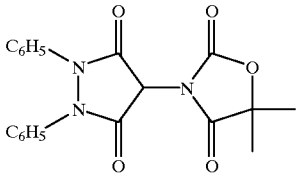
(A-712)
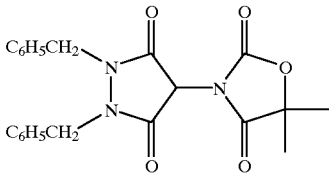
(A-713)
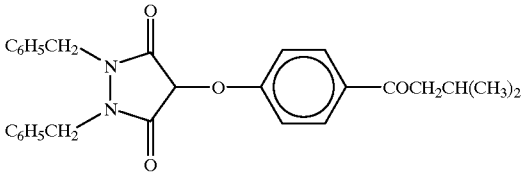
(A-801)
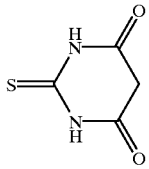
(A-802)
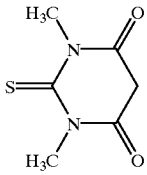
(A-803)
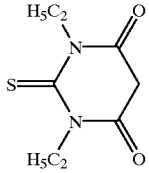
(A-804)
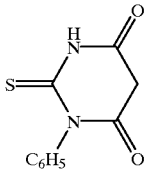
(A-805)
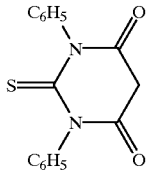
(A-806)
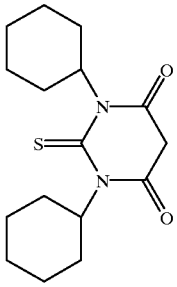
(A-807)
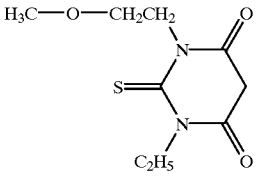
(A-808)
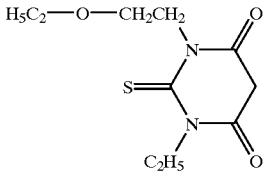

-continued
(A-809)
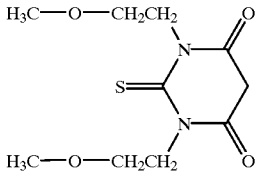
(A-810)
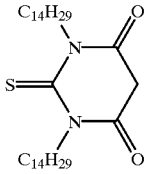
(A-811)
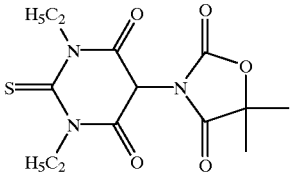
(A-812)
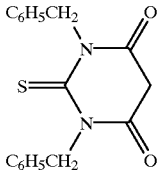
(A-813)
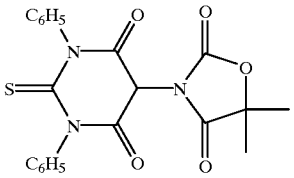
(A-814)
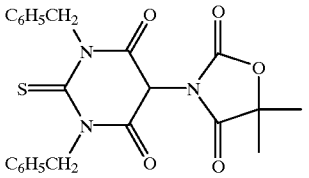
(A-901)
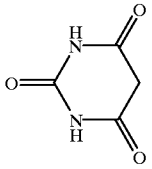
(A-902)
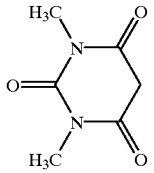
(A-903)
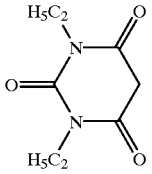
(A-904)
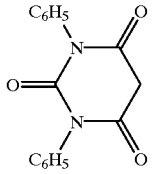
(A-905)
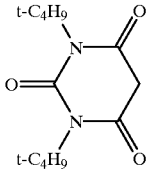
(A-906)
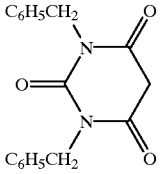
(A-907)
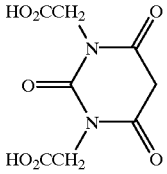
(A-908)
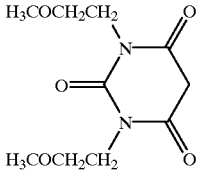
(A-909)
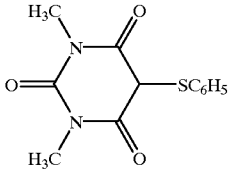
(A-910)
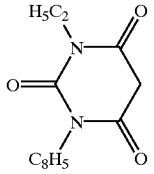

-continued
(A-911)
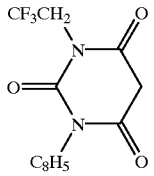
(A-912)
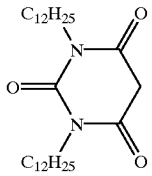
(A-913)
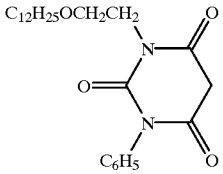
(A-914)
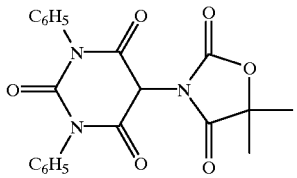
(A-915)
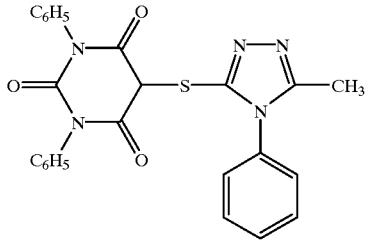
(A-1001)
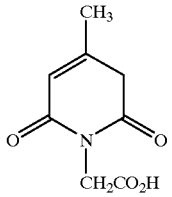
(A-1002)
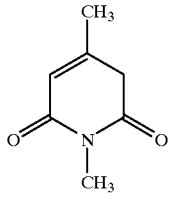
(A-1003)
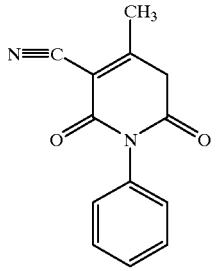
(A-1004)
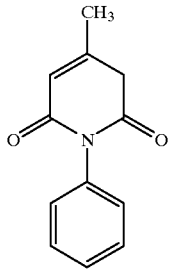
(A-1005)
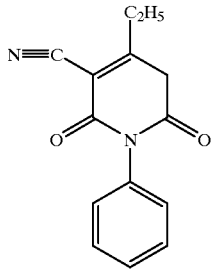
(A-1006)
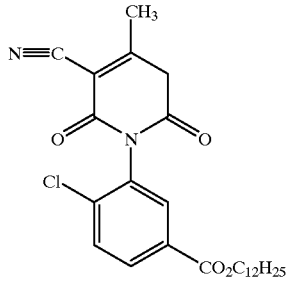
(A-1007)
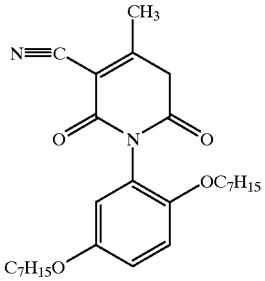

-continued
(A-1008)
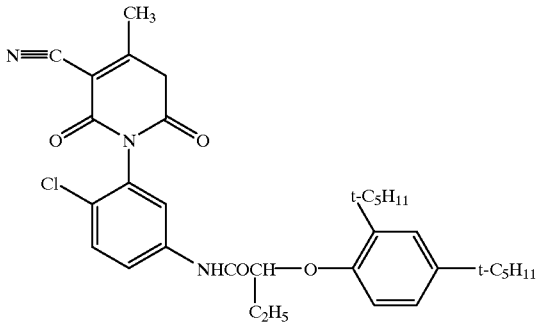
(A-1009)
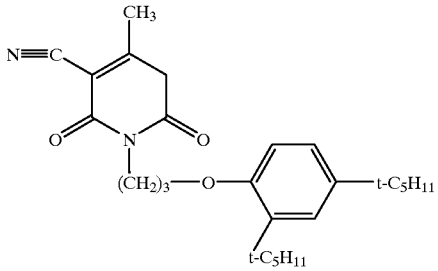
(A-1011)
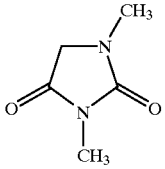
(A-1012)
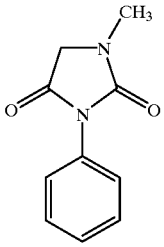
(A-1013)
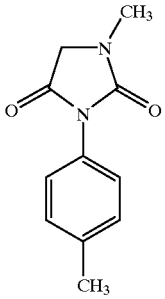
(A-1014)
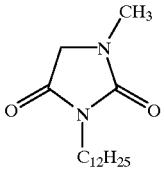
(A-1015)
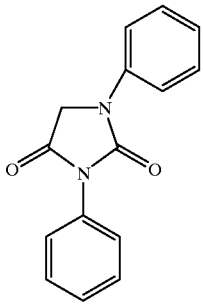
(A-1016)
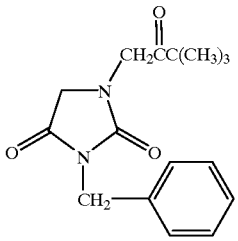
(A-1017)
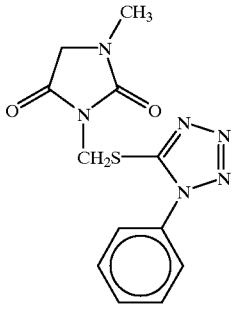
(A-1018)
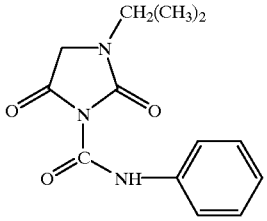

-continued
(A-1019)
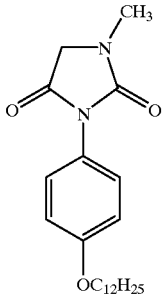
(A-1020)
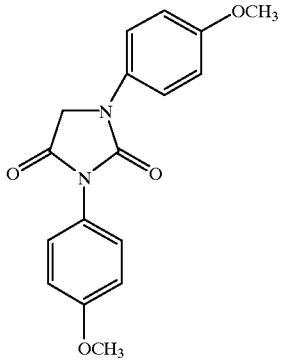
(A-1101)
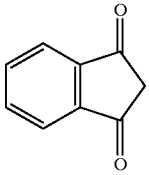
(A-1102)
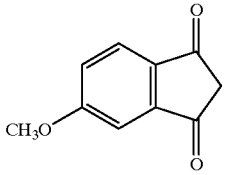
(A-1103)
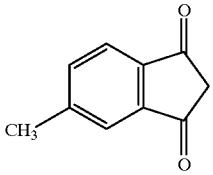
(A-1104)
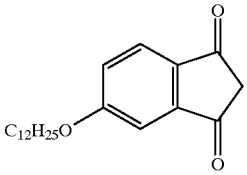
(A-1105)
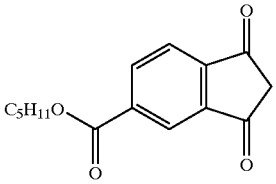
(A-1106)
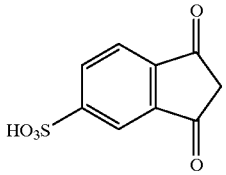
(A-1107)
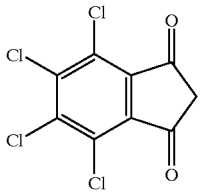
(A-1108)
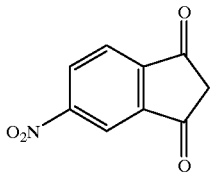
(A-1109)
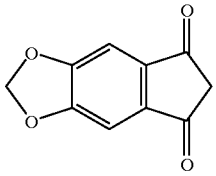
(A-1201)
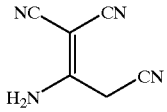
(A-1202)
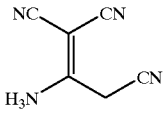
(A-1203)
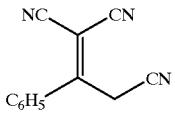

-continued
(A-1204)
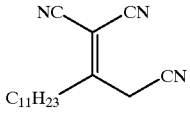
(A-1205)
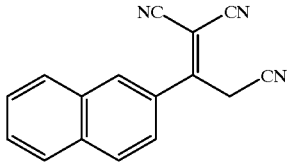
(A-1206)
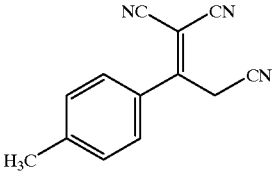
(A-1207)
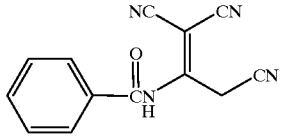
(A-1208)
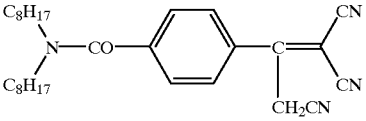
(A-1209)
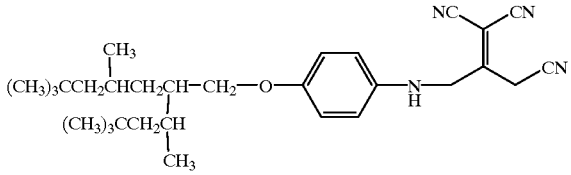
(B-101)
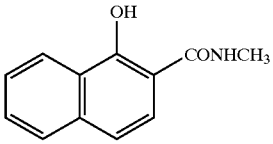
(B-102)
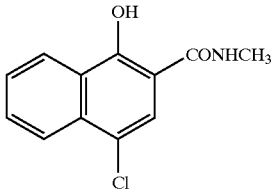
(B-103)
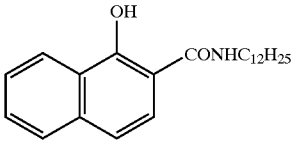
(B-104)
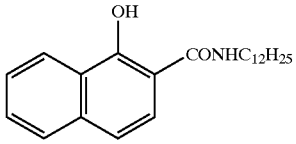
(B-105)
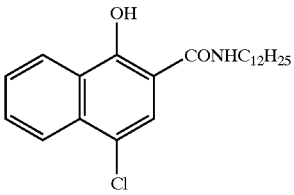
(B-106)
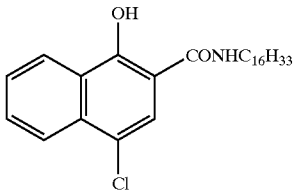
(B-107)
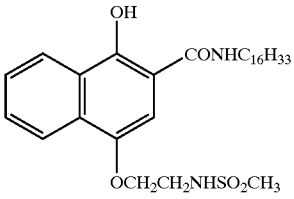
(B-108)
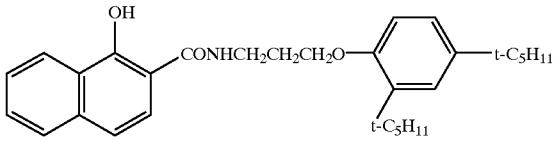
(B-109)
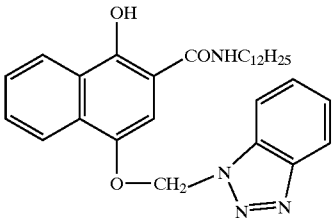
(B-110)
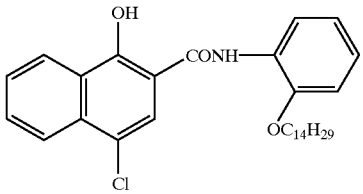

-continued
(B-111)
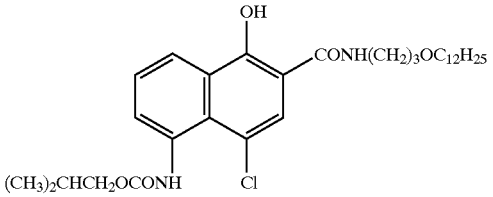
(B-112)
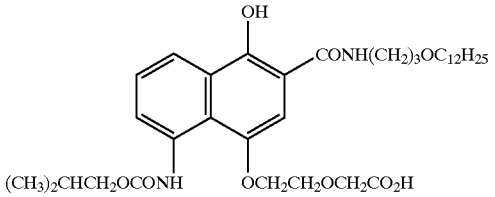
(B-113)
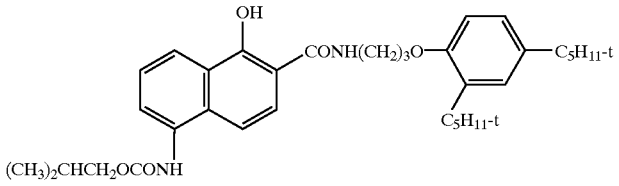
(B-114)
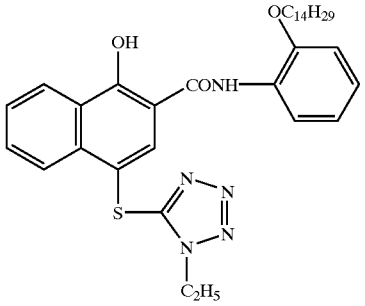
(B-115)
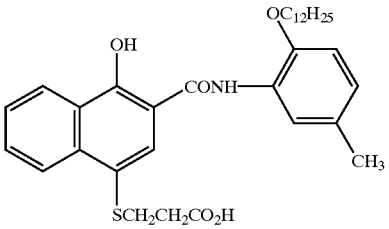
(B-116)
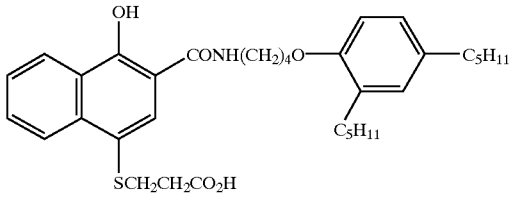
(B-117)
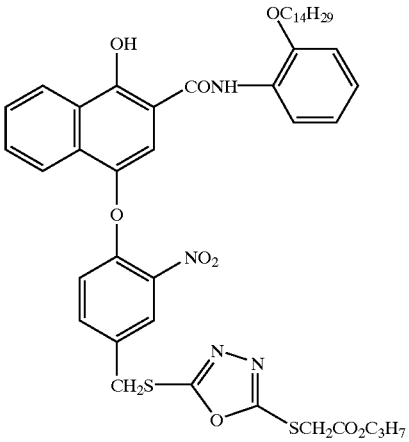
(B-118)
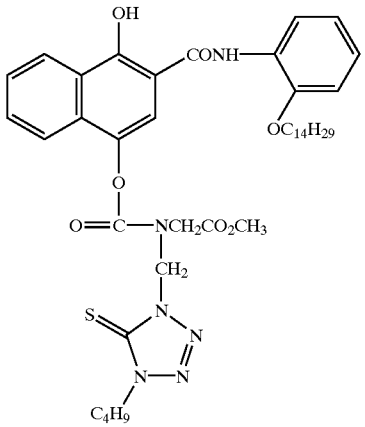

-continued
(B-119)
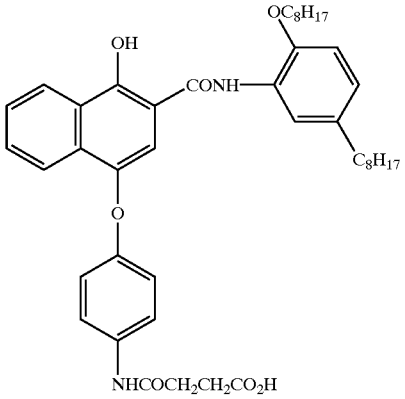
(B-120)
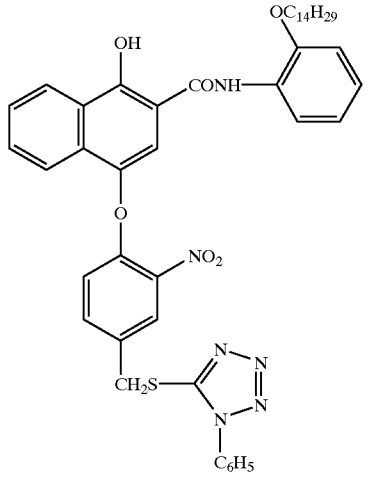
(B-201)
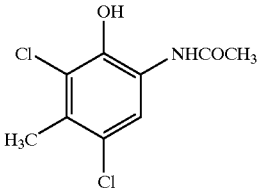
(B-202)
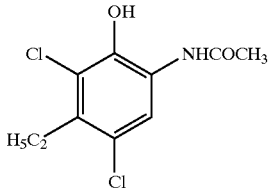
(B-203)
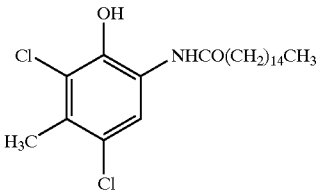
(B-204)
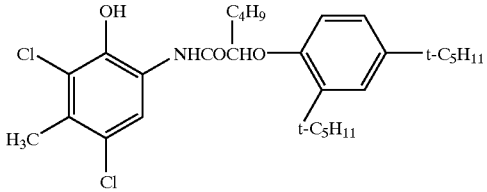
(B-205)
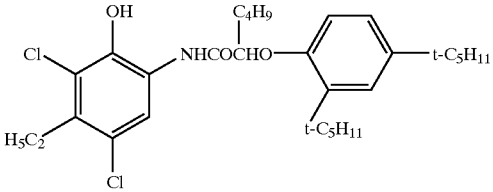
(B-206)
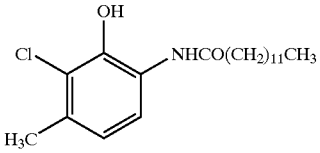
(B-207)
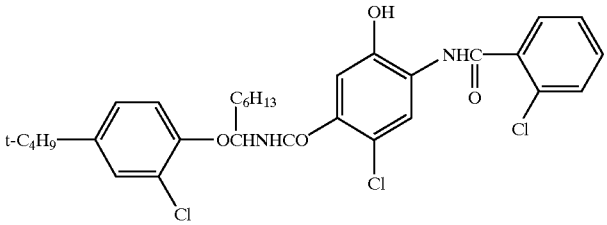
(B-208)
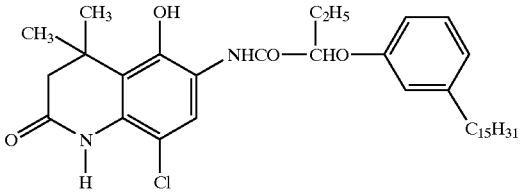
(B-209)
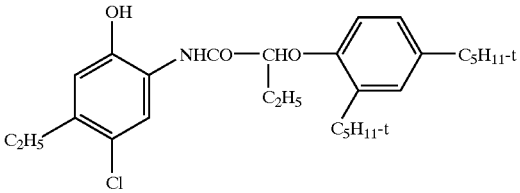
(B-210)
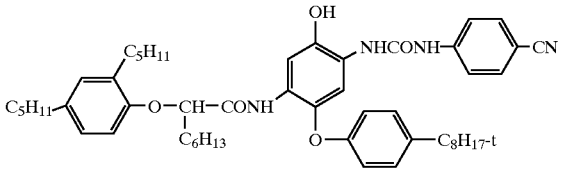

-continued (B-211)

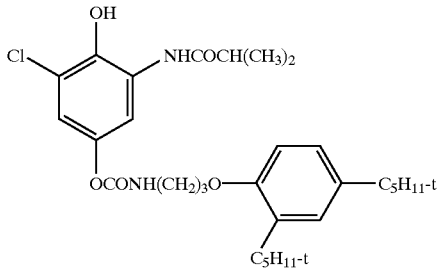

(B-212)

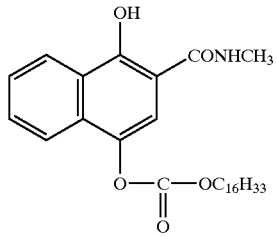

(B-213)

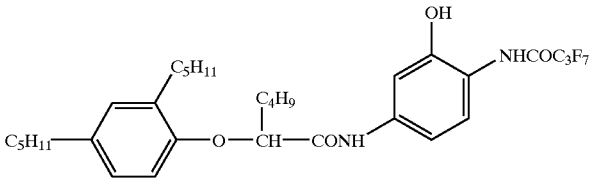

(B-214)

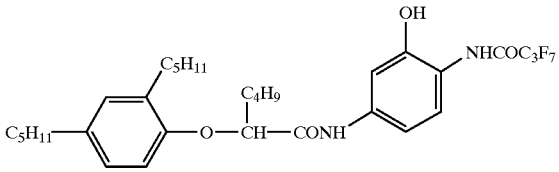

(B-215)

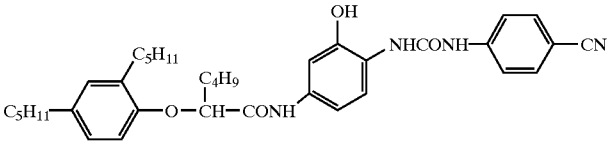

(B-216)

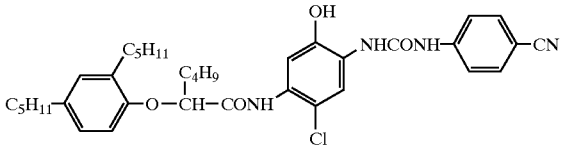

(B-217)

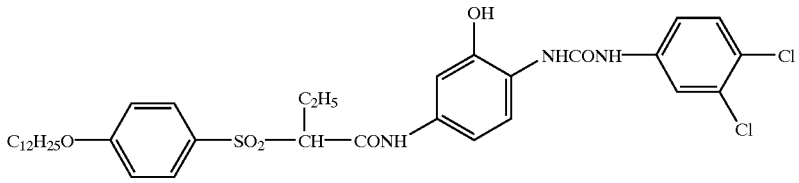

(B-218)

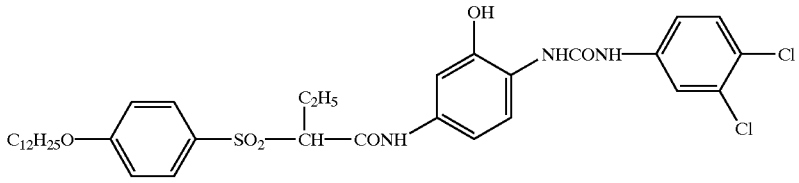

(B-218)

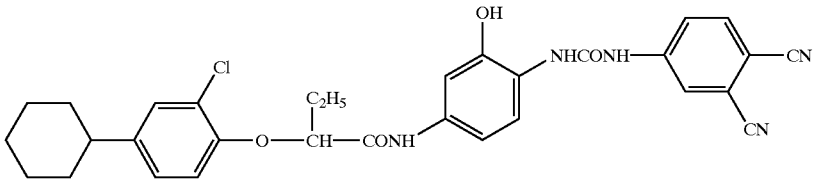

The coupler compounds represented by the formulas (3) to (17) preferably used for the present invention can readily be synthesized by methods known in the art of photography.

The amount of the coupler compound used for the present invention is preferably 0.2–200 mmol, more preferably 0.3–100 mmol, further preferably 0.5–30 mmol, per mole of silver. The coupler compounds may be used each alone or as a combination of two or more kinds of them.

When the coupler compound that can be used for the present invention is used for image-capturing materials, the amount of the coupler compound is preferably 0.2–10 mmol, more preferably 0.5–1 mmol, per mole of silver.

The photothermographic material of the present invention may comprise (j) at least one of a development inhibitor-releasing couplers represented by the following formula (24).

$$A\text{-}(TIME)_n\text{-}DI \qquad (24)$$

wherein, in the formula (24), A represents a coupler residue which releases $(TIME)_n$-DI by a coupling reaction with an oxidized form of the compound represented by the formula (1) or (2), TIME represents a timing group which releases $(TIME)_{n-1}$-DI after being released from A by a coupling reaction or a timing group which releases $(TIME)_{n-2}$-DI after being released from TIME, n represents an integer of 0–3, and when n is 2 or more, plural TIMEs may be the same or different, and DI represents a group which functions as a development inhibitor after being released from A or TIME.

In the formula (24), A represents a coupler residue, more particularly, an yellow image forming coupler residue, a magenta image forming coupler residue, a cyan image forming coupler residue, a non-colored coupler residue or a dye discharge type coupler residue. As the coupler residue represented by A, the timing group represented by TIME and the group of a development inhibitor represented by DI, those described in Research Disclosure 37038 (February, 1995), pages 80–85 and 87–89 can preferably be used.

Such functional couplers as mentioned below may also be used for the present invention.

As couplers of which color forming dye shows suitable diffusibility, preferred are those described in U.S. Pat. No. 4,366,237, British Patent No. 2,125,570, EP96873B and German Patent 3,234,533.

As couplers for correcting unnecessary absorption of a color forming dye, preferred are yellow colored cyan couplers described EP456257A1, yellow colored magenta couplers mentioned in EP456257A1, magenta colored cyan couplers mentioned in U.S. Pat. No. 4,833,069, Compound (2) mentioned in U.S. Pat. No. 4,837,136 and colorless masking couplers represented by the formula (A) in claim 1 of WO92/11575 (in particular, the exemplary compounds mentioned in pages 36 to 45).

Examples of compounds (including couplers) that react with an oxidized developing agent and release a photographically useful group include the followings.

Development inhibitor-releasing compounds: compounds represented by the formulas (I), (II), (III), (IV) mentioned in EP378236A1, page 11, compounds represented by the formula (I) mentioned in EP436938A2, page 7, compounds represented by the formula (1) mentioned in EP568037A, and compounds represented by the formulas (I), (II), and (III) mentioned in EP440,195A2, pages 5 and 6;

Bleaching accelerator-releasing compounds: compounds represented by the formulas (I) and (I') mentioned in EP310,125A2, page 5, and compounds represented by the formula (I) in mentioned JP-A-6-59411, claim 1;

Ligand-releasing compounds: compounds represented by LIG-X mentioned in U.S. Pat. No. 4,555,478, claim 1;

Leuco dye-releasing compounds: Compounds 1 to 6 mentioned in U.S. Pat. No. 4,749,641, columns 3 to 8;

Fluorescent dye-releasing compounds: compounds represented by COUP-DYE mentioned in U.S. Pat. No. 4,774,181, claim 1;

Development accelerator or fogging agent release compounds: compounds represented by the formulas (1), (2) and (3) mentioned in U.S. Pat. No. 4,656,123, column 3, and ExZK-2 mentioned in EP450637A2, page 75, lines 36 to 38;

Compounds that release a group that functions as a dye after it is cleaved: compounds represented by the formula (1) mentioned in U.S. Pat. No. 4,857,447, claim 1, compounds represented by the formula (1) mentioned in JP-A-5-307248 (Japanese Patent No. 2835665), compounds represented by the formulas (I), (II) and (III) mentioned in EP440195A2, pages 5 and 6, compound-ligand releasing compounds represented by the formula (1) mentioned in JP-A-6-59411, claim 1, and compounds represented by LIG-X mentioned in U.S. Pat. No. 4,555,478, claim 1.

These functional couplers are preferably used in an amount of 0.05–10 times, more preferably 0.1–5 times in mole, of the amount of the aforementioned coupler that contribute to the color formation.

The coupler compound used for the present invention may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, hydrophobic additives such as these couplers and color formation developing agents may be incorporated into layers of photosensitive materials according to known methods mentioned in, for example, in U.S. Pat. No. 2,322,027. In this case, a high boiling point organic solvent as mentioned in U.S. Pat. Nos. 4,555,470, 4,536,466, 4,536,467, 4,587,206, 4,555,476, 4,599,296, JP-B-3-62256 and so forth may be used, if desired, in combination with a low boiling point organic solvent having a boiling point of from 50–160° C. These dye-donating couplers, high boiling point organic solvents and so forth may be used as a combination of two or more kinds of them.

The amount of the high boiling point organic solvent is 10 g or less, preferably 5 g or less, more preferably 1–0.1 g, per 1 g of the hydrophobic additives. Further, it is suitably used in an amount of 1 ml or less, preferably 0.5 ml or less, more preferably 0.3 ml or less, per 1 g of the binder.

Dispersion methods using polymer materials mentioned in JP-B-51-39853 and JP-A-51-59943 and the method of adding as microparticle dispersion mentioned in JP-A-62-30242 can also be used.

In the case of a substantially water-insoluble compound, a method of forming the compound into micro particles and then dispersing and incorporating them into the binder may be used, in addition to the aforementioned methods.

In dispersing a hydrophobic compound in hydrophilic colloids, various surface active agents may be used. Examples thereof include those described as surface active agents in JP-A-59-157636, pages (37) to (38) and the aforementioned Research Disclosure. Further, the phosphoric acid ester type surface active agents mentioned in JP-A-7-56267, JP-A-7-228589 and German Patent Publication No. 1,932,299A, can be used.

The coupler compounds may be used after dispersion of powder of the coupler compounds in water by using a ball mill, colloid mill, sand grinder mill, MANTON GAULIN, a microfluidizer, or by means of ultrasonic wave according to a known method for solid dispersion.

The coupler compounds used for the present invention may preferably be added to any layer provided on the same side as the silver halide emulsion layer that is preferably the image-forming layer, i.e., the silver halide emulsion layer or any layer on the same side of the emulsion layer. However, it is preferably added to the silver halide emulsion layer or a layer adjacent thereto.

The photosensitive silver halide and/or the reducible silver salt used in the present invention can be further prevented from the production of additional fog or stabilized against the reduction in sensitivity during the stock storage by use of a known antifoggant, stabilizer or stabilizer precursor. Examples of suitable antifoggant, stabilizer and stabilizer precursor that can be used individually or in combination include the thiazonium salts mentioned in U.S. Pat. Nos. 2,131,038 and 2,694,716, azaindenes mentioned in U.S. Pat. Nos. 2,886,437 and 2,444,605, mercury salts mentioned in U.S. Pat. No. 2,728,663, urazoles mentioned in U.S. Pat. No. 3,287,135, sulfocatechols mentioned in U.S. Pat. No. 3,235,652, oximes, nitrons and nitroindazoles mentioned in British Patent No. 623,448, polyvalent metal salts mentioned in U.S. Pat. No. 2,839,405, thiuronium salts mentioned in U.S. Pat. No. 3,220,839, palladium, platinum and gold salts mentioned in U.S. Pat. Nos. 2,566,263 and 2,597,915, halogen-substituted organic compounds mentioned in U.S. Pat. Nos. 4,108,665 and 4,442,202, triazines mentioned in U.S. Pat. Nos. 4,128,557, 4,137,079, 4,138,365 and 4,459,350, phosphorus compounds mentioned in U.S. Pat. No. 4,411,985 and so forth.

The antifoggant that is particularly preferably used in the present invention is an organic halide, and examples thereof include the compounds mentioned in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, U.S. Pat. Nos. 5,340,712, 5,369,000 and 5,464,737. Among these, particularly preferred are those organic polyhalogenated compounds represented by the aforementioned formula (18).

In the formula (18), $Q^2$ represents an alkyl group, aryl group or heterocyclic group, which may have one or more substituents.

The alkyl group represented by $Q^2$ is a linear, branched or cyclic alkyl group or an alkyl group consisting of a combination thereof having preferably 1–20 carbon atoms, more preferably 1–12 carbon atoms, further preferably 1–6 carbon atoms. Examples thereof include, for example, methyl, ethyl, allyl, n-propyl, isopropyl, sec-butyl, isobutyl, tert-butyl, sec-pentyl, isopentyl, tert-pentyl, tert-octyl, 1-methylcyclohexyl etc. It is preferably a tertiary alkyl group.

The alkyl group represented by $Q^2$ may have one or more substituents. The substituents may be any groups so long as they do not adversely affect the photographic performance. Examples thereof include, for example, a halogen atom (fluorine atom, chlorine atom, bromine atom or iodine atom), an alkyl group, an alkenyl group, an alkynyl group, an aryl group, a heterocyclic group (including N-substituted nitrogen-containing heterocyclic group such as morpholino group), an alkoxycarbonyl group, an aryloxycarbonyl group, a carbamoyl group, an imino group, an imino group substituted at the N atom, a thiocarbonyl group, a carbazoyl group, a cyano group, a thiocarbamoyl group, an alkoxy group, an aryloxy group, a heterocyclyloxy group, an acyloxy group, an (alkoxy or aryloxy)carbonyloxy group, a sulfonyloxy group, an acylamino group, a sulfonamido group, a ureido group, a thioureido group, an imido group, an (alkoxy or aryloxy)carbonylamino group, a sulfamoylamino group, a semicarbazide group, a thiosemicarbazide group, an (alkyl or aryl)sulfonylureido group, a nitro group, an (alkyl or aryl)sulfonyl group, a sulfamoyl group, a group containing phosphoric acid amide or phosphoric acid ester structure, a silyl group, a carboxyl group or a salt thereof, a sulfo group or a salt thereof, a phosphoric acid group, a hydroxyl group, a quaternary ammonium group and so forth. These substituents may further be substituted with similar substituents.

The aryl group represented by $Q^2$ is an aryl group that may have a monocyclic structure or a condensed ring structure. The aryl group preferably has 6–20 carbon atoms, more preferably 6–16 carbon atoms, particularly preferably 6–10 carbon atoms, and phenyl group and naphthyl group are preferred.

The aryl group represented by $Q^2$ may have one or more substituents. The substituents may be any groups so long as they do not adversely affect the photographic performance. Examples thereof include, for example, those mentioned as substituents for the aforementioned alkyl group.

The heterocyclic group represented by $Q^2$ is preferably a heterocyclic group of which heterocycle is 5- to 7-membered saturated or unsaturated monocycle or condensed cycles containing at least one of hetero atom selected from the group consisting of nitrogen, oxygen and sulfur atoms. Preferred examples of the heterocycle are pyridine, quinoline, isoquinoline, pyrimidine, pyrazine, pyridazine, phthalazine, triazine, furan, thiophene, pyrrole, oxazole, benzoxazole, thiazole, benzothiazole, imidazole, benzimidazole, thiadiazole, triazole and so forth, more preferred are pyridine, quinoline, pyrimidine, thiadiazole and benzothiazole, and particularly preferred are pyridine, quinoline and pyrimidine.

The heterocyclic group represented by $Q^2$ may have one or more substituents. Examples of the substituents include, for example, those mentioned as substituents for the aforementioned alkyl group represented by $V^5$ in the formula (1).

$Q^2$ is preferably phenyl group, naphthyl group, quinolyl group, pyridyl group, pyrimidyl group, thiadiazolyl group or benzothiazolyl group, particularly preferably phenyl group, naphthyl group, quinolyl group, pyridyl group or pyrimidyl group.

As a substituent of $Q^2$, a ballast group for suppressing diffusion commonly used in photographic materials, a group adsorptive for the silver salt or a group imparting water-solubility may be introduced. The substituents may be polymerized to form a polymer, or bonded together to form a bis-type, tris-type or tetrakis-type compound.

In the formula (18), Y represents a divalent bridging group, preferably —$SO_2$—, —SO— or —CO—, particularly preferably —$SO_2$—.

n represents 0 or 1, preferably 1.

$Z^1$ and $Z^2$ independently represent a halogen atom such as fluorine, chlorine, bromine and iodine. It is preferred that both of $Z^1$ and $Z^2$ represent bromine atom.

X represents hydrogen atom or an electron-withdrawing group. The electron-withdrawing group used herein is a substituent having a Hammett's substituent group constant $\sigma_p$ of a positive value, and specific examples thereof include cyano group, an alkoxycarbonyl group, an aryloxycarbonyl group, a carbamoyl group, a sulfamoyl group, an alkylsulfonyl group, an arylsulfonyl group, a halogen atom, an acyl group, a heterocyclic group and so forth. X is preferably hydrogen atom or a halogen atom, and the most preferred is bromine atom.

Examples of the polyhalogenated compound of the formula (18) include, for example, those compounds disclosed in U.S. Pat. Nos. 3,874,946, 4,756,999, 5,340,712, 5,369,000, 5,464,737, JP-A-50-137126, JP-A-50-89020, JP-A-50-119624, JP-A-59-57234, JP-A-7-2781, JP-A-7-5621, JP-A-9-160164, JP-A-10-197988, JP-A-9-244177, JP-A-9-244178, JP-A-9-160167, JP-A-9-319022, JP-A-9-258367, JP-A-9-265150, JP-A-9-319022, JP-A-10-197989, JP-A-11-242304, Japanese Patent Application Nos. 10-181459, 10-292864, 11-90095, 11-89773, 11-205330 and so forth.

Preferred examples of the organic polyhalogenated compounds represented by the formula (18) will be shown below. However, the organic polyhalogenated compounds used for the present invention are not limited to these examples.

(P-1)

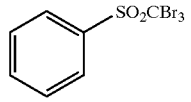

-continued
(P-2)
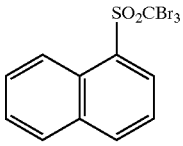
(P-3)
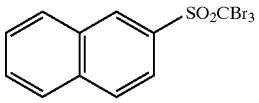
(P-4)
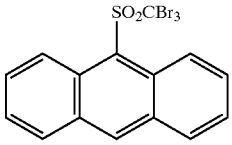
(P-5)
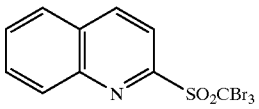
(P-6)
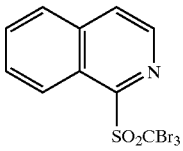
(P-7)
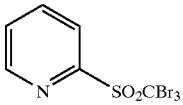
(P-8)
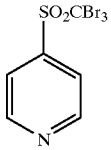
(P-9)
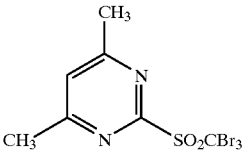
(P-10)
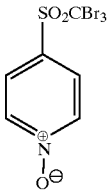
(P-11)
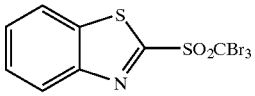
-continued
(P-12)
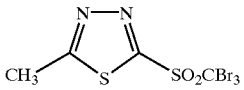
(P-13)
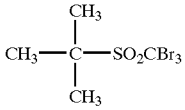
(P-14)
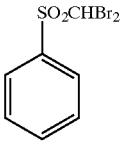
(P-15)
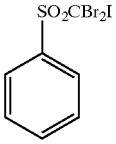
(P-16)
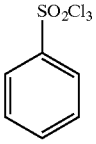
(P-17)
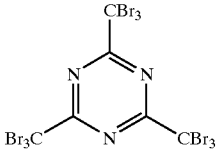
(P-18)
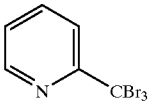
(P-19)
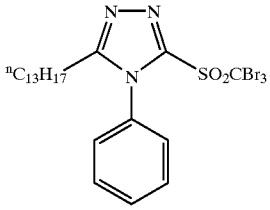
(P-20)
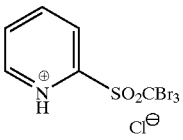
(P-21)
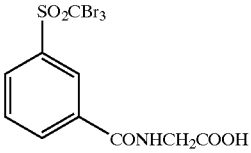

-continued
(P-22)
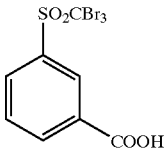
(P-23)
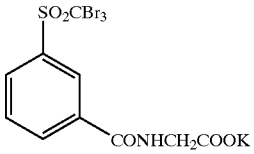
(P-24)
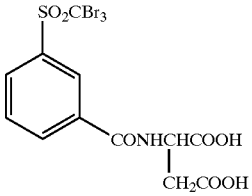
(P-25)
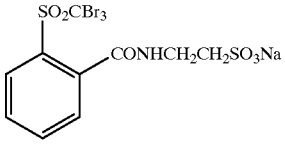
(P-26)
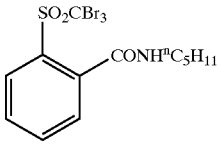
(P-27)
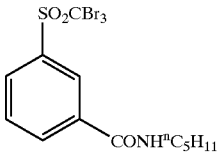
(P-28)
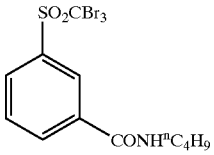
(P-29)
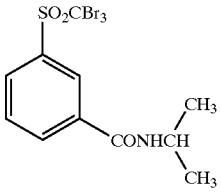
(P-30)
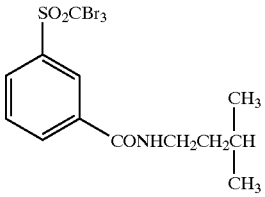
-continued
(P-31)
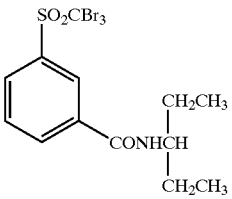
(P-32)
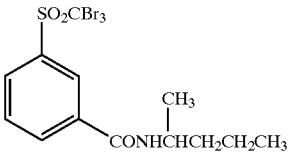
(P-33)
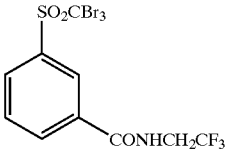
(P-34)
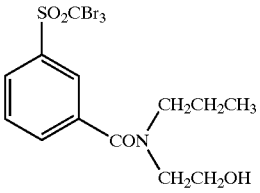
(P-35)
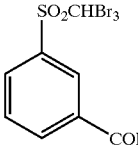
(P-36)
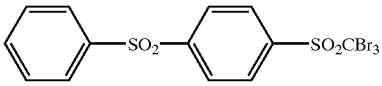
(P-37)
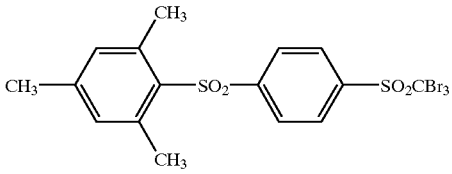
(P-38)
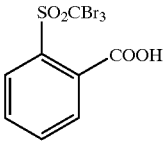
(P-39)
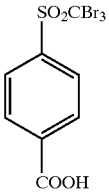

-continued (P-40)

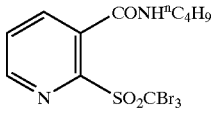

The amount of the polyhalogenated compounds represented by the formula (18), which are preferably used for the present invention, is preferably $1\times10^{-6}$ to $1\times10^{-2}$ mol/m$^2$, more preferably $1\times10^{-5}$ to $5\times10^{-3}$ mol/m$^2$, further preferably $2\times10^{-5}$ to $1\times10^{-3}$ mol/m$^2$, as application amount per 1 m$^2$ of the photothermographic material. The polyhalogenated compounds may be used each alone or in any combination of two or more of them.

The polyhalogenated compounds represented by the formula (18) can be used by dissolving said compounds in water or a suitable organic solvent, for example, alcohols such as methanol, ethanol, propanol and fluorinated alcohol, ketones such as acetone, methyl ethyl ketone and methyl isobutyl ketone, dimethylformamide, dimethyl sulfoxide, methyl cellosolve and so forth. The compounds may also be used as an emulsified dispersion mechanically prepared according to a known emulsification dispersion method by using an oil such as dibutyl phthalate, tricresyl phosphate, glyceryl triacetate or diethyl phthalate, ethyl acetate or cyclohexanone as an auxiliary solvent for dissolution. Alternatively, the compounds may be used after dispersion of powder of organic polyhalogenated compound in water by using a ball mill, colloid mill, sand grinder mill, MANTON GAULIN, or microfluidizer, or by means of ultrasonic wave according to a known method for solid dispersion.

The compounds represented by the formula (18) of the present invention may be added to any layers on a support provided at the side of the image-forming layer, i.e., the image-forming layer or other layers provided on the same side. The compounds may preferably be added to the image-forming layer or a layer adjacent thereto.

The photothermographic material of the present invention preferably contains a phthlazine compound represented by the formula (19).

In the formula (19), $R^{31}$ represents hydrogen atom or a monovalent substituent, and m represents an integer of 1 to 6. $(R^{31})m$ means that 1–6 of $R^{31}$ independently exist on the phthalazine ring, and when m is 2 or more, adjacent two of $R^{31}$ may form an aliphatic ring or an aromatic ring.

Examples of the substituents represented by $R^{31}$ include, for example, an alkyl group having preferably from 1 to 20 carbon atoms, more preferably from 1 to 12 carbon atoms, further preferably from 1 to 8 carbon atoms (for example, methyl, ethyl, n-propyl, isopropyl, n-butyl, isobutyl, tert-butyl, n-octyl, n-decyl, n-hexadecyl, cyclopropyl, cyclopentyl, cyclohexyl etc.); an alkenyl group having preferably from 2 to 20 carbon atoms, more preferably from 2 to 12 carbon atoms, further preferably from 2 to 8 carbon atoms (for example, vinyl, allyl, 2-butenyl, 3-pentenyl etc.); an alkynyl group having preferably from 2 to 20 carbon atoms, more preferably from 2 to 12 carbon atoms, further preferably from 2 to 8 carbon atoms (for example, propargyl, 3-pentynyl etc.); an aryl group having preferably from 6 to 30 carbon atoms, more preferably from 6 to 20 carbon atoms, further preferably from 6 to 12 carbon atoms (for example, phenyl, p-methylphenyl, naphthyl etc.); an aralkyl group having preferably from 7 to 30 carbon atoms, preferably from 7 to 20 carbon atoms, more preferably 7 to 12 carbon atoms, further preferably from 1 to 8 carbon atoms (for example, benzyl, α-methylbenzyl, 2-phenylethyl, naphthylmethyl, (4-methylphenyl)methyl etc.); an amino group having preferably from 0 to 20 carbon atoms, more preferably from 0 to 10 carbon atoms, further preferably from 0 to 6 carbon atoms (for example, amino, methylamino, dimethylamino, diethylamino, dibenzylamino etc.); an alkoxy group having preferably from 1 to 20 carbon atoms, more preferably from 1 to 12 carbon atoms, particularly preferably from 1 to 8 carbon atoms (for example, methoxy, ethoxy, butoxy etc.); an aryloxy group having preferably from 6 to 20 carbon atoms, more preferably from 6 to 16 carbon atoms, further preferably from 6 to 12 carbon atoms (for example, phenyloxy, 2-naphthyloxy etc.); an acyl group having preferably from 1 to 20 carbon atoms, more preferably from 1 to 16 carbon atoms, further preferably from 1 to 12 carbon atoms (for example, acetyl, benzoyl, formyl, pivaloyl etc.); an alkoxycarbonyl group having preferably from 2 to 20 carbon atoms, more preferably from 2 to 16 carbon atoms, further preferably from 2 to 12 carbon atoms (for example, methoxycarbonyl, ethoxycarbonyl etc.); an aryloxycarbonyl group having preferably from 7 to 20 carbon atoms, more preferably from 7 to 16 carbon atoms, further preferably from 7 to 10 carbon atoms (for example, phenyloxycarbonyl etc.); an acyloxy group having preferably from 2 to 20 carbon atoms, more preferably from 2 to 16 carbon atoms, further preferably from 2 to 10 carbon atoms (for example, acetoxy, benzoyloxy etc.); an acylamino group having preferably from 2 to 20 carbon atoms, more preferably from 2 to 16 carbon atoms, further preferably from 2 to 10 carbon atoms (for example, acetylamino, benzoylamino etc.); an alkoxycarbonylamino group having preferably from 2 to 20 carbon atoms, more preferably from 2 to 16 carbon atoms, further preferably from 2 to 12 carbon atoms (for example, methoxycarbonylamino etc.); an aryloxycarbonylamino group having preferably from 7 to 20 carbon atoms, more preferably from 7 to 16 carbon atoms, further preferably from 7 to 12 carbon atoms (for example, phenyloxycarbonylamino etc.); a sulfonylamino group having preferably from 1 to 20 carbon atoms, more preferably from 1 to 16 carbon atoms, further preferably from 1 to 12 carbon atoms (for example, methanesulfonylamino, benzenesulfonylamino etc.); a sulfamoyl group having preferably from 0 to 20 carbon atoms, more preferably from 0 to 16 carbon atoms, further preferably from 0 to 12 carbon atoms (for example, sulfamoyl, methylsulfamoyl, dimethylsulfamoyl, phenylsulfamoyl etc.); a carbamoyl group having preferably from 1 to 20 carbon atoms, more preferably from 1 to 16 carbon atoms, further preferably from 1 to 12 carbon atoms (for example, carbamoyl, methylcarbamoyl, diethylcarbamoyl, phenylcarbamoyl etc.); an alkylthio group having preferably from 1 to 20 carbon atoms, more preferably from 1 to 16 carbon atoms, further preferably from 1 to 12 carbon atoms (for example, methylthio, ethylthio etc.); an arylthio group having preferably from 6 to 20 carbon atoms, more preferably from 6 to 16 carbon atoms, further preferably from 6 to 12 carbon atoms (for example, phenylthio etc.); a sulfonyl group having preferably from 1 to 20 carbon atoms, more preferably from 1 to 16 carbon atoms, further preferably from 1 to 12 carbon atoms (for example, mesyl, tosyl etc.); a sulfinyl group having preferably from 1 to 20 carbon atoms, more preferably from 1 to 16 carbon atoms, further preferably from 1 to 12 carbon atoms (for example, methanesulfinyl, benzenesulfinyl etc.); a ureido group having preferably from 1 to 20 carbon atoms, more preferably from 1 to 16 carbon atoms, further preferably from 1 to 12 carbon atoms (for example, ureido, methylureido, phenylureido etc.); a phosphoric acid amido group having preferably from 1 to 20 carbon atoms, more preferably from 1 to 16 carbon atoms, further preferably from 1 to 12 carbon atoms (for example, diethylphosphoric acid amido, phenylphosphoric acid amido etc.) ; a hydroxyl group; a mercapto group; a halogen atom (e.g., fluorine atom, chlorine atom, bromine atom, iodine atom); a cyano group; a sulfo group; a carboxyl group; a nitro group; a hydroxamic acid group; a sulfino group; a hydrazino group; a heterocyclic group (e.g., imidazolyl, pyridyl, furyl, piperidyl, morpholino etc.) ad so forth. These substituents may be further substituted with other substituents.

$R^{31}$ is preferably hydrogen atom, an alkyl group, an alkenyl group, an alkynyl group, an aryl group, an aralkyl group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a sulfinyl group, a hydroxy group, a halogen atom or a cyano group, more preferably hydrogen atom, an alkyl group, an aryl group, an aralkyl group, an acyl group, a hydroxy group, a halogen atom, or a cyano group, further preferably hydrogen atom, an alkyl group, an aryl group, an aralkyl group or a halogen atom, particularly preferably hydrogen atom, an alkyl group, an aryl group or an aralkyl group.

m represents an integer of 1 to 6. m is preferably 3 or less, more preferably 2 or less. $(R^{31})m$ means that 1–6 of Y independently exist on the phthalazine ring, and when m is 2 or more, adjacent two of $R^{31}$ may form an aliphatic ring (preferably 3- to 8-membered ring, more preferably 5- to 6-membered ring) or an aromatic ring (benzene or naphthalene ring), or they may form a heterocycle (preferably 5- or 6-membered ring).

As for the methods for producing the phthalazine compounds represented by the formula (19), there can be mentioned, for example, the method comprising condensing a corresponding phthalic acid derivative (phthalaldehyde, phthalic acid anhydride, phthalic ester etc.) with hydrazine to form a phthalazine base structure as mentioned in R. G. ElderField "Heterocyclic Compounds", John Wiley and Sons, Vols. 1–9, 1950–1967; A. R. Katritzky, "Comprehensive Heterocyclic Chemistry", Pergamon Press, 1984 etc., the method comprising condensing α, α, α', α'-tetrachloro-o-xylene with hydrazine to form a phthalazine, the method comprising reacting an arylaldazine derivative with a mixture of aluminum chloride and aluminum bromide under a condition where the materials are melted to cause cyclization as mentioned in Tetrahedron Letters, vol. 22, 345 page (1981), the method in which the synthesis is attained by cyclization of an aldazine compound in an organic solvent using an aluminum chloride catalyst as mentioned in JP-A-11-180961 and so forth.

The amount of the phthalazine compound represented by the formula (19) is preferably 0.1–50 moles %, more preferably 0.5–20 moles %, per mole of silver on the side having the image-forming layer. The phthalazine compound may also be a so-called precursor that is derived so as to effectively function only at the time of development.

The compound represented by the formula (19) may be added in any form, for example, as a solution, powder, solid microparticle dispersion and so forth. The solid microparticle dispersion can be formed by a known pulverization means (for example, a ball mill, vibration ball mill, sand mill, colloid mill, jet mill, roller mill etc.). Further, when solid microparticle dispersion is prepared, a dispersing aid may be used.

The compound represented by the formula (19) may be added to any layer on a support provided on the same side as the photosensitive silver halide and the reducible silver salt. However, it is preferably added to a layer containing the silver halide or a layer adjacent thereto.

Specific examples of the phthalazine compound represented by the formula (19) are listed below. However, the phthalazine compounds used for the present invention are not limited to these.

I-1

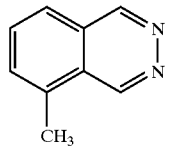

I-2

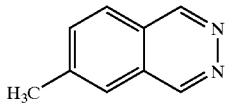

I-3

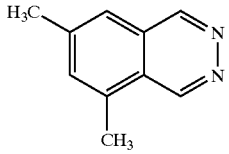

I-4

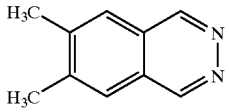

I-5

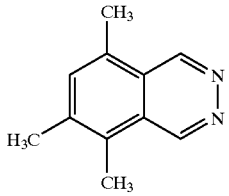

I-6

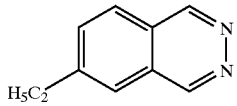

I-7

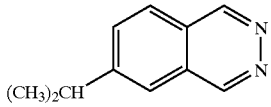

I-8

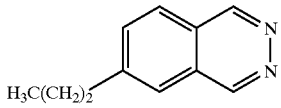

I-9

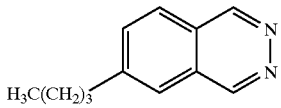

I-10

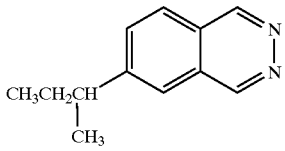

-continued
I-11
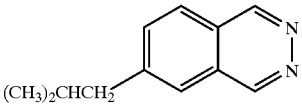
I-12
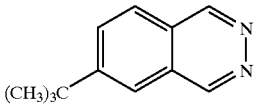
I-13
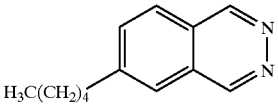
I-14
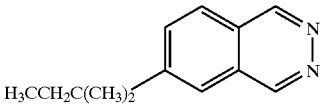
I-15
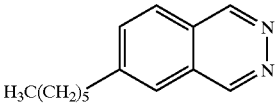
I-16
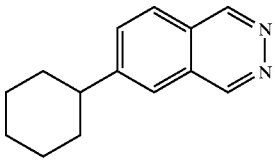
I-17
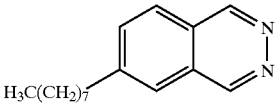
I-18
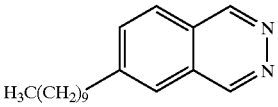
I-19
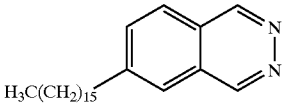
I-20
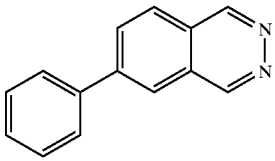
I-21
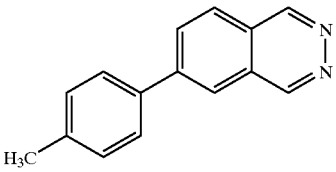
-continued
I-22
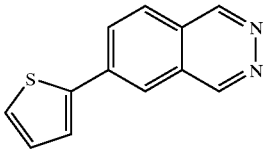
I-23
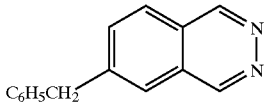
I-24
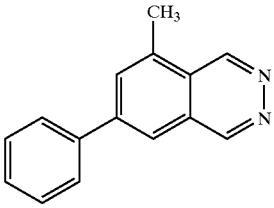
I-25
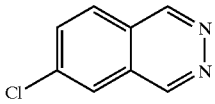
I-26
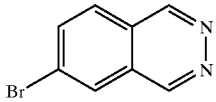
I-27
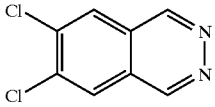
I-28
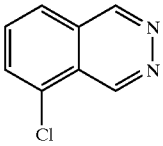
I-29
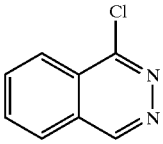
I-30
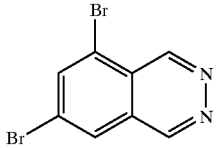
I-31
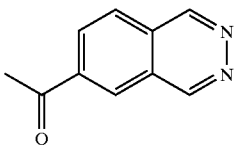

-continued
I-32
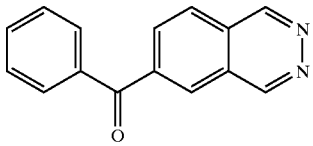
I-33
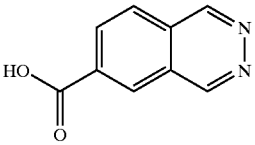
I-34
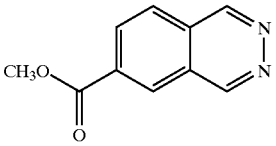
I-35
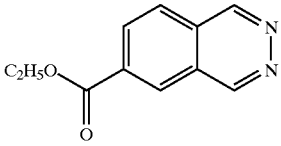
I-36
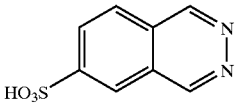
I-37
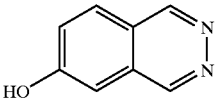
I-38
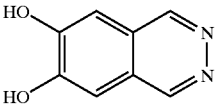
I-39
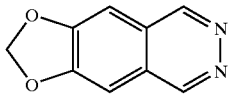
I-40
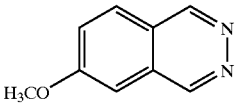
I-41
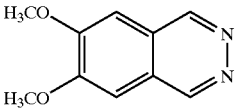
I-42
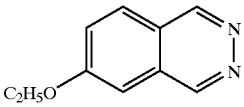
I-43
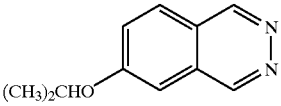
-continued
I-44
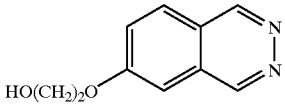
I-45
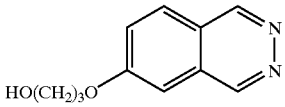
I-46
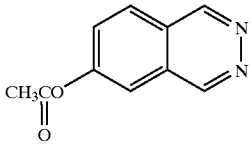
I-47
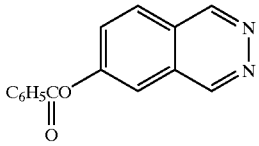
I-48
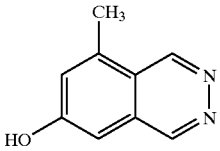
I-49
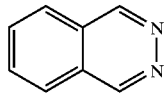
I-50
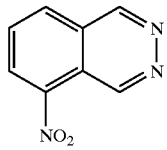
I-51
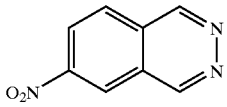
I-52
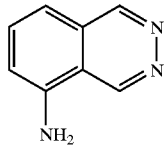
I-53
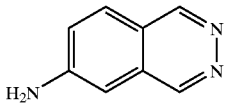
I-54
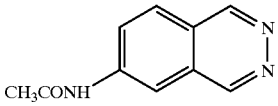

-continued
I-55
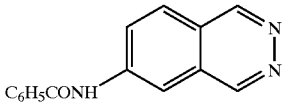
I-56
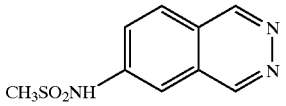
I-57
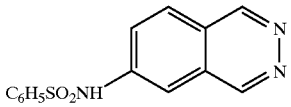
I-58
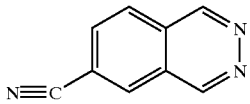
I-59
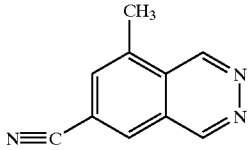
I-60
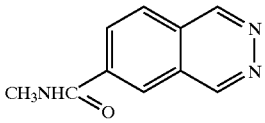
I-61
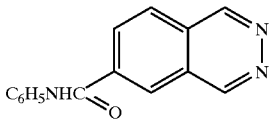
I-62
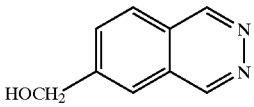
I-63
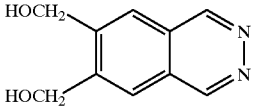
I-64
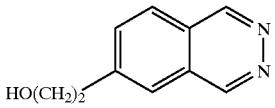
I-65
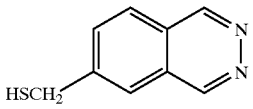
I-66
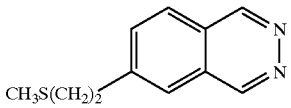
-continued
I-67
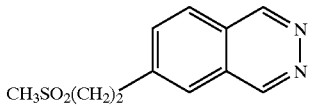
I-68
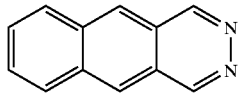
I-69
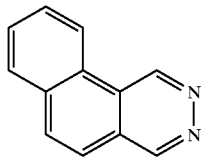
I-70
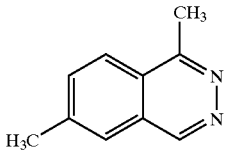
I-71
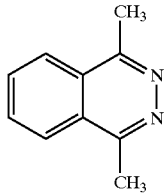
I-72
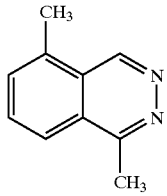
I-73
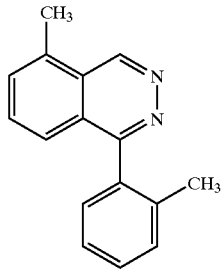
I-74
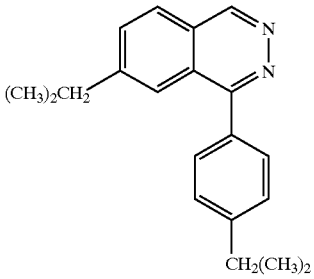

-continued

I-75

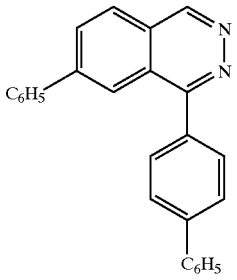

I-76

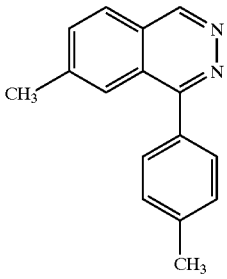

I-77

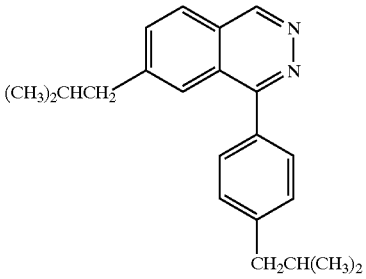

I-78

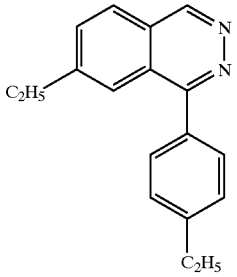

I-79

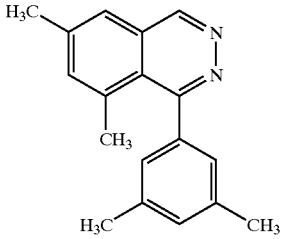

I-80

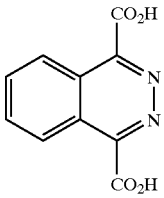

-continued

I-81

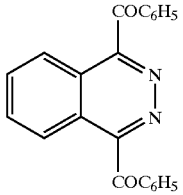

I-82

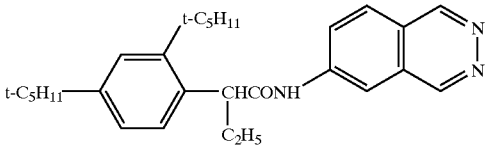

I-83

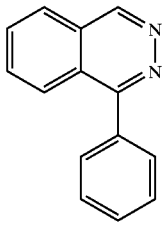

I-84

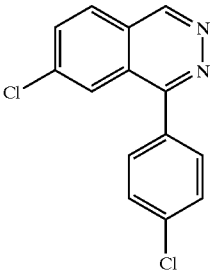

I-85

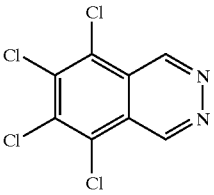

The photothermographic material of the present invention preferably contains an ultrahigh contrast agent. While type of the ultrahigh contrast agent that can be used for the present invention is not particularly limited, preferred examples thereof include all of the hydrazine derivatives represented by the formula (H) mentioned in Japanese Patent Application No. 11-87297 (specifically, the hydrazine derivatives mentioned in Tables 1–4 of the same), the hydrazine derivatives mentioned in JP-A-10-10672, JP-A-10-161270, JP-A-10-62898, JP-A-9-304870, JP-A-9-304872, JP-A-9-304871, JP-A-10-31282, U.S. Pat. No. 5,496,695 and EP741320A.

As the ultrahigh contrast agent used for the present invention, the compounds represented by the formula (20), (21) or (22) can be preferably used. The compounds represented by the formula (20), (21) or (22) will be explained hereinafter.

In the formula (20), $R^{41}$, $R^{42}$ and $R^{43}$ each independently represent hydrogen atom or a substituent, and Z represents an electron-withdrawing group or a silyl group. $R^{41}$ and Z, $R^{42}$ and $R^{43}$, $R^{41}$ and $R^{42}$, or $R^{43}$ and Z may combine with each other to form a ring structure. In the formula (21), $R^{44}$ represents a substituent. In the formula (22), X and Y independently represent hydrogen atom or a substituent, and A and B each independently represent an alkoxy group, an alkylthio group, an alkylamino group, an aryloxy group, an arylthio group, an anilino group, a heterocyclyloxy group, a heterocyclylthio group or a heterocyclylamino group. In the formula (22), X and Y, or A and B may be combined with each other to form a ring structure. Specific examples and preferred combinations of these substituents are those mentioned in the detailed explanations of the substituted alkene derivatives, substituted isoxazole derivatives and particular acetal compounds represented by the formulas (1) to (3) mentioned in Japanese Patent Application No. 11-87297, and the cyclic compounds represented by the formula (A) or (B) mentioned in the same. In the present invention, two or more kind of these ultrahigh contrast agents may be used in combination.

Specific examples of the compounds represented by the formula (20), (21) or (22) will be shown below. However, the compounds are not limited to these examples.

B-1

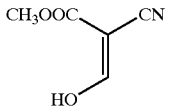

B-2

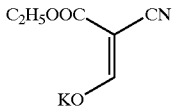

B-3

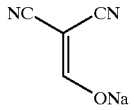

B-4

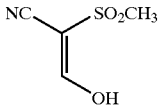

B-5

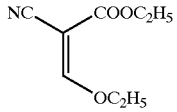

B-6

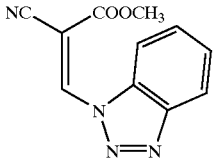

B-7

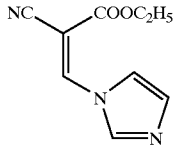

B-8

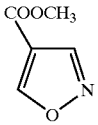

B-9

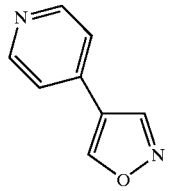

B-10

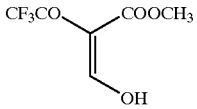

B-11

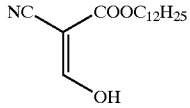

B-12

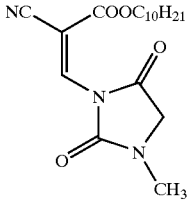

B-13

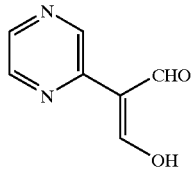

B-14

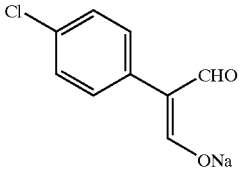

-continued
B-15
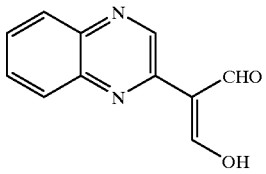
B-16
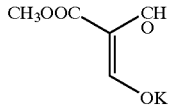
B-17
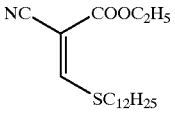
B-18
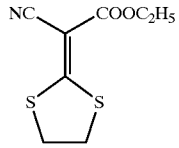
B-19
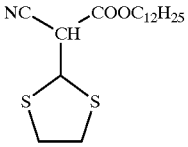
B-20
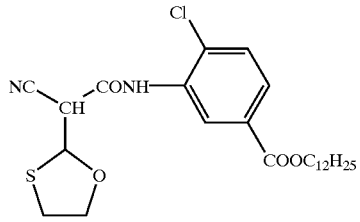
B-21
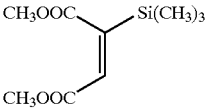
B-22
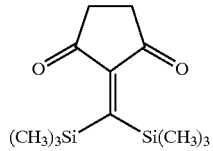
B-23
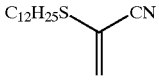
B-24
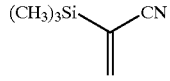
B-25
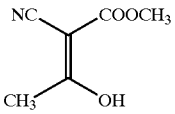
B-26
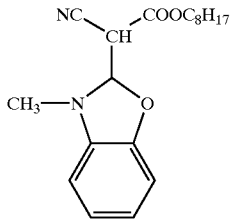
B-27
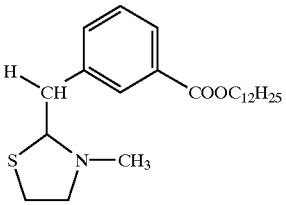
B-28
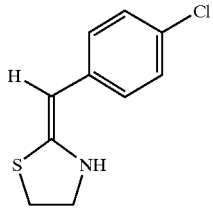
B-29
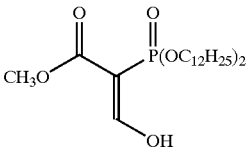
B-30
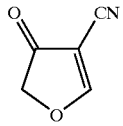

-continued
B-31
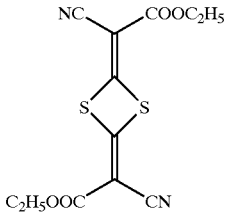
B-32
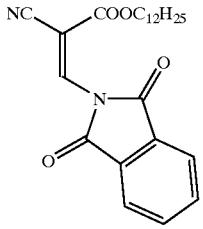
B-33
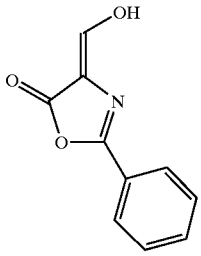
B-34
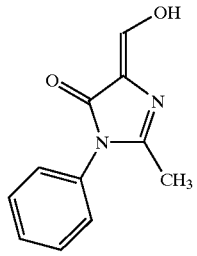
B-35
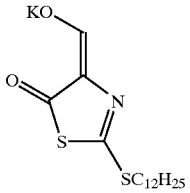
B-36
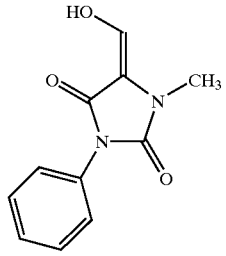
B-37
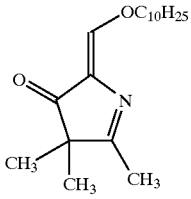
B-38
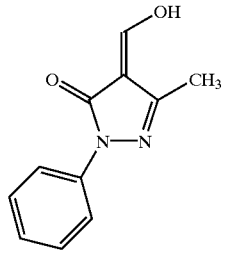
B-39
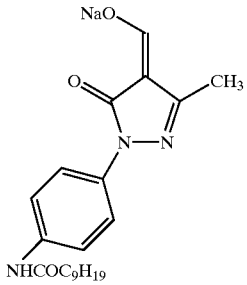
B-40
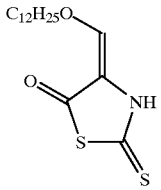

-continued
B-41
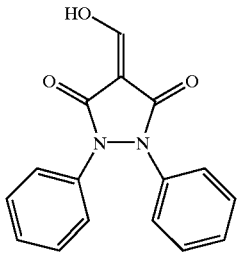
B-42
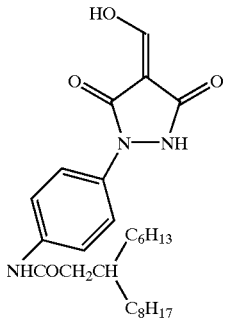
B-43
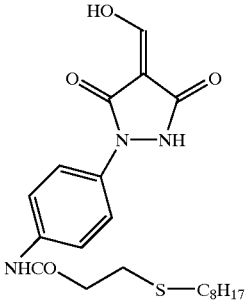
B-44
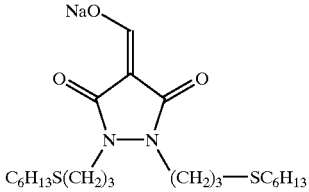
B-45
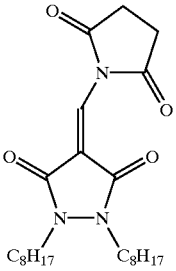
B-46
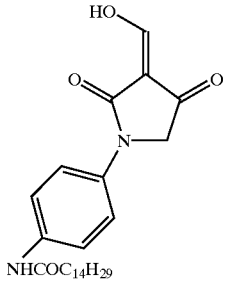
B-47
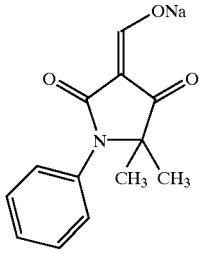
B-48
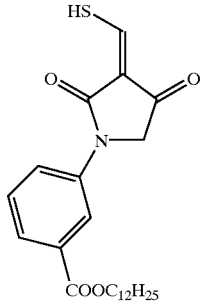
B-49
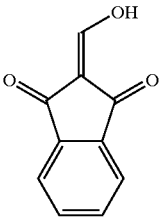
B-50
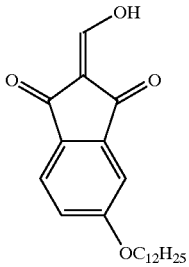

-continued
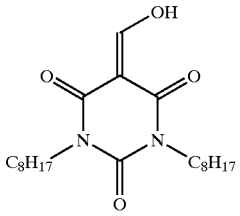
B-51
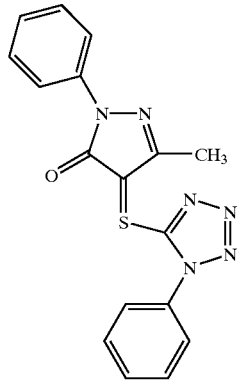
B-52
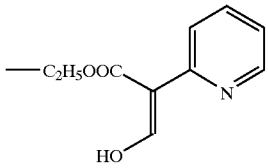
B-53
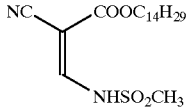
B-54
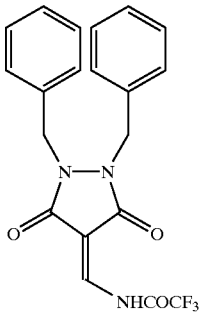
B-55
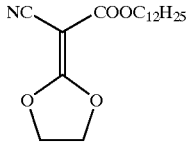
B-56
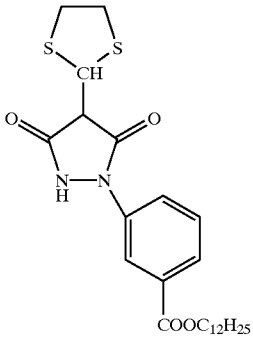
B-57
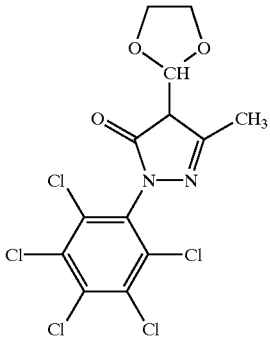
B-58

-continued

B-59

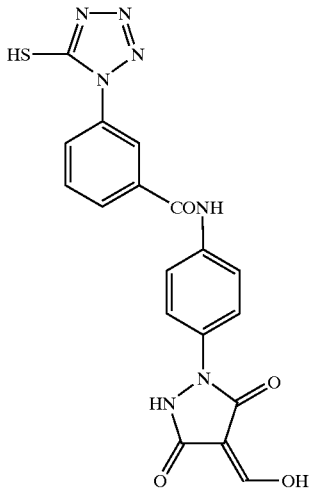

B-60

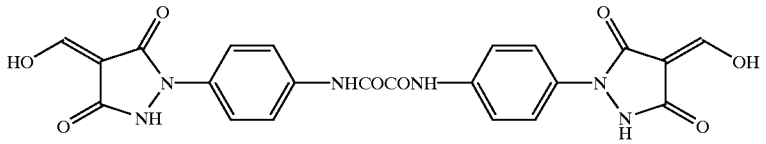

The aforementioned ultrahigh contrast agents may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, they may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, the ultrahigh contrast agent may be used by dispersing powder of the ultrahigh contrast agent in a suitable solvent such as water using a ball mill, colloid mill, or by means of ultrasonic wave according to a known method for solid dispersion.

While the ultrahigh contrast agent may be added to any layer on the image-forming layer side, it is preferably added to the image-forming layer or a layer adjacent thereto.

The amount of the ultrahigh contrast agent is $1\times10^{-6}$ mole to 1 mole, more preferably from $1\times10^{-5}$ mole to $5\times10^{-1}$ mole, further preferably from $2\times10^{-5}$ mole to $2\times10^{-1}$ mole, per mole of silver.

In addition to the aforementioned compounds, the compounds disclosed in U.S. Pat. Nos. 5,545,515, 5,635,339, 5,654,130 WO97/34196 and U.S. Pat. No. 5,686,228, and the compounds disclosed in JP-A-11-119372, JP-A-11-133546, JP-A-11-119373, JP-A-11-109546, JP-A-11-95365, JP-A-11-95366 and JP-A-11-149136 may also be used.

Preferably, the photothermographic material of the present invention further contains at least one kind of compound represented by the formula (23) or (24) as a reducing agent for the silver salt of an organic acid on the same side of the support as the photosensitive silver halide and the reducible silver salt.

In the formula (23), $V^7$ to $V^{14}$ each independently represent hydrogen atom or a substituent. The substituents represented by $V^7$ to $V^{14}$ may be the same or different from each other or one another. Preferred examples of the substituents include a halogen atom (for example, fluorine atom, chlorine atom, bromine atom and iodine atom), a linear, branched or cyclic alkyl group or an alkyl group consisting of a combination thereof having preferably 1–20 carbon atoms, more preferably 1–16 carbon atoms, further preferably 1–13 carbon atoms (for example, methyl, ethyl, n-propyl, isopropyl, sec-butyl, tert-butyl, tert-octyl, n-amyl, tert-amyl, n-dodecyl, n-tridecyl, cyclohexyl etc.), an alkenyl group having preferably 2–20 carbon atoms, more preferably 2–16 carbon atoms, further preferably 2–12 carbon atoms (for example, vinyl, allyl, 2-butenyl, 3-pentenyl etc.), an aryl group having preferably 6–30 carbon atoms, more preferably 6–20 carbon atoms, further preferably 6–12 carbon atoms (for example, phenyl, p-methylphenyl, naphthyl etc.), an alkoxy group having preferably 1–20 carbon atoms, more preferably 1–16 carbon atoms, further preferably 1–12 carbon atoms (for example, methoxy, ethoxy, propoxy, butoxy etc.), an aryloxy group having preferably 6–30 carbon atoms, more preferably 6–20 carbon atoms, further preferably 6–12 carbon atoms (for example, phenyloxy, 2-naphthyloxy etc.), an acyloxy group having preferably 2–20 carbon atoms, more preferably 2–16 carbon atoms, further preferably 2–12 carbon atoms (for example, acetoxy, benzoyloxy etc.), an amino group having preferably 0–20 carbon atoms, more preferably 1–16 carbon atoms, further preferably 1–12 carbon atoms (for example, dimethylamino group, diethylamino group, dibutylamino group, anilino group etc.), an acylamino group having preferably 2–20 carbon atoms, more preferably 2–16 carbon atoms, further preferably 2–13 carbon atoms (for example, acetylamino, tridecanoylamino, benzoylamino etc.), a sulfonylamino group having preferably 1–20 carbon atoms, more preferably 1–16 carbon atoms, further preferably 1–12 carbon atoms (for example, methanesulfonylamino, butanesulfonylamino, benzenesulfonylamino etc.), a ureido group having preferably 1–20 carbon atoms, more preferably 1–16 carbon atoms, further preferably 1–12 carbon atoms (for example, ureido, methylureido, phenylureido etc.), a carbamate group having preferably 2–20 carbon atoms, more preferably 2–16 carbon atoms, further preferably 2–12 carbon atoms (for example, methoxycarbonylamino, phenyloxycarbonylamino etc.), carboxyl group, a carbamoyl group having preferably 1–20 carbon atoms, more preferably 1–16 carbon atoms, further preferably 1–12 carbon atoms (for example, carbamoyl, N,N-diethylcarbamoyl, N-dodecylcarbamoyl, N-phenylcarbamoyl etc.), an alkoxycarbonyl group having preferably 2–20 carbon atoms, more preferably 2–16 carbon atoms, further preferably 2–12 carbon atoms (for example, methoxycarbonyl, ethoxycarbonyl, butoxycarbonyl etc.), an acyl group having preferably 2–20 carbon atoms, more preferably 2–16 carbon atoms, further preferably 2–12 carbon atoms (for example, acetyl, benzoyl, formyl, pivaloyl etc.), a sulfo group, a sulfonyl group having preferably 1–20 carbon atoms, more preferably 1–16 carbon atoms, further preferably 1–12 carbon atoms (for example, mesyl, tosyl etc.), a sulfamoyl group having preferably 0–20 carbon atoms, more preferably 0–16 carbon atoms, further preferably 0–12 carbon atoms (for example, sulfamoyl, methylsulfamoyl, dimethylsulfamoyl, phenylsulfamoyl etc.), a cyano group, a nitro group, a hydroxyl group, a mercapto group, an alkylthio group having preferably 1–20 carbon atoms, more preferably 1–16 carbon atoms, further preferably 1–12 carbon atoms (for example, methylthio, butylthio etc.), a heterocyclic group having preferably 2–20 carbon atoms, more preferably 2–16 carbon atoms, further preferably 2–12 carbon atoms (for example, pyridyl, imidazoyl, pyrrolidyl etc.) and so forth. These substituents may be further substituted with other substituents.

Particularly preferred examples of the substituents represented by $V^7$ to $V^{14}$ are alkyl groups (for example, methyl, ethyl, n-propyl, isopropyl, sec-butyl, tert-butyl, tert-octyl, n-amyl, tert-amyl, n-dodecyl, n-tridecyl, cyclohexyl etc.).

In the formula (23), L represents a bridging group consisting of —CH($V^{15}$)— or —S—. $V^{15}$ represents hydrogen atom or a substituent. Preferred examples of the substituent represented by $V^{15}$ include, for example, a halogen atom (for example, fluorine atom, chlorine atom, bromine atom and iodine atom), a linear, branched or cyclic alkyl group or an alkyl group consisting of a combination thereof having preferably 1–20 carbon atoms, more preferably 1–16 carbon atoms, further preferably 1–13 carbon atoms (for example, methyl, ethyl, n-propyl, isopropyl, sec-butyl, tert-butyl, tert-octyl, n-amyl, tert-amyl, n-dodecyl, n-tridecyl, cyclohexyl, 2,4,4-trimethylpentyl etc.), an alkenyl group having preferably 2–20 carbon atoms, more preferably 2–16 carbon atoms, further preferably 2–12 carbon atoms (for example, vinyl, allyl, 2-butenyl, 3-pentenyl etc.), an aryl group having preferably 6–30 carbon atoms, more preferably 6–20 carbon atoms, further preferably 6–12 carbon atoms (for example, phenyl, p-methylphenyl, naphthyl etc.), an alkoxy group having preferably 1–20 carbon atoms, more preferably 1–16 carbon atoms, further preferably 1–12 carbon atoms (for example, methoxy, ethoxy, propoxy, butoxy etc.), an aryloxy group having preferably 6–30 carbon atoms, more preferably 6–20 carbon atoms, further preferably 6–12 carbon atoms (for example, phenyloxy, 2-naphthyloxy etc.), an acyloxy group having preferably 2–20 carbon atoms, more preferably 2–16 carbon atoms, further preferably 2–12 carbon atoms (for example, acetoxy, benzoyloxy etc.), an amino group having preferably 0–20 carbon atoms, more preferably 1–16 carbon atoms, further preferably 1–12 carbon atoms (for example, dimethylamino group, diethylamino group, dibutylamino group, anilino group etc.), an acylamino group having preferably 2–20 carbon atoms, more preferably 2–16 carbon atoms, further preferably 2–13 carbon atoms (for example, acetylamino, tridecanoylamino, benzoylamino etc.), a sulfonylamino group having preferably 1–20 carbon atoms, more preferably 1–16 carbon atoms, further preferably 1–12 carbon atoms (for example, methanesulfonylamino, butanesulfonylamino, benzenesulfonylamino etc.), a ureido group having preferably 1–20 carbon atoms, more preferably 1–16 carbon atoms, further preferably 1–12 carbon atoms (for example, ureido, methylureido, phenylureido etc.), a carbamate group having preferably 2–20 carbon atoms, more preferably 2–16 carbon atoms, further preferably 2–12 carbon atoms (for example, methoxycarbonylamino, phenyloxycarbonylamino etc.), a carboxyl group, a carbamoyl group having preferably 1–20 carbon atoms, more preferably 1–16 carbon atoms, further preferably 1–12 carbon atoms (for example, carbamoyl, N,N-diethylcarbamoyl, N-dodecylcarbamoyl, N-phenylcarbamoyl etc.), an alkoxycarbonyl group having preferably 2–20 carbon atoms, more preferably 2–16 carbon atoms, further preferably 2–12 carbon atoms (for example, methoxycarbonyl, ethoxycarbonyl, butoxycarbonyl etc.), an acyl group having preferably 2–20 carbon atoms, more preferably 2–16 carbon atoms, further preferably 2–12 carbon atoms (for example, acetyl, benzoyl, formyl, pivaloyl etc.), a sulfo group, a sulfonyl group having preferably 1–20 carbon atoms, more preferably 1–16 carbon atoms, further preferably 1–12 carbon atoms (for example, mesyl, tosyl etc.), a sulfamoyl group having preferably 0–20 carbon atoms, more preferably 0–16 carbon atoms, further preferably 0–12 carbon atoms (for example, sulfamoyl, methylsulfamoyl, dimethylsulfamoyl, phenylsulfamoyl, etc.), a cyano group, a nitro group, a hydroxyl group, a mercapto group, an alkylthio group having preferably 1–20 carbon atoms, more preferably 1–16 carbon atoms, further preferably 1–12 carbon atoms (for example, methylthio, butylthio etc.), aheterocyclic group having preferably 2–20 carbon atoms, more preferably 2–16 carbon atoms, further preferably 2–12 carbon atoms (for example, pyridyl, imidazoyl, pyrrolidyl etc.) and so forth. These substituents may be further substituted with other substituents.

Particularly preferred examples of the substituent represented by $V^{15}$ are an alkyl group (for example, methyl, ethyl, n-propyl, isopropyl, sec-butyl, tert-butyl, tert-octyl, n-amyl, n-octyl, tert-amyl, n-dodecyl, n-tridecyl, cyclohexyl, 2,4,4-trimethylpentyl etc.), an alkenyl group (for example, vinyl, allyl, 2-butenyl, 3-pentenyl etc.), an aryl group (for example, phenyl, p-methylphenyl, naphthyl etc.), a hydroxyl group, a mercapto group, an alkylthio group (for example, methylthio, butylthio etc.) and so forth.

Specific examples of the compound represented by the formula (23) will be shown below. However, the compounds used for the present invention are not limited to these examples.

(I-1)
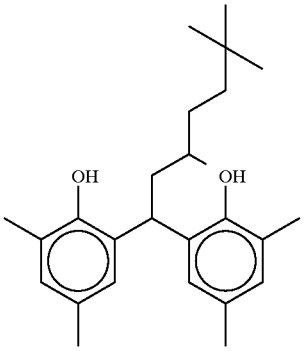
(I-2)
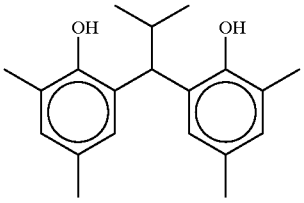
(I-3)
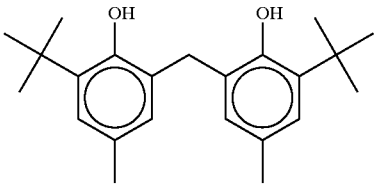
(I-4)
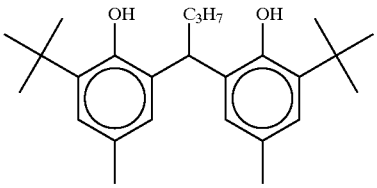
(I-5)
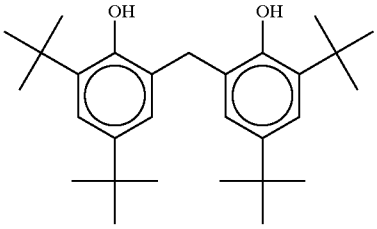
(I-6)
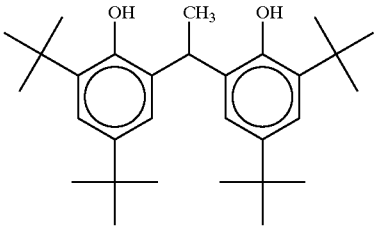
-continued
(I-7)
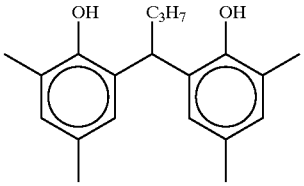
(I-8)
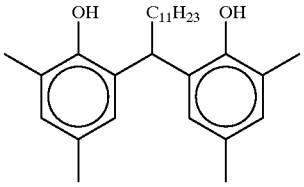
(I-9)
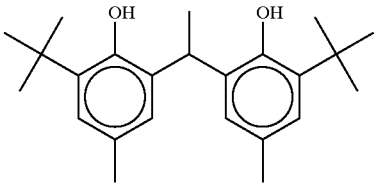
(I-10)
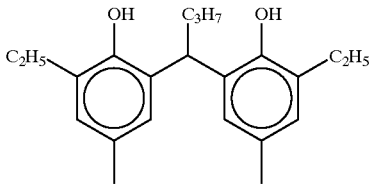
(I-11)
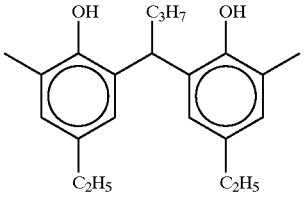
(I-12)
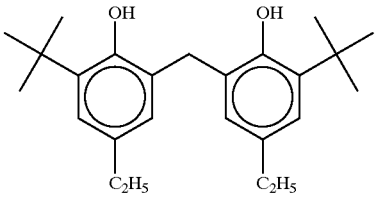
(I-13)
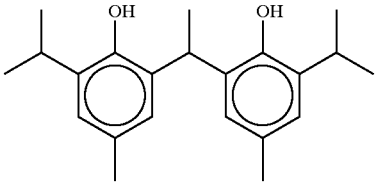

-continued
(I-14)
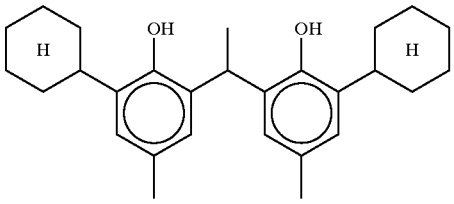
(I-15)
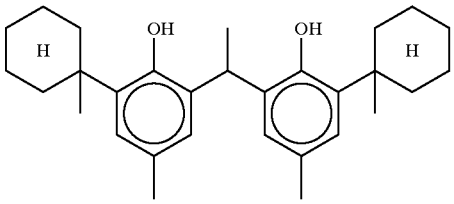
(I-16)
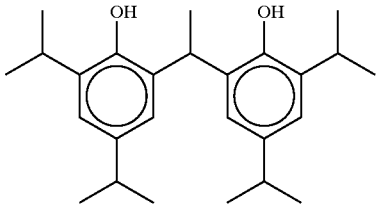
(I-17)
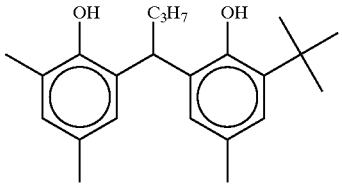
(I-18)
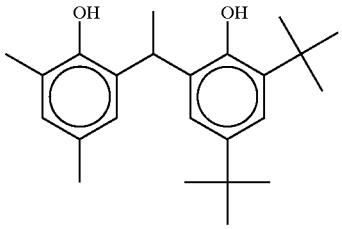
(I-19)
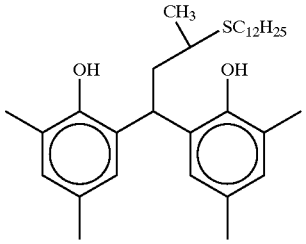
(I-20)
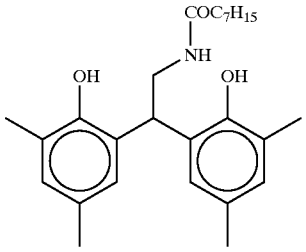
-continued
(I-21)
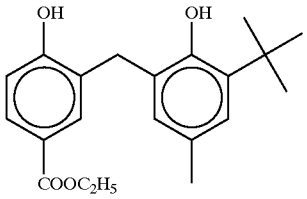
(I-22)
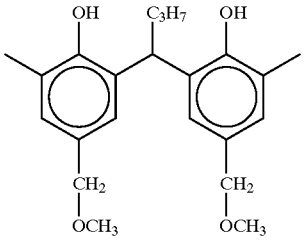
(I-23)
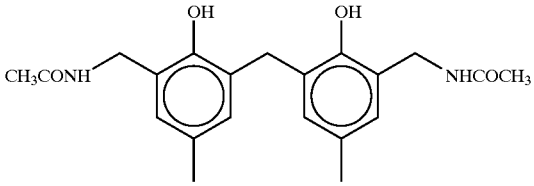
(I-24)
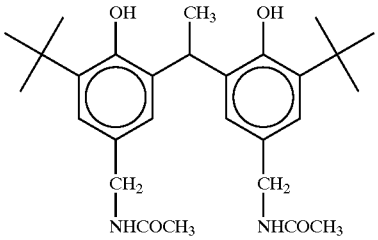
(I-25)
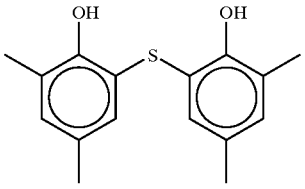
(I-26)
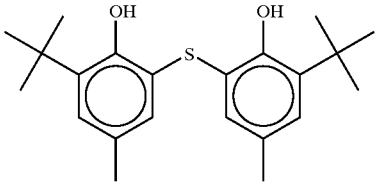

-continued (I-27)

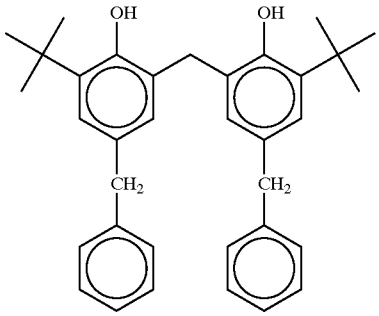

(I-28)

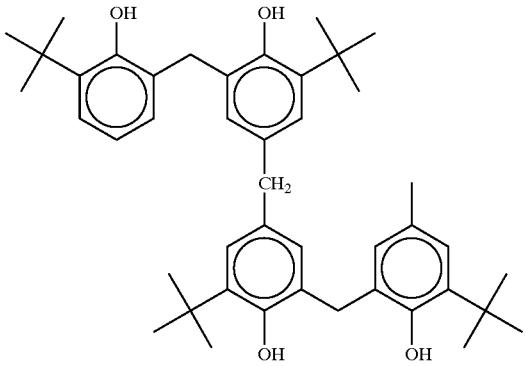

(I-29)

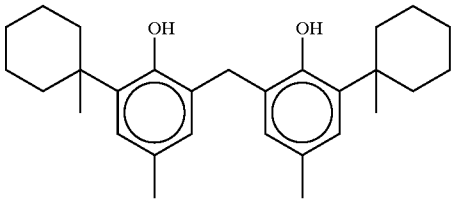

(I-30)

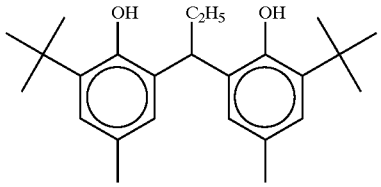

(I-31)

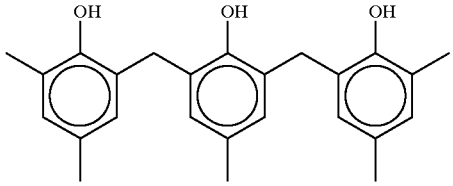

(I-32)

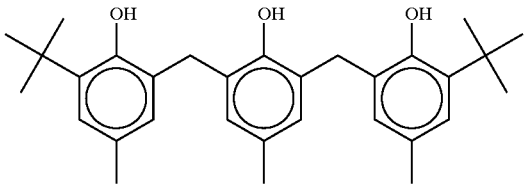

-continued (I-33)

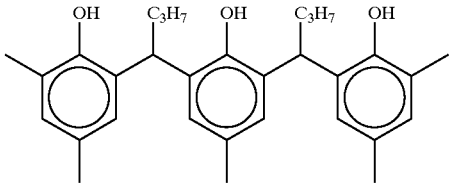

(I-34)

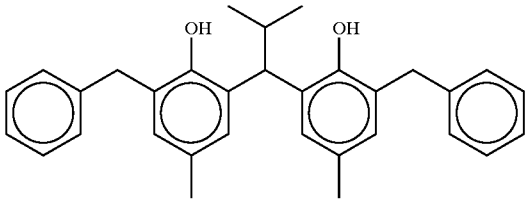

The compounds represented by the formula (24) will be explained hereinafter. In the formula (24), $V^{16}$ to $V^{20}$ each independently represent hydrogen atom or a substituent. The substituents represented by $V^{16}$ to $V^{20}$ may be the same or different from each other or one another. Preferred examples of the substituents include a halogen atom (for example, fluorine atom, chlorine atom, bromine atom and iodine atom), a linear, branched or cyclic alkyl group or an alkyl group consisting of a combination thereof having preferably 1–20 carbon atoms, more preferably 1–16 carbon atoms, further preferably 1–13 carbon atoms (for example, methyl, ethyl, n-propyl, isopropyl, sec-butyl, tert-butyl, tert-octyl, n-amyl, tert-amyl, n-dodecyl, n-tridecyl, cyclohexyl etc.), an alkenyl group having preferably 2–20 carbon atoms, more preferably 2–16 carbon atoms, further preferably 2–12 carbon atoms (for example, vinyl, allyl, 2-butenyl, 3-pentenyl etc.), an aryl group having preferably 6–30 carbon atoms, more preferably 6–20 carbon atoms, further preferably 6–12 carbon atoms (for example, phenyl, p-methylphenyl, naphthyl etc.), an alkoxy group having preferably 1–20 carbon atoms, more preferably 1–16 carbon atoms, further preferably 1–12 carbon atoms (for example, methoxy, ethoxy, propoxy, butoxy etc.), an aryloxy group having preferably 6–30 carbon atoms, more preferably 6–20 carbon atoms, further preferably 6–12 carbon atoms (for example, phenyloxy, 2-naphthyloxy etc.), an acyloxy group having preferably 2–20 carbon atoms, more preferably 2–16 carbon atoms, further preferably 2–12 carbon atoms (for example, acetoxy, benzoyloxy etc.), an amino group having preferably 0–20 carbon atoms, more preferably 1–16 carbon atoms, further preferably 1–12 carbon atoms (for example, dimethylamino group, diethylamino group, dibutylamino group, anilino group etc.), an acylamino group having preferably 2–20 carbon atoms, more preferably 2–16 carbon atoms, further preferably 2–13 carbon atoms (for example, acetylamino, tridecanoylamino, benzoylamino etc.), a sulfonylamino group having preferably 1–20 carbon atoms, more preferably 1–16 carbon atoms, further preferably 1–12 carbon atoms (for example, methanesulfonylamino, butanesulfonylamino, benzenesulfonylamino etc.), a ureido group having preferably 1–20 carbon atoms, more preferably 1–16 carbon atoms, further preferably 1–12 carbon atoms (for example, ureido, methylureido, phenylureido etc.), a carbamate group having preferably 2–20 carbon atoms, more preferably 2–16 carbon atoms, further preferably 2–12 carbon atoms (for example, methoxycarbonylamino, phenyloxycarbonylamino etc.), a carboxyl group, a carbamoyl group having preferably 1–20 carbon atoms, more preferably 1–16 carbon atoms, further preferably 1–12 carbon atoms (for example, carbamoyl, N,N-diethylcarbamoyl, N-dodecylcarbamoyl, N-phenylcarbamoyl etc.), an alkoxycarbonyl group having preferably 2–20 carbon atoms, more preferably 2–16 carbon atoms, further preferably 2–12 carbon atoms (for example, methoxycarbonyl, ethoxycarbonyl, butoxycarbonyl etc.), an acyl group having preferably 2–20 carbon atoms, more preferably 2–16 carbon atoms, further preferably 2–12 carbon atoms (for example, acetyl, benzoyl, formyl, pivaloyl etc.), a sulfo group, a sulfonyl group having preferably 1–20 carbon atoms, more preferably 1–16 carbon atoms, further preferably 1–12 carbon atoms (for example, mesyl, tosyl etc.), a sulfamoyl group having preferably 0–20 carbon atoms, more preferably 0–16 carbon atoms, further preferably 0–12 carbon atoms (for example, sulfamoyl, methylsulfamoyl, dimethylsulfamoyl, phenylsulfamoyl etc.), a cyano group, a nitro group, a hydroxyl group, a mercapto group, an alkylthio group having preferably 1–20 carbon atoms, more preferably 1–16 carbon atoms, further preferably 1–12 carbon atoms (for example, methylthio, butylthio etc.), a heterocyclic group having preferably 2–20 carbon atoms, more preferably 2–16 carbon atoms, further preferably 2–12 carbon atoms (for example, pyridyl, imidazoyl, pyrrolidyl etc.) and so forth. These substituents may be further substituted with other substituents.

Particularly preferred examples of the substituents represented by $V^{16}$ to $V^{20}$ are alkyl groups (for example, methyl, ethyl, n-propyl, isopropyl, sec-butyl, tert-butyl, tert-octyl, n-amyl, tert-amyl, n-dodecyl, n-tridecyl, cyclohexyl etc.).

Further, the compound represented by the formula (24) may be provided in the form of a precursor, or there may be used a compound comprising a monovalent group derived from a compound represented by the formula (24) bonded through a bridging group (e.g., a bridging group represented as —C(X) (Y)— wherein X and Y each independently represent hydrogen atom, an alkyl group, an aryl group or a heterocyclic group, and these groups may have a substituent).

Specific examples of the compound represented by the formula (24) will be shown below. However, the compounds used for the present invention are not limited to these examples.

(II-1)

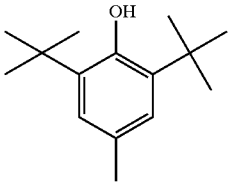

(II-2)

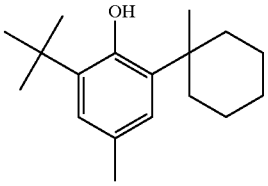

(II-3)

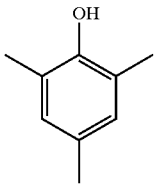

(II-4)

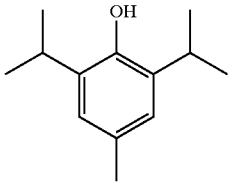

(II-5)

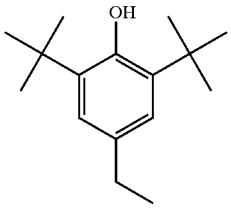

(II-6)

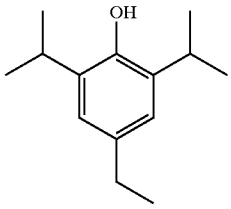

(II-7)

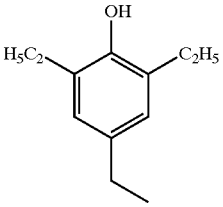

(II-8)

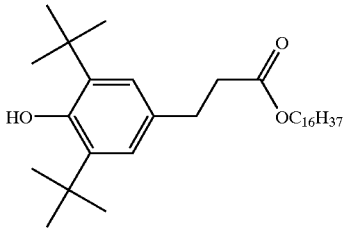

-continued
(II-9)
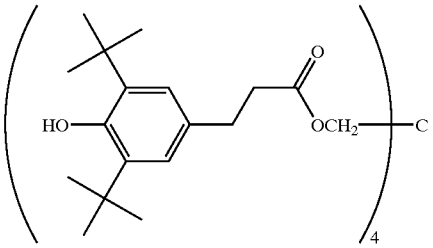
(II-10)
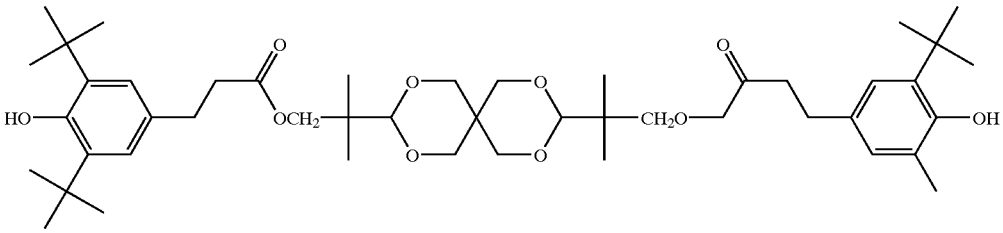
(II-11)
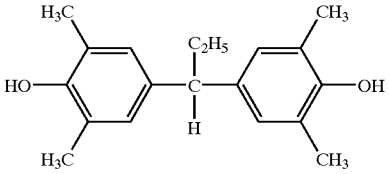
(II-12)
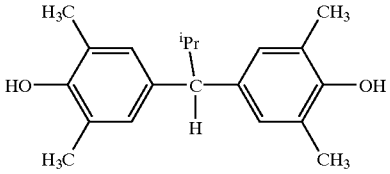
(II-13)
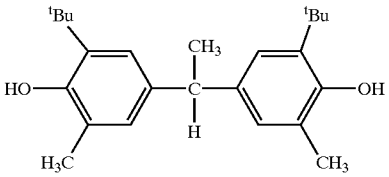
(II-14)
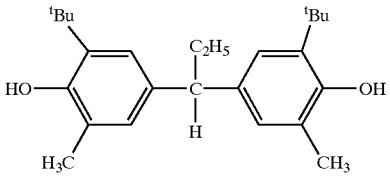
(II-15)
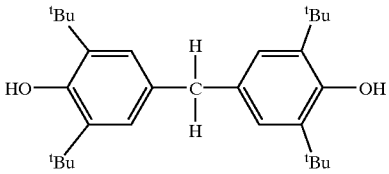
(II-16)
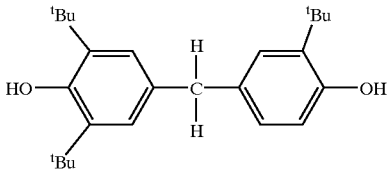
(II-17)
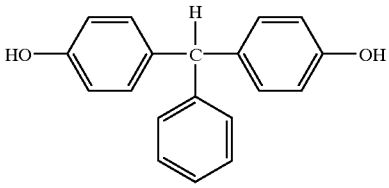
(II-18)
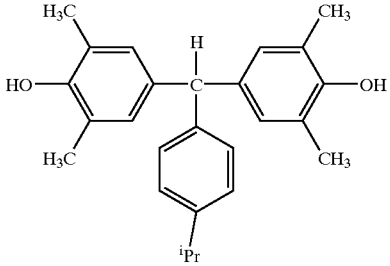
(II-19)
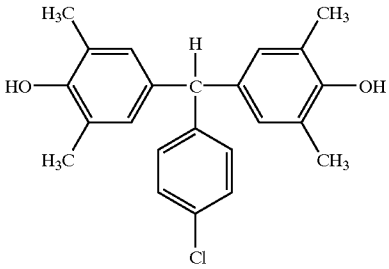
(II-20)
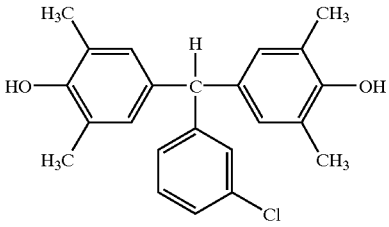

-continued (II-21)

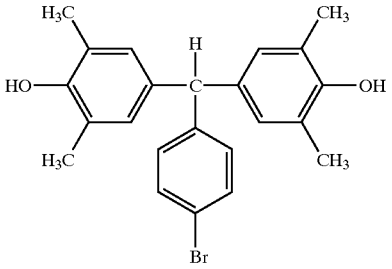

(II-22)

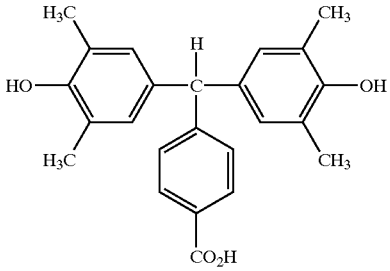

(II-23)

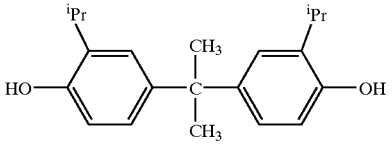

(II-24)

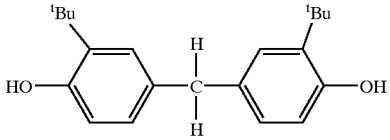

(II-25)

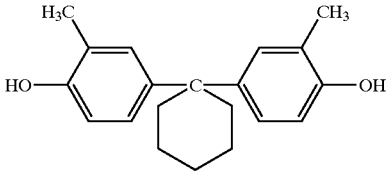

(II-26)

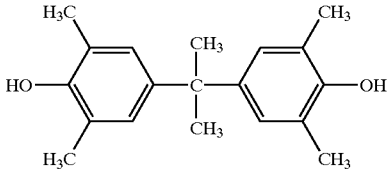

(II-27)

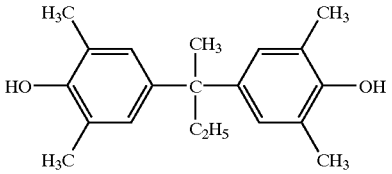

(II-28)

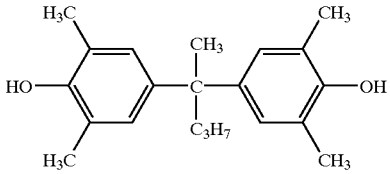

(II-29)

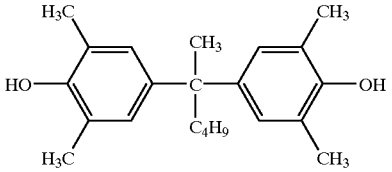

(II-30)

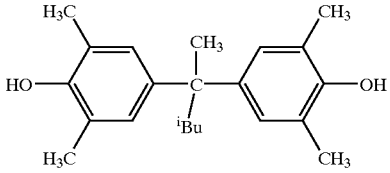

(II-31)

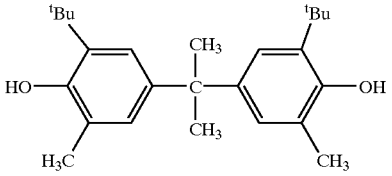

While the amount of the compound represented by the formula (23) or (24) is not particularly limited, it is preferably 0.01–100000%, more preferably 1–5000%, further preferably 10–1000%, with respect to the compound represented by the formula (1) or (2).

The compounds represented by the formula (23) or (24) may be added in any form, for example, as a solution, powder, solid microparticle dispersion and so forth. The solid microparticle dispersion can be formed by a known pulverization means (for example, a ball mill, vibration ball mill, sand mill, colloid mill, jet mill, roller mill etc.). Further, when solid microparticle dispersion is prepared, a dispersing aid may be used.

The compound represented by the formula (23) or (24) may be added to any layer provided on the same side on a support as the photosensitive silver halide and the reducible silver salt. However, it is preferably added to a layer containing the silver halide or a layer adjacent thereto.

The photothermographic material of the present invention may contain a reducing agent for the silver salt of an organic acid in addition to the compounds represented by the formula (1), (2), (23) and (24). The reducing agent for the silver salt of an organic acid may be any substance that reduces silver ion to metal silver, preferably such an organic substance. In addition to conventional photographic developers such as phenidone, hydroquinone and catechol, hindered phenol reducing agents can also be mentioned as preferred examples. The reducing agent is preferably contained in an amount of 5–50 mole %, more preferably 10–40 mole %, per mole of silver on the side having the image-forming layer. The reducing agent may be added to any layer on the image-forming layer side of the support. In the case of adding the reducing agent to a layer other than the image-forming layer, the reducing agent is preferably used in a slightly larger amount, i.e., 10–50 mole % per mole of silver. The reducing agent may also be a so-called precursor that is derived to effectively function only at the time of development.

For photothermographic materials using silver salt of an organic acid, various types of reducing agents can be used. There can be used, for example, the reducing agents disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,9586, 3,679,426, 3,751,252, 3,751,255, 3,761,270, 3,782,949, 3,839,048, 3,928,686and 5,464,738, German Patent No. 2,321,328, EP692732A and so forth.

Specific examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with ascorbic acid such as a combination of 2,2-bis(hydroxymethyl)propionyl-β-phenylhydrazine with ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl) methane; combinations of a bis-β-naphthol with a 1,3-dihydroxybenzene derivative such as 2,4-dihydroxybenzophenone and 2,4-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-dione etc.; chromans such as 2,2-dimethyl-7-tert-butyl-6-hydroxychroman; 1,4-dihydropyridines such as 2,6-dimethoxy-3,5-dicarboethoxy-1,4-dihydropyridine; bisphenols such as bis(2-hydroxy-3-tert-butyl-5-methylphenyl)methane, 2,2-bis(4-hydroxy-3-methylphenyl) propane, 4,4-ethylidene-bis(2-tert-butyl-6-methylphenol), 1,1 -bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; chromanols such as tocopherol and so forth.

The photothermographic material of the present invention may be used as either of a monochromatic photosensitive material and color photosensitive material. For obtaining a wide range of colors on the chromaticity diagram by using three primary colors of yellow, magenta and cyan, at least three silver halide emulsion layers each having photosensitivity in a different spectral region are used in combination. For example, there are a combination of three layers of blue sensitive layer, green sensitive layer and red sensitive layer, a combination of a green sensitive layer, red sensitive layer and infrared sensitive layer and so forth. These photosensitive layers may be provided in various orders known in ordinary color photosensitive materials. Further, each of these photosensitive layers may consist of two or more layers as required. The photosensitive material may be provided with various auxiliary layers, e.g., a protective layer, undercoat layer, intermediate layer, antihalation layer, back layer and so forth. Further, various filter dyes may also be added to the photosensitive material in order to improve color separation property.

In the photothermographic material of the present invention, it is sufficient that at least one photosensitive layer is provided on the support. A typical example thereof is a silver halide photographic material that comprises a support having thereon at least one photosensitive layer comprising a plurality of silver halide emulsion layers having substantially the same spectral sensitivity but different photosensitivities. That photosensitive layer is a unit photosensitive layer having spectral sensitivity to any one of blue light, green light and red light. In the case of a multi-layer silver halide color photographic material, the unit photosensitive layers are generally arranged so that a red sensitive unit layer, green sensitive layer and blue sensitive layer should be provided in this order from the support side. However, depending on the purpose, the above arrangement order may be reversed or a layer having different light sensitivity may be present between layers having the same spectral sensitivities. A non-photosensitive layer may be provided between the aforementioned silver halide photosensitive layers, or as an uppermost layer or as a lowermost layer. These layers may contain the aforementioned couplers, developing agents, DIR compounds, color mixing inhibitor, dyes and so forth. As for a plurality of the silver halide emulsion layers constituting each unit photosensitive layer, two layers of a high sensitivity emulsion layer and a low sensitivity emulsion layer are preferably provided so that the photosensitivity should decrease in sequence toward the support as mentioned in German Patent No. 1,121,470 and British Patent No. 923,045. Further, it is also possible to provide a low sensitivity emulsion layer at a position remoter from the support and a high sensitivity emulsion layer at a position nearer to the support as mentioned in JP-A-57-112751, JP-A-62-200350, JP-A-62-206541 and JP-A-62-206543.

Specific examples of the layer arrangement include orders of, from the remotest side from the support, a low sensitivity blue sensitive layer (BL) /high sensitivity blue sensitive layer (BH)/high sensitivity green sensitive layer (GH)/low sensitivity green sensitive layer (GL)/high sensitivity red sensitive layer (RH)/low sensitivity red sensitive layer (RL), BH/BL/GL/GH/RH/RL, BH/BL/GH/GL/RL/RH and so forth.

Further, as described in JP-B-55-34932, an arrangement of blue sensitive layer/GH/RH/GL/RL from the remotest side from the support may be used. Furthermore, as described in JP-A-56-25738 and JP-A-62-63936, an arrangement of blue-sensitive layer/GL/RL/GH/RH from the remotest side from the support may also be employable.

An arrangement consisting of three layers different in the photosensitivity as mentioned in JP-B-49-15495 may be used, where a silver halide emulsion layer having the highest photosensitivity is provided as an upper layer, a silver halide emulsion layer having a photosensitivity lower than that of the upper layer as an intermediate layer and a silver halide emulsion layer having a photosensitivity lower than that of the intermediate layer as a lower layer so that the photosensitivity should be decreased in sequence toward the support. Even in such a case of three layer structure having different light sensitivities, an arrangement of medium sensitivity emulsion layer/high sensitivity emulsion layer/low sensitivity emulsion layer of the same spectral sensitivity from the remotest side from the support may be used in a layer of the same spectral sensitivity as mentioned in JP-A-59-202464.

In addition, an arrangement of high sensitivity emulsion layer/low sensitivity emulsion layer/medium sensitivity emulsion layer, or an arrangement of low sensitivity emulsion layer/medium sensitivity emulsion layer/high sensitivity emulsion layer may also be used. In the case of four or more layer structure, the layer arrangement may also be changed as mentioned above.

In order to improve color reproducibility, a donor layer (CL) having a spectral sensitivity distribution different from that of the main photosensitive layers such as BL, GL and RL and capable of providing an interlayer effect is preferably provided adjacent to or in the vicinity of the main photosensitive layers as mentioned in U.S. Pat. Nos. 4,663,271, 4,705,744, 4,707,436, JP-A-62-160448 and JP-A-63-89850.

In the present invention, although the silver halide, dye-donating coupler and color formation developing agent may be contained in the same layer, they may be separately added to separate layers so long as they can react with one another. For example, by separating a layer containing the color formation developing agent and a layer containing the silver halide, storability of the photosensitive material before exposure may be improved.

The relationship of spectral sensitivity and coupler's hue of each layer may be arbitrarily selected. If the photosensitive material is constructed so that it should contain a cyan coupler in a red sensitive layer, a magenta coupler in a green sensitive layer, and a yellow coupler in a blue sensitive layer, conventional color paper may be used for direct exposure.

The photosensitive material may contain various non-photosensitive layers such as a protective layer, undercoat layer, intermediate layer, yellow filter layer and antihalation layer between the aforementioned silver halide emulsion layers or as an uppermost or lowermost layer. Further, various auxiliary layers such as a back layer may be provided on the opposite side of the support. More specifically, it is possible to provide various layers including those of the layer structures mentioned in the aforementioned patent documents, undercoat layer mentioned in U.S. Pat. No. 5,051,335, intermediate layer containing a solid pigment mentioned in JP-A-1-167838 and JP-A-61-20943, intermediate layer containing a reducing agent or DIR compound mentioned in JP-A-1-120553, JP-A-5-34884 and JP-A-2-64634, intermediate layer containing an electron transporting agent mentioned in U.S. Pat. Nos. 5,017,454, 5,139,919 and JP-A-2-235044, protective layer containing a reducing agent mentioned in JP-A-4-249245, combinations of two or more of these layers and so forth.

As a dye that can be used in the yellow filter layer or antihalation layer, preferred is a dye that is decolored or eliminated during the development and hence does not contribute to the density after the development.

The decoloration or elimination of the dye in the yellow filter layer or antihalation layer during the development means that the amount of the dye remaining after the development is one third or less, preferably one tenth or less, of the amount of the dye present immediately before the coating. This may be attained by transfer of the dye component of photosensitive material into a processing material during the development, or by a phenomenon that the dye component undergoes a reaction to become a colorless compound during the development.

Specifically, dyes mentioned in EP549489A and dyes of ExF 2 to 6 mentioned in JP-A-7-152129 can be mentioned. There can also be used a dye in the form of solid dispersion as mentioned in JP-A-8-101487.

Further, it is also possible that a dye is mordanted in a mordant and binder. In this case, the mordant and dye may be those known in the field of photography, and there can be mentioned mordants mentioned in U.S. Pat. No. 4,500,626, columns 58 to 59, JP-A-61-88256, pp. 32 to 41, JP-A-62-244043 and JP-A-62-244036.

Furthermore, it is also possible to use a reducing agent and a compound that reacts with the reducing agent to release a diffusive dye so that a mobile dye should be released by an alkali used in the development and transferred to a processing material or eliminated. Examples of such compounds are mentioned in U.S. Pat. Nos. 4,559,290, 4,783,396, EP220746A2, JIII Journal of Technical Disclosure (Kokai Giho) No. 87-6119 and JP-A-8-101487, paragraphs 0080–0081.

A leuco dye which is decolored can also be used. For example, JP-A-1-150132 discloses a silver halide photosensitive material containing a leuco dye that is previously colored with a metal salt of an organic acid as a color developer. A complex of the leuco dye and the color developer is decolored by heat or reaction with an alkali.

Known leuco dyes can be used, and examples thereof are mentioned in Moriga and Yoshida, "Senryo to Yakuhin (Dyes and Chemicals)", vol. 9, p. 84, Association of Chemical Products, "Shinban Senryo Binran (New Handbook of Dyes)", p. 242, Maruzen Co., Ltd. (1970), R. Garner, "Reports on the Progress of Applied Chemistry", vol. 56, p. 199 (1971), "Senryo to Yakuhin (Dyes and Chemicals)", vol. 19, p. 230, Association of Chemical Products (1974), "Shinkizai (Color Materials)", vol. 62, p. 288 (1989), "Senryo Kogyo (Die Industry)", vol. 32, p. 208 and so forth.

As the color developer, acid clay color developers and phenol/formaldehyde resins as well as metal salts of an organic acid are preferably used. Among the metal salts of an organic acid, metal salts of salicylic acids, metal salt of phenol/salicylic acid/formaldehyde resin, rhodan salts and metal salts of xanthogenic acid and so forth are useful. Zinc is particularly preferred among metals. Among the aforementioned color developers, oil-soluble zinc salicylate mentioned in U.S. Pat. Nos. 3,864,146, 4,046,941 and JP-B-52-1327 can be used.

Further, various additives mentioned below can also be used together.

Dispersion medium of oil-soluble organic compound: P-3, 5, 16, 19, 25, 30, 42, 49, 54, 55, 66, 81, 85, 86, 93 mentioned in JP-A-62-215272, pages 140 to 144, Latex for impregnation with oil-soluble organic compounds: latex mentioned in U.S. Pat. No. 4,199,363, Oxidized developing agent scavenger: compounds represented by the formula (1) mentioned in U.S. Pat. No. 4,978,606, column 2, lines 54 to 62 (in particular, I-, (1), (2), (6) and (12) (columns 4 to 5)); compounds represented by the formulas mentioned in U.S. Pat. No. 4,923,787, column 2, lines 5 to 10 (in particular, Compound 1 (column 3)), Stain inhibitor: compounds of the formulas (I) to (III) mentioned in EP298321A, page 4, lines 30 to 33, in particular, I-47, 72, III-1 and 27 (pages 24 to 48), Fading inhibitor: A-6, 7, 20, 21, 23, 24, 25, 26, 30, 37, 40, 42, 48, 63, 90, 92, 94 and 164 mentioned in EP298321A, pages 69 to 118; II-1 to III-23, in particular, III-10, mentioned in U.S. Pat. No. 5,122,444, columns 25 to 38; I-1 to III-4, in particular, II-2, mentioned in EP471347A, pages 8 to 12; A-1 to 48, in particular, A-39 and 42, mentioned in U.S. Pat. No. 5,139,931, columns 32 to 40;

Materials for reducing the amount of color formation enhancer or color mixing inhibitor: I-1 to II-15, in particular, I-46, mentioned in EP411324A, pages 5 to 24;

Formalin scavenger: SCV-1 to 28, in particular, SCV-8, mentioned in EP477932A, pages 24 to 29;

Hardener: H-1, 4, 6, 8 and 14 mentioned in JP-A-1-214845, page 17; compounds represented by the formulae (VII) to (XII) (H-1 to 54) mentioned in U.S. Pat. No. 4,618,573, columns 13 to 23; compounds represented by the formula (6) (H-1 to 76), in particular, H-14, mentioned in JP-A-2-214852, page 8, lower right column; compounds mentioned in U.S. Pat. No. 3,325,287, claim 1, Development inhibitor precursor: P-24, 37 and 39 mentioned in JP-A-62-168139, pages 6 to 7; compounds mentioned in U.S. Pat. No. 5,019,492, claim 1, in particular, Compounds 28 and 29 mentioned in column 7 of the same, Preservative, antifungus agent: I-1 to III-43, in particular, II-1, 9, 10, 18 and III-25, mentioned in U.S. Pat. No. 4,923,790, columns 3 to 15;

Stabilizer, antifoggant: I-1 to (14), in particular, I-1, 60, (2) and (13), mentioned in U.S. Pat. No. 4,923,793, columns 6 to 16; Compounds 1 to 65, in particular, 36, mentioned in U.S. Pat. No. 4,952,483, columns 25 to 32;

Chemical sensitization agent: triphenylphosphine selenide; Compound 50 mentioned in JP-A-5-40324;

Dyes: a-1 to b-20, in particular, a-1, 12, 18, 27, 35, 36 and b-5, mentioned in JP-A-3-156450, pp. 15 to 18, V-1 to 23, in particular, V-1, pp. 27 to 29 of the same; F-I-1 to F-II-43, in particular, F-I-11 and F-II-8, mentioned in EP445627A, pages 33 to 55; III-1 to 36, in particular III-1, 3, mentioned in EP457153A, pp. 17 to 28; microparticle dispersions of Dye-1 to 124 mentioned in WO88/04794, pages 8 to 26; Compounds 1 to 22, in particular, Compound 1, mentioned in EP319999A, pages 6 to 11; Compounds D-1 to 87 represented by the formulae (1) to (3) mentioned in EP519306A, pages 3 to 28; Compounds 1 to 22 represented by the formula (1) mentioned in U.S. Pat. No. 4,268,622, columns 3 to 10; Compounds (1) to (31) represented by the formula (1) mentioned in U.S. Pat. No. 4,923,788, columns 2 to 9;

UV absorber: Compounds (18b) to (18r) represented by the formula (1) mentioned in JP-A-46-3335, pages 6 to 9; Compounds (3) to (66) represented by the formula (1) mentioned in EP520938A, pages 10 to 44 and Compounds HBT-1 to 10 represented by the formula (III) mentioned in page 14 of the same; Compounds (1) to (31) represented by the formula (1) mentioned in EP521823A, columns 2 to 9.

A base is generally required for treatment of photographic photosensitive materials. For the photographic material of the present invention, various mechanisms for supplying base may be used. For example, when a base-generating function is imparted to the photosensitive material, a base precursor may be added to the photosensitive material. Examples of such a base precursor include salts of organic acids with bases that are decarboxylated by heat, compounds that release amines by intramolecular nucleophilic substitution reaction, Lossen rearrangement or Beckman rearrangement and so forth. Examples thereof are mentioned in U.S. Pat. Nos. 4,514,493, 4,657,848 and so forth.

In the present invention, when a reducing compound represented by the aforementioned formula (1) or (2) is used, base may not be used.

In the present invention, while the color developing agent used when a base is not used may be either of compounds represented by the aforementioned formulas (1) and (2), a compound represented by the formula (2) is preferred.

The photosensitive silver halide used for the present invention is not particularly limited as for the halogen composition, and silver chloride, silver chlorobromide, silver bromide, silver iodobromide, silver chloroiodobromide and so forth-may be used. Grain formation of the photosensitive silver halide emulsion may be attained by the method mentioned in JP-A-11-119374, paragraphs 0217–0224. However, the method is not particularly limited to this method.

Examples of the form of silver halide grains include a cubic form, octahedral form, tetradecahedral form, tabular form, spherical form, rod-like form, potato-like form and so forth. In particular, cubic grains and tabular grains are preferred for the present invention. As for the characteristics of the grain form such as aspect ratio and surface index of the grains, they may be similar to those mentioned in JP-A-11-119374, paragraph 0225. Further, the halide composition may have a uniform distribution in the inner part and surface of the silver halide grains, or the composition may change stepwise or continuously in the grains. Silver halide grains having a core/shell structure may also be preferably used. Core/shell grains having preferably a double to quintuple structure, more preferably a double to quadruple structure, may be used. A technique for localizing silver bromide on the surface of silver chloride or silver chlorobromide grains may also be preferably used.

When the photothermographic material of the present invention is used as a photosensitive material for capturing images, silver halide emulsion having sufficient sensitivity for capturing images must be used.

The sensitivity of silver halide emulsion is generally proportional to the light-receiving area of the grains as light-receiving elements, i.e., the project area of the silver halide grains. In the heat development process as used in the present invention, since the development reaction amount occurring in neighborhood of development starting points is restricted compared with the conventional solution development process, it is effective to increase the number of development starting points per unit area of the photosensitive material in order to obtain sufficient image density. To attain this, it is effective to increase the number of silver halide grains contained in per unit area of the photosensitive material. However, there is simultaneously arisen a problem of increase of the coated silver halide amount. This problem becomes serious, in particular, when silver halide grains of a relatively large size (about 0.4–2 $\mu$m of diameter as spheres) having sensitivity for capturing images are used.

For this reason, it is preferable to use the so-called tabular grains that have a small grain volume relative to the light-receiving area. The form of tabular grains is usually mentioned by using the so-called aspect ratio, which is obtained by dividing diameter of a circle equivalent to a projected area with grain thickness. Even when grains have the same sensitivity, those having a larger aspect ratio can increase the number of silver halide grains per unit amount of used silver, and therefore they are more preferred.

The silver halide emulsion used for the photosensitive material of the present invention preferably has such a grain composition that tabular grains having a thickness of 0.3 $\mu$m or less, preferably 0.2 $\mu$m or less, and an aspect ratio of 2–100, preferably 8–80, show 50% of the whole projected areas of grains. If such silver halide emulsion is used, high sensitivity and good graininess will be obtained with a small amount of coated silver amount. The grain thickness is more preferably 0.15 μm or less, most preferably 0.10 μm or less. If all of the silver halide emulsions used for the photosensitive material are designed to have such a thickness or smaller thickness, the advantage of the present invention is obtained most markedly.

The aspect ratio is preferably 5 or more, more preferably 8 or more, most preferably 12 or more. When grains having a relatively small grain size, i.e., about 0.5 μm or less in terms of a grain size represented with diameter of a sphere having the same volume, are used, the grains preferably have a tabular degree of 25 or more, which is calculated by further dividing the aspect ratio with the grain thickness.

The techniques for using these tabular grains having a high aspect ratio and characteristics of these tabular grains having a high aspect ratio are disclosed in U.S. Pat. Nos. 4,433,048, 4,434,226 and 4,439,520. Further, techniques concerning the tabular grains having a grain thickness of less than 0.07 μm and a very high aspect ratio are disclosed in U.S. Pat. Nos. 5,494,789, 5,503,970, 5,503,971 and 5,536,632, European Patent Nos. 0699945, 0699950, 0699948, 0699944, 0701165, 0699946 and so forth. In order to prepare tabular grains having a small grain thickness and a high aspect ratio, it is important to control parameters such as the concentration of binder, temperature, pH, kind of excess halogen ion, ion concentration of excess halogen ion, supply rate of reaction solution and so forth during the nucleation. In order to selectively grow the created tabular nuclei in the peripheral direction, not in the direction of the thickness, it is important to control the addition rate of a reaction solution for growing the grains as well as to select the most suitable binder for the stages of from the grain formation to the growth of grains. In this respect, gelatin having a low methionine content and gelatin of which amino groups are modified with phthalic acid, trimellitic acid, pyromellitic acid and so forth are advantageous.

The composition of silver halide that can be used for the present invention is selected according to the characteristics that should be imparted to the photosensitive silver halide. When high sensitivity is imparted as photosensitive materials for capturing images, it is advantageous to use silver bromide or silver iodobromide. It is preferable to use high silver chloride content emulsion having a silver chloride content of 50% or more, preferably and 80% or more, because it can reduce haze of the photosensitive material after development.

In the present invention, while silver halide grains of various shapes can be used, the grains preferably have monodispersed grain size distribution. Silver halide emulsion preferably used for the present invention preferably has a variation coefficient for grain size distribution of 40% or less, more preferably 30% or less, most preferably 20% or less.

When the silver halide grains are tabular grains, a smaller variation coefficient for grain thickness distribution is also preferred. This variation coefficient is preferably 40% or less, more preferably 30% or less, most preferably 20% or less.

Silver halide grains are prepared so that they should have various structures in grains, in addition to the devising of the shapes thereof. A commonly used technique is a method of constituting each grain with multiple layers with different halogen compositions. For silver iodobromide grains used for materials for capturing images, it is preferable to prepare layers of different iodine contents. The so-called high iodine content core type core/shell grains are known for the purpose of controlling developability, in which a core having a high iodine content is coated with a shell having a low iodine content. Contrary to the above, high iodine content shell type core/shell grains are also known, which have a shell having a high iodine content. These grains are effective for enhancing stability of the shape, when-the grain thickness of tabular grains is reduced. There is also known a technique in which high sensitivity is attained by covering a core having a low iodine content with a first shell having a high iodine content and depositing a second shell having a low iodine content thereon. In silver halide grains prepared in such a manner, dislocation lines are formed in the shell deposited on the high iodine content phase (in a tabular grain, this corresponds to a fringe portion at outer periphery of the grain) due to crystal irregularity, and they contribute to obtaining high sensitivity. For the deposition of the high iodine content phase, there can be preferably used a method comprising adding a solution of water-soluble iodide such as potassium iodide alone, or adding it simultaneously with a solution of water-soluble silver salt such as silver nitrate, a method comprising introducing silver iodide microparticles into a system, a method comprising adding a compound that releases an iodide ion upon reaction with an alkali or a nucleophilic agent (for example, sodium p-iodoacetamidobenzenesulfonate etc.) and so forth.

In the present invention, epitaxially grown projections may be deposited on the surface of the aforementioned various host grains.

In the present invention, the silver halide grains are preferably doped with polyvalent metal ions such as transition metal elements. Although such polyvalent metal ions can also be introduced in the form of halide, nitrate or the like during the grain formation, it is preferable to introduce the polyvalent metal ions in the form of metal complex containing the polyvalent metal ion as the center metal (halogeno complex, ammine complex, cyano complex, nitrosyl complex etc.).

The metal complexes preferably used in the present invention are complexes in which ligands that can significantly cleave d-orbital on spectral chemical series such as cyanide ions are coordinated around a metal ion belonging to the first, second or third transition series. It is preferred that the coordination form of these complexes is a 6-coordinated complex in which 6 ligands are coordinated to form an octahedron and the number of cyane ligands among them is 4 or more.

Preferred ligands other than the cyane ligands can be selected from inorganic ligands such as SCN, NCS and $H_2O$ and organic ligands such as pyridine, bipyridine, phenanthroline, imidazole and pyrazole, and used.

Examples of preferred center transition metals are iron, cobalt, ruthenium, rhenium, osmium and iridium.

The photosensitive silver halide emulsion used in the present invention can contain, in addition to the aforementioned metal complexes, complexes comprising ruthenium, rhodium, palladium or iridium carrying a halide ion or thiocyanate ion as a ligand, complexes comprising ruthenium having one or more nitrosyl ligands, complexes comprising chromium having a cyanide ion ligand and so forth.

In the present invention, the silver halide grains are preferably doped with divalent anions of so-called chalcogen elements such as sulfur, selenium and tellurium in addition to the aforementioned metal complexes. These dopants are also useful for obtaining high sensitivity and improving exposure condition dependency.

The preparation of silver halide grains used in the present invention can be performed based on known methods, for example, those methods described in P. Glafkides, Chimie et Phisique Photographique, Paul Montel, 1967; G. F. Duffin, Photographic Emulsion Chemistry, Focal Press, 1966; V. L. Zelikman et al., Making and Coating of Photographic Emulsion, Focal Press, 1964 and so forth. That is, the preparation can be performed in various pH regions by the acidic method, neutral method, ammonia method and so forth. Further, the single addition method, simultaneous addition method and so forth may be used alone in combination as a method for supplying reaction solutions of water-soluble silver salt and water-soluble halogen salt. It is also preferable to employ the controlled double jet method in which the addition of reaction solutions is controlled so that pAg should be maintained at a target value during the reaction. Further, a method for maintaining pH during the reaction at a constant value is also employed. When the grains are formed, although the solubility of silver halide can be controlled by varying the temperature, pH or pAg of the system, thioethers, thioureas or rhodan salts can also be used as a solvent. Examples of these are mentioned in, for example, JP-B-47-113-86 and JP-A-53-144319.

The silver halide particle used for the present invention is usually prepared by supplying a solution of water-soluble silver salt such as silver nitrate and solution of water-soluble halogen salt such as an alkali halide into an aqueous solution of water-soluble binder such as gelatin under controlled conditions. After the formation of the silver halide grains, excessive water-soluble salts are preferably removed. For this, a variety of means may be employed, which include the noodle washing process comprising gelling a gelatin solution containing silver halide grains, cutting the gel into strings and then washing away the water-soluble salts from the strings with cold water and the precipitation process comprising coagulating the gelatin by adding to the solution an inorganic salt comprising a polyvalent anion (e.g., sodium sulfate), an anionic surfactant, an anionic polymer (e.g., sodium polystyrenesulfonate) or a gelatin derivative (e.g., aliphatic acylated gelatin, aromatic acylated gelatin, aromatic carbamoylated gelatin etc.), and thereafter removing the excess salts. The precipitation process is favorably used, because the excessive salt can be rapidly removed.

In the present invention, it is normally preferable to use silver halide emulsion subjected to chemical sensitization comprising any of known sensitization methods each alone or as combination thereof. The chemical sensitization imparts high sensitivity to the prepared silver halide grains and contributes to impartation of stability of the silver halide emulsion for exposure conditions and storage conditions.

As the chemical sensitization, preferably employed is chalcogen sensitization utilizing a sulfur, selenium or tellurium compound. As these sensitizers, there are used compounds that release the chalcogen elements to form a silver chalcogenide when they are added to silver halide emulsion. Use of a combination of these sensitizers is also preferable in view of achieving high sensitivity and reducing fog.

Noble metal sensitization utilizing gold, platinum, iridium or the like is also preferred. In particular, gold sensitization utilizing chloroauric acid alone or in combination with a compound that can be a ligand of gold such as thiocyanate ion can provide high sensitivity. A combination of gold sensitization and chalcogen sensitization can provide further higher sensitivity.

The so-called reductive sensitization is also preferably used, in which reductive silver nuclei are introduced during the grain formation by using a compound having appropriate reducing property to obtain high sensitivity. Also preferred is reductive sensitization in which an alkynylamine having an aromatic ring is added to silver halide emulsion during the chemical sensitization thereof.

When chemical sensitization is performed, it is also preferable to control reactivity of silver halide grains by using a compound that can be adsorbed on the silver halide grains. It is particularly preferable to add a nitrogen-containing heterocyclic compound or a mercapto compound, or a sensitizing dye such as cyanine dye or merocyanine dye prior to the chalcogen sensitization or gold sensitization.

Although the conditions for the chemical sensitization vary depending on the purpose, the temperature is in the range of 30–95° C., preferably in the range of 40–75° C., pH is in the range of 5.0–11.0, preferably in the range of 5.5–8.5, and pAg is in the range of 6.0–10.5, preferably in the range of 6.5–9.8.

The techniques concerning chemical sensitization are mentioned in, for example, JP-A-3-110555, JP-A-5-241267, JP-A-62-253159, JP-A-5-45833, JP-A-62-40446 and so forth. In these chemical sensitization processes, it is also preferable to form epitaxially grown projections.

In the present invention, photosensitive silver halide emulsion is preferably subjected to the so-called spectral sensitization, which imparts sensitivity in a desired wavelength region to the silver halide emulsion. In particular, color photosensitive materials comprise photosensitive layers sensitive to blue, green and red, respectively, in order to reproduce colors conforming to the original with high fidelity. Such sensitivities can be imparted by spectrally sensitizing silver halide with so-called spectral sensitizing dyes.

Examples of such dyes include cyanine dyes, merocyanine dyes, complex cyanine dyes, complex merocyanine dyes, holopolar cyanine dyes, hemicyanine dyes, styryl dyes, hemioxonol dyes and so forth. Examples of these sensitizing dyes are disclosed in, for example, U.S. Pat. No. 4,617,257, JP-A-59-180550, JP-A-64-13546, JP-A-5-45828, JP-A-5-45834 and so forth.

These sensitizing dyes may be used alone, or they may also be used in a combination thereof. A combination of these sensitizing dyes is used for adjustment of distribution of spectral sensitivity as for wavelength or for supersensitization. By using a combination of dyes exhibiting a supersensitization effect, it is possible to obtain sensitivity far greater than the sum of sensitivities that can be obtained by using dyes individually.

Further, the photosensitive silver halide emulsion preferably further contains a dye having no spectral sensitization effect by itself or a compound which is substantially incapable of absorbing visible light, but exhibiting supersensitization effect. Examples of the compound exhibiting supersensitization effect include diaminostilbene compounds. Examples of these compounds are mentioned in U.S. Pat. No. 3,615,641, JP-A-63-23145 and so forth.

These spectral sensitizing dyes or supersensitizing dyes can be added to the silver halide emulsion at any stage of the preparation of the emulsion. There are various methods including, for examples, a method in which the addition is performed when a coating solution is prepared from an emulsion after the chemical sensitization thereof, a method in which the addition is performed upon completion of the chemical sensitization, a method in which the addition is performed during the chemical sensitization, a method in which the addition is performed before the chemical sensitization, a method in which the addition is performed after the grain formation but before desalting, a method in which the addition is performed during the process of grain formation, a method in which the addition is performed before grain formation and so forth. These methods may be employed each alone, or in combination. It is preferable to perform the addition in a process before the chemical sensitization in view of obtaining high sensitivity.

The amounts of the spectral sensitizing dye and supersensitizing dye may significantly differ depending on the form and size of the grains, and depending on the photographic characteristics to be imparted. However, in general, the amounts are in the range of from $10^{-8}$ to $10^{-1}$ mole, preferably $10^{-5}$ to $10^{-2}$ mole, per one mole of silver halide. These compounds can be added in the form of a solution in an organic solvent such as methanol and fluorinated alcohol, or in the form of a dispersion in water together with a surfactant or gelatin.

In order to prevent fogging or to improve storage stability, various stabilizers are preferably added to the silver halide emulsion. Preferred examples of such stabilizers include nitrogen-containing heterocyclic compounds such as azaindenes, triazoles, tetrazoles and purines, and mercapto compounds such as mercaptotetrazoles, mercaptotriazoles, mercaptoimidazoles and mercaptothiadiazoles. Details of these compounds are described in T. H. James, The Theory of the Photographic Process, Macmillan, 1977, pp. 396–399, and references cited therein.

In the present invention, among these antifoggants, mercaptotriazoles having an alkyl group containing 4 or more carbon atoms or a plurality of aromatic groups as substituents are particularly preferably used.

In the case of using a mercapto compound, those having any structure may be used but those represented by Ar—SM or Ar—S—S—Ar are preferred, wherein M is hydrogen atom or an alkali metal atom, and Ar is an aromatic ring or condensed aromatic ring containing one or more nitrogen, sulfur, oxygen, selenium or tellurium atoms. The heteroaromatic ring is preferably selected from benzimidazole, naphthimidazole, benzothiazole, naphthothiazole, benzoxazole, naphthoxazole, benzoselenazole, benzotellurazole, carbazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have one or more substituents selected from, for example, the group consisting of a halogen (e.g., Br, Cl), hydroxy, amino, carboxy, alkyl (e.g., alkyl having one or more carbon atoms, preferably from 1 to 4 carbon atoms), alkoxy (e.g., alkoxy having one or more carbon atoms, preferably from 1 to 4 carbon atoms) and aryl (which may have a substituent). Examples of the mercapto-substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-{3-(5-mercaptotetrazolyl)phenyl}urea, 2-mercapto-4-phenyloxazole, N-[3-(mercaptoacetylamino)propyl] carbazole and so forth. However, the present invention is not limited to these.

These antifoggants and stabilizers may be added to silver halide emulsion at any stage of the preparation of emulsion. Various methods in which addition is performed after chemical sensitization and at the time of preparation of coating solution, upon completion of chemical sensitization, during chemical sensitization, before chemical sensitization, after grain formation and before desalting, during grain formation, before grain formation or the like may be used each alone or in any combination thereof.

The amounts of these antifoggants and stabilizers may significantly differ depending on the halogen composition of the silver halide emulsion, purpose of the addition or the like. However, the amounts are generally in the range of from $10^{-6}$ to $10^{-1}$ mole, preferably $10^{-5}$ to $10^{-2}$ mole, per one mole of silver halide.

As for the grain size distribution of the silver halide grains used for the present invention, the grains show monodispersion degree of 30% or less, preferably 1–20%, more preferably 5–15%. The monodispersion degree used herein is defined as a percentage (%) of value obtained by dividing standard deviation of grain size by average grain size (variation coefficient). The grain size of the silver halide grains is represented as a ridge length for cubic grains, or a diameter as circle of projected area for the other grains (octahedral grains, tetradecahedral grains, tabular grains and so forth) for convenience.

The photosensitive silver halide grains used for the present invention preferably contain a metal of Group VII or Group VIII in the periodic table of elements or a complex of such a metal. The metal of Group VII or Group VIII of the periodic table or the center metal of the complex is preferably rhodium, rhenium, ruthenium, osmium or iridium. Particularly preferred metal complexes are $(NH_4)_3Rh(H_2O)Cl_5$, $K_2Ru(NO)Cl_5$, $K_3IrCl_6$ and $K_4Fe(CN)_6$. The metal complexes may be used each alone, or two or more complexes of the same or different metals may also be used in combination. The metal or metal complex content is preferably in the range of from $1\times10^{-9}$ to $1\times10^{-3}$ mole, more preferably $1\times10^{-8}$ to $1\times10^{-4}$ mole, per mole of silver. As for specific structures of metal complexes, metal complexes of the structures mentioned in JP-A-7-225449 and so forth can be used. Types and addition methods of these heavy metals and complexes thereof are mentioned in JP-A-11-119374, paragraphs 0227–0240.

The photosensitive silver halide grains may be desalted by washing methods with water known in the art, such as the noodle washing and flocculation washing. However, the grains may not be desalted in the present invention.

The photosensitive silver halide grains used in the present invention are preferably subjected to chemical sensitization. For the chemical sensitization, the method mentioned in JP-A-11-119374, paragraphs 0242–0250 can preferably be used.

Silver halide emulsions used in the present invention may be added with thiosulfonic acid compounds by the method mentioned in EP293917A.

As gelatin used with the photosensitive silver halide used for the present invention, low molecular weight gelatin is preferably used in order to maintain good dispersion state of the silver halide emulsion in a coating solution containing a silver salt of an organic acid. The low molecular weight gelatin has a molecular weight of 500–60,000, preferably 1,000–40,000. While such low molecular weight gelatin may be added during the formation of grains or dispersion operation after the desalting treatment, it is preferably added during dispersion operation after the desalting treatment. It is also possible to use ordinary gelatin (molecular weight of about 100,000) during the grain formation and use low molecular weight gelatin during dispersion operation after the desalting treatment.

While the concentration of dispersion medium may be 0.05–20 weight %, it is preferably in the range of 5–15 weight % in view of handling. As for type of gelatin, alkali-treated gelatin is usually used. Besides that, however, acid-treated gelatin, modified gelatin such as phthalated gelatin and so forth can also be used.

In the photothermographic material of the present invention, one kind of photosensitive silver halide emulsion may be used or two or more different emulsions (for example, those having different average grain sizes, different halogen compositions, different crystal habits or those subjected to different chemical sensitization conditions) may be used in combination.

The amount of the photosensitive silver halide used in the present invention is preferably from 0.01–0.5 mole, more preferably from 0.02–0.3 mole, still more preferably from 0.03–0.25 mole, per mole of the silver salt of an organic acid. Methods and conditions for mixing photosensitive silver halide and a silver salt of an organic acid, which are prepared separately, are not particularly limited so long as the effect of the present invention can be attained satisfactorily. Examples thereof include, for example, a method of mixing silver halide grains and a silver salt of an organic acid after completion of respective preparations by using a high-speed stirring machine, ball mill, sand mill, colloid mill, vibrating mill or homogenizer or the like, or a method of preparing a silver salt of an organic acid by mixing a photosensitive silver halide obtained separately at any time during the preparation of the silver salt of an organic acid. In the mixing, two or more kinds of organic acid silver salt aqueous dispersions are preferably mixed with two or more kinds of photosensitive silver salt aqueous dispersions in order to control the photographic properties.

The silver salt of an organic acid that can be used for the present invention is a silver salt relatively stable against light, but forms a silver image when it is heated at 80° C. or higher in the presence of an exposed photocatalyst (e.g., a latent image of photosensitive silver halide) and a reducing agent. The silver salt of an organic acid may be any organic substance containing a source of reducible silver ions. Silver salts of an organic acid, in particular, silver salts of a long chain aliphatic carboxylic acid having from 10 to 30, preferably from 15 to 28 carbon atoms, are preferred. Complexes of organic or inorganic acid silver salts of which ligands have a complex stability constant in the range of 4.0–10.0 are also preferred. The silver supplying substance can preferably constitute about 5–70 weight % of the image-forming layer. Preferred examples of the silver salts of an organic acid include silver salts of organic compounds having carboxyl group. Specifically, the silver salts of an organic acid may be silver salts of an aliphatic carboxylic acid and silver salts of an aromatic carboxylic acid, but not limited to these. Preferred examples of the silver salts of an aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate, mixtures thereof and so forth.

In the present invention, there is preferably used silver salt of an organic acid having a silver behenate content of 75 mole % or more, more preferably silver salt of an organic acid having a silver behenate content of 85 mole % or more, among the aforementioned silver salts of an organic acid and mixtures of silver salts of an organic acid. The silver behenate content used herein means a molar percent of silver behenate with respect to silver salt of an organic acid to be used. As silver salts of an organic acid other than silver behenate contained in the silver salts of organic acid used for the present invention, the silver salts of an organic acid exemplified above can preferably be used.

Silver salts of an organic acid that can be preferably used for the present invention can be prepared by allowing a solution or suspension of an alkali metal salt (e.g., Na salts, K salts, Li salts) of the aforementioned organic acids to react with silver nitrate. As the preparation method, the method mentioned in Japanese Patent Application No. 11-104187, paragraphs 0019–0021 can be used.

In the present invention, a method of preparing a silver salt of an organic acid by adding an aqueous solution of silver nitrate and a solution of alkali metal salt of an organic acid into a sealable means for mixing liquids can preferably be used. Specifically, the method mentioned in Japanese Patent Application No. 11-203413 can be used.

In the present invention, a dispersing agent soluble in water can be added to the aqueous solution of silver nitrate and the solution of alkali metal salt of an organic acid or reaction mixture during the preparation of the silver salt of an organic acid. Type and amount of the dispersing agent used in this case are specifically mentioned in Japanese Patent Application No. 11-115457, paragraph 0052.

The silver salt of an organic acid for use in the present invention is preferably prepared in the presence of a tertiary alcohol. The tertiary alcohol preferably has a total carbon number of 15 or less, more preferably 10 or less. Examples of preferred tertiary alcohols include tert-butanol. However, tertiary alcohol that can be used for the present invention is not limited to it.

The tertiary alcohol used for the present invention may be added at any time during the preparation of the organic acid silver salt, but the tertiary alcohol is preferably used by adding at the time of preparation of the organic acid alkali metal salt to dissolve the organic alkali metal salt. The tertiary alcohol for use in the present invention may be added in any amount of 0.01–10 in terms of the weight ratio to water used as a solvent for the preparation of the silver salt of an organic acid, but preferably added in an amount of 0.03–1 in terms of weight ratio to water.

Although shape and size of the organic acid silver salt used for the present invention are not particularly limited, those mentioned in Japanese Patent Application No. 11-104187, paragraph 0024 can be preferably used. The shape of the organic acid silver salt can be determined from a transmission electron microscope image of organic silver salt dispersion. An example of the method for determining monodispesibility is a method comprising obtaining the standard deviation of a volume weight average diameter of the organic acid silver salt. The percentage of a value obtained by dividing the standard deviation by volume weight average diameter (variation coefficient) is preferably 80% or less, more preferably 50% or less, particularly preferably 30% or less. As a measurement method, for example, the grain size can be determined by irradiating organic acid silver salt dispersed in a liquid with a laser ray and determining an autocorrelation function for change of fluctuation of the scattered light with time (volume weight average diameter). The average grain size determined by this method is preferably from 0.05–10.0 $\mu$m, more preferably from 0.1–5.0 $\mu$m, further preferably from 0.1–2.0 $\mu$m, as in solid microparticle dispersion.

The silver salt of an organic acid used in the present invention is preferably desalted. The desalting method is not particularly limited and any known methods may be used. Known filtration methods such as centrifugal filtration, suction filtration, ultrafiltration and flocculation washing by coagulation may be preferably used. As the method of ultrafiltration, the method mentioned in Japanese Patent Application Nos. 11-115457 can be used.

In the present invention, for obtaining an organic acid silver salt solid dispersion having a high S/N ratio and a small grain size and being free from coagulation, there is preferably used a dispersion method comprising steps of converting an aqueous dispersion that contains a silver salt of an organic acid as an image-forming medium and contains substantially no photosensitive silver salt into a high-speed flow, and then releasing the pressure. As such a dispersion method, the method mentioned in Japanese Patent Application No. 11-104187, paragraphs 0027–0038 can be used.

The grain size distribution of the silver salt of an organic acid used for the present invention preferably corresponds to monodispersion. Specifically, the percentage (variation coefficient) of the value obtained by dividing a standard deviation of volume weight average diameter by volume weight average diameter is preferably 80% or less, more preferably 50% or less, particularly preferably 30% or less.

The organic acid silver salt grain solid dispersion used for the present invention consists at least of a silver salt of an organic acid and water. While the ratio of the silver salt of an organic acid and water is not particularly limited, the ratio of the silver salt of an organic acid is preferably in the range of 5–50 weight %, particularly preferably 10–30 weight %, with respect to the total weight. While it is preferred that the aforementioned dispersing agent should be used, it is preferably used in a minimum amount within a range suitable for minimizing the grain size, and it is preferably used in an amount of 0.5–30 weight %, particularly preferably 1–15 weight %, with respect to the silver salt of an organic acid.

The silver salt of an organic acid for use in the present invention may be used in any desired amount. However, it is preferably used in an amount of 0.1–5 g/m$^2$, more preferably 1–3 g/m$^2$, in terms of silver.

In the present invention, metal ions selected from Ca, Mg, Zn and Ag are preferably added to the non-photosensitive silver salt of an organic acid. The metal ions selected from Ca, Mg, Zn and Ag are preferably added to the non-photosensitive silver salt of an organic acid in the form of a water-soluble metal salt, not a halide compound. Specifically, they are preferably added in the form of nitrate or sulfate. Addition of halide is not preferred, since it degrades image storability, i.e., so-called printing-out property, of the photosensitive material against light (indoor light, sun light etc.) after the development. Therefore, in the present invention, it is preferable to add the ions in the form of water-soluble metal salts, but not the halide compound.

The metal ions selected from Ca, Mg, Zn and Ag, which are preferably used in the present invention, may be added at any time after the formation of non-photosensitive organic acid silver salt grains and immediately before the coating operation, for example, immediately after the formation of grains, before dispersion, after dispersion, before and after the formation of coating solution and so forth. They are preferably added after dispersion, or before or after the formation of coating solution.

In the present invention, the metal ions selected from Ca, Mg, Zn and Ag are preferably added in an amount of $10^{-3}$ to $10^{-1}$ mole, particularly $5\times10^{-3}$ to $5\times10^{-2}$ mole, per one mole of non-photosensitive silver salt of an organic acid.

The photothermographic material of the present invention preferably contain an additive called "color tone adjuster" in order to improve images or increase image density. Further, the color tone adjuster may be advantageous for forming black silver images.

As the color tone adjuster, there can be used, for example, the color tone adjusters disclosed in JP-A-46-6077, JP-A-47-10282, JP-A-49-5019, JP-A-49-5020, JP-A-49-91215, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282 and 4,510,236, British Patent No. 1,380,795, Belgian Patent No. 841,910 and so forth. Specific examples of the color tone adjuster include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and a certain kind of photobleaching agents such as N,N'-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylid ene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone and 2,3-dihydro-1,4-phthalazinedione; combinations of phthalazinone with a phthalic acid derivative such as phthalic acid, 4-methylphthalic acid, 4-nitrophthalic acid, tetrachlorophthalic acid anhydride and homophthalic acid; phthalazine, phthalazine derivatives such as 4-(1-naphthyl) phthalazine, 6-chlorophthalazine, 5,7-dimethoxyphthalazine, 6-isopropylphthalazine, 6-isobutylphthalazine, 6-tert-butylphthalazine, 5,7-dimethylphthalazine, 2,3-dihydrophthalazine and metal salts thereof; combinations of phthalazine or a derivative thereof with a phthalic acid derivative such as phthalic acid, 4-methylphthalic acid, 4-nitrophthalic acid, tetrachlorophthalic acid anhydride; quinazolinedione, benzoxazine and naphthoxazine derivatives; rhodium complexes that function not only as a color tone adjuster but also as a halide ion source for the formation of silver halide at the site, such as ammonium hexachlororhodate(III), rhodium bromide, rhodium-nitrate and potassium hexachlororhodate(III); inorganic peroxides and persulfates such as ammonium disulfide peroxide and hydrogen peroxide; benzoxazine-2,4-diones such as 1,3-benzoxazine-2,4-dione, 8-methyl-1,3-benzoxazine-2,4-dione and 6-nitro-1,3-benzoxazine-2,4-dione; pyrimidines and asymmetric triazines such as 2,4-dihydroxpyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene and so forth.

The color tone adjuster is preferably contained on the side having the image-forming layer in an amount of 0.1–50 moles %, more preferably 0.5–20 moles %, per mole of silver. The color tone adjuster may also be a so-called precursor that is derived to effectively function only at the time of development.

The color tone adjuster may be added in any form, for example, as a solution, powder, solid microparticle dispersion and so forth. The solid microparticle dispersion can be formed by a known pulverization means (for example, a ball mill, vibration ball mill, sand mill, colloid mill, jet mill, roller mill etc.). Further, when solid microparticle dispersion is prepared, a dispersing aid may be used.

The photothermographic material of the present invention contains a binder on the same side of a support as the photosensitive silver halide and the reducible silver salt. The binder of the image-forming layer (photosensitive layer, emulsion layer) can be selected from well known natural or synthetic resins such as gelatin, polyvinyl acetal, polyvinyl chloride, polyvinyl acetate, cellulose acetate, polyolefin, polyester, polystyrene, polyacrylonitrile and polycarbonate. Copolymers and terpolymers may also be used. Preferred polymers are polyvinyl butyral, butyl ethyl cellulose, methacrylate copolymer, maleic anhydride ester copolymer, polystyrene and butadiene/styrene copolymer. Two or more of these polymers can be used in combination, if required. The polymers are used in an amount sufficient to hold other components in the polymer, namely, they are used in an effective range to function as a binder. Those skilled in the art can appropriately determine the effective range. In order to hold at least the organic silver salt, the ratio of the binder and the organic silver salt may preferably range from about 15:1 to 1:2, particularly preferably 8:1 to 1:1.

Among image-forming layers, at least one layer is preferably an image-forming layer utilizing polymer latex to be explained below in an amount of 50 weight % or more with respect to the total amount of binder (such an image-forming layer will be referred to as the "image-forming layer in the present invention", and the polymer latex used for the binder will be referred to as the "polymer latex used in the present invention" hereinafter). The polymer latex may be used not only in the image-forming layer, but also in the protective layer, back layer or the like. When the photothermographic material of the present invention is used for, in particular, printing use in which dimensional change causes problems, the polymer latex should be used also in a protective layer and a back layer. The term "polymer latex" used herein means a dispersion comprising hydrophobic water-insoluble polymer dispersed in a water-soluble dispersion medium as fine particles. The dispersed state may be one in which polymer is emulsified in a dispersion medium, one in which polymer underwent emulsion polymerization, micelle dispersion, one in which polymer molecules having a hydrophilic portion are dispersed in a molecular state or the like. Polymer latex used in the present invention is mentioned in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. The dispersed particles preferably have a mean particle size of about 1–50000 nm, more preferably about 5–1000 nm. The particle size distribution of the dispersed particles is not particularly limited, and the particles may have either wide particle size distribution or monodispersed particle size distribution.

Other than ordinary polymer latex of a uniform structure, the polymer latex used in the present invention may be latex of the so-called core/shell type. In this case, use of different glass transition temperatures of the core and shell may be preferred.

Preferred range of the glass transition temperature (Tg) of the polymer latex preferably used as the binder varies for the protective layer, back layer and image-forming layer. As for the image-forming layer, the glass transition temperature is 40° C. or lower,preferably30–40° C., for accelerating diffusion of photographic elements during the heat development. Polymer latex used for the protective layer or back layer preferably has a glass transition temperature of 25–70° C., because these layers are brought into contact with various apparatuses.

The polymer latex used in the present invention preferably shows a minimum film forming temperature (MFT) of about 30–90° C., more preferably about 0–70° C. A film-forming aid may be added in order to control the minimum film forming temperature. The film-forming aid is also referred to as a plasticizer, and consists of an organic compound (usually an organic solvent) that lowers the minimum film forming temperature of the polymer latex. It is explained in, for example, the aforementioned Soichi Muroi, "Gosei Latex no Kagaku (Chemistry of Synthetic Latex)", Kobunshi Kanko Kai (1970).

Examples of polymer species used for the polymer latex include acrylic resins, polyvinyl acetate resins, polyester resins, polyurethane resins, rubber resins, polyvinyl chloride resins, polyvinylidene chloride resins and polyolefin resins, copolymers of monomers constituting these resins and so forth. The polymers may be linear, branched or crosslinked. They may be so-called homopolymers in which a single kind of monomer is polymerized, or copolymers in which two or more different kinds of monomers are polymerized. The copolymers may be random copolymers or block copolymers. The polymers may have a number average molecular weight of 5,000 to 1,000,000, preferably from 10,000 to 100,000. Polymers having a too small molecular weight may unfavorably suffer from insufficient mechanical strength of the image-forming layer, and those having a too large molecular weight may unfavorably suffer from bad film forming property.

Examples of the polymer latex used as the binder of the image-forming layer of the photothermographic material of the present invention include latex of methyl methacrylate/ethyl acrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer and so forth. Such polymers are also commercially available and examples thereof include acrylic resins such as CEBIAN A4635, 46583, 4601 (all produced by Dicel Kagaku Kogyo Co., Ltd), Nipol Lx811, 814, 821, 820, 857 (all produced by Nippon Zeon Co., Ltd.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol Lx416, 410, 438C, 2507 (all produced by Nippon Zeon Co., Ltd.; polyvinyl chloride resins such as G351, G576 (both produced by Nippon Zeon Co., Ltd.); polyvinylidene chloride resins such as L502, L513 (both produced by Asahi Chemical Industry Co., Ltd.), ARON D7020, D504, D5071 (all produced by Mitsui Toatsu Co., Ltd.); and olefin resins such as CHEMIPEARL S120 and SA100 (both produced by Mitsui Petrochemical Industries, Ltd.) and so forth. These polymers may be used individually or if desired, as a blend of two or more of them.

The image-forming layer of the photothermographic material of the present invention preferably contains 50 weight % or more, more preferably 70 weight % or more of the aforementioned polymer latex based on the total binder.

If needed, the image-forming layer of the photothermographic material of the present invention may contain a hydrophilic polymer in an amount of 50 weight % or less of the total binder, such as gelatin, polyvinyl alcohol, methylcellulose, hydroxypropylcellulose, carboxymethylcellulose and hydroxypropylmethyl cellulose. The amount of the hydrophilic polymer is preferably 30 weight % or less, more preferably 15 weight % or less, of the total binder in the image-forming layer.

In the present invention, the image-forming layer is preferably formed by coating an aqueous coating solution and then drying the coating solution. The term "aqueous" as used herein means that water content of the solvent (dispersion medium) in the coating solution is 60 weight % or more. In the coating solution, the component other than water may be a water-miscible organic solvent such as methyl alcohol, ethyl alcohol, isopropyl alcohol, methyl cellosolve, ethyl cellosolve, dimethylformamide and ethyl acetate. Specific examples of the solvent composition include, in addition to water, water/methanol=90/10, water/methanol=70/30, water/ethanol=90/10, water/isopropanol=90/10, water/dimethylformamide=95/5, water/methanol/dimethylformamide=80/15/5, and water/methanol/dimethylformamide=90/5/5 (the numerals indicate weight %).

The total amount of the binder in the image-forming layer is preferably from 0.2–30 g/m$^2$, more preferably from 1–15 g/m$^2$. The image-forming layer may contain a crosslinking agent for crosslinking, surfactant for improving coatability and so forth.

As a sensitizing dye that can be used for the present invention, there can be advantageously selected those sensitizing dyes that can spectrally sensitize silver halide grains within a desired wavelength range after they are adsorbed by the silver halide grains and have spectral sensitivity suitable for spectral characteristics of the light source to be used for exposure. For example, as dyes that spectrally sensitize in a wavelength range of 550–750 nm, there can be mentioned the compounds of formula (II) mentioned in JP-A-10-186572, and more specifically, dyes of II-6, II-7, II-14, II-15, II-18, II-23 and II-25 mentioned in the same can be exemplified as preferred dyes. As dyes that spectrally sensitize in a wavelength range of 750–1400 nm, there can be mentioned the compounds of formula (I) mentioned in JP-A-11-119374, and more specifically, dyes of (25), (26), (30), (32), (36), (37), (41), (49) and (54) mentioned in the same can be exemplified as preferred dyes. Further, as dyes forming J-band, those disclosed in U.S. Pat. Nos. 5,510,236, 3,871,887 (Example 5), JP-A-2-96131 and JP-A-59-48753 can be exemplified as preferred dyes. These sensitizing dyes can be used each alone, or two or more of them can be used in combination.

The sensitizing dye can be added by the method mentioned in JP-A-11-119374, paragraph 0106. However, the addition method is not particularly limited to that method.

While the amount of the sensitizing dye used in the present invention may be selected to be a desired amount depending on the performance including sensitivity and fog, it is preferably used in an amount of $10^{-6}$–1 mole, more preferably $10^{-4}$–$10^{-1}$ mole, per mole of silver halide in the photosensitive layer.

Although not essential for practicing the present invention, it is advantageous in some cases to add a mercury (II) salt as an antifoggant to the emulsion layer. Preferred mercury(II) salts for this purpose are mercury acetate and mercury bromide.

The photothermographic material of the present invention may contain a benzoic acid compound for the purpose of achieving high sensitivity or preventing fog. The benzoic acid compound for use in the present invention may be any benzoic acid derivative, but preferred examples thereof include the compounds mentioned in U.S. Pat. Nos. 4,784,939 and 4,152,160 and JP-A-9-329863, JP-A-9-329864, JP-A-9-281637 and so forth. The benzoic acid compound may be added in any amount. However, the addition amount thereof is preferably from $1\times10^{-6}$ to 2 moles, more preferably from $1\times10^{-3}$ to 0.5 mole, per mole of silver. The benzoic acid compound may be added in any form such as powder, solution and microparticle dispersion, or it may be added as a solution containing a mixture of the benzoic acid compound with other additives such as a sensitizing dye, reducing agent and color tone adjuster. The benzoic acid compound may be added at any step during the preparation of the coating solution. In the case of adding the benzoic acid compound to a layer containing a silver salt of an organic acid, it may be added at any step from the preparation of the silver salt of an organic acid to the preparation of the coating solution, but it is preferably added in the period after the preparation of the silver salt of an organic acid and immediately before the coating. The benzoic acid compound for use in the present invention may be added to any site of the photothermographic material, but it is preferably added to a layer on the side of the photosensitive layer that is the image-forming layer, more preferably a layer containing a silver salt of an organic acid.

The photothermographic material of the present invention may contain a mercapto compound, disulfide compound or thione compound so as to control the development by inhibiting or accelerating the development, improve spectral sensitization efficiency or improve the storage stability before or after the development.

In the case of using a mercapto compound, one having any structure may be used but those represented by Ar—SM$^0$ or Ar—S—S—Ar are preferred, wherein M$^0$ is hydrogen atom or an alkali metal atom, and Ar is an aromatic ring or condensed aromatic ring containing one or more nitrogen, sulfur, oxygen, selenium or telluriumatoms. The heteroaromatic ring is preferably selected from benzimidazole, naphthimidazole, benzothiazole, naphthothiazole, benzoxazole, naphthoxazole, benzoselenazole, benzotellurazole, carbazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have one or more substituents selected from, for example, the group consisting of a halogen (e.g., bromine, chlorine), hydroxy, amino, carboxy, alkyl (e.g., alkyl having one or more carbon atoms, preferably from 1 to 4 carbon atoms), alkoxy (e.g., alkoxy having one or more carbon atoms, preferably from 1 to 4 carbon atoms) and aryl (which may have a substituent). Examples of the mercapto-substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2-dithiobisbenzothiazole, 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)- quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N-{3-(5-mercaptotetrazolyl)phenyl}urea, 2-mercapto-4-phenyloxazole, N-[3-(mercaptoacetylamino)propyl] carbazole and so forth. However, the present invention is not limited to these.

The amount of the mercapto compound is preferably from 0.0001 to 1.0 mole, more preferably from 0.001 to 0.3 mole, per mole of silver in the image-forming layer.

The image-forming layer (photosensitive layer) of the photothermographic material of the present invention may contain, as a plasticizer or lubricant, polyhydric alcohols (for example, glycerins and diols mentioned in U.S. Pat. No. 2,960,404), fatty acids or esters thereof mentioned in U.S. Pat. Nos. 2,588,765 and 3,121,060, and silicone resins mentioned in British Patent No. 955,061.

The photothermographic material of the present invention may have a surface protective layer, for example, in order to prevent adhesion of the image-forming layer.

While the surface protective layer may contain any polymers as a binder, it preferably contains a polymer having carboxyl residues in an amount of from 100 mg/m$^2$ to 5 g/m$^2$. Examples of the polymer having carboxyl residues include, for example, natural polymers (e.g., gelatin, alginic acid), modified natural polymers (e.g., carboxymethyl cellulose, phthalized gelatin), synthetic polymers (e.g., polymethacrylate, polyacrylate, polyalkyl methacrylate/acrylate copolymer, polystyrene/polymethacrylate copolymer) and so forth. The content of carboxyl residue in the polymer is preferably from 10 mmol to 1.4 mol per 100 g of the polymer. The carboxylic acid residues may form salts with alkali metal ions, alkaline earth metal ions, organic cations and so forth.

For the surface protective layer, any anti-adhesion material can be used. Examples of the anti-adhesion material include wax, silica particles, styrene-containing elastomeric block copolymer (e.g., styrene/butadiene/styrene, styrene/isoprene/styrene), cellulose acetate, cellulose acetate butyrate, cellulose propionate and mixtures thereof. The surface protective layer may also contain a crosslinking agent for forming cross-linkage or a surface active agent for improving coating property.

In the present invention, the image-forming layer or the protective layer for the image-forming layer may contain a light-absorbing material and a filter dye such as those mentioned in U.S. Pat. Nos. 3,253,921, 2,274,782, 2,527,583 and 2,956,879. The dyes can be mordanted as described in, for example, U.S. Pat. No. 3,282,699. The filter dye is preferably used in such an amount that absorbance at an exposure wavelength of 0.1–3, particularly preferably 0.2–1.5, should be achieved.

The image-forming layer for use in the photothermographic material of the present invention may contain a dye or a pigment of various types to improve color tone or prevent irradiation. Any dye or pigment may be used, and examples thereof include pigments and dyes mentioned in the color index. Specific examples thereof include organic pigments and inorganic pigments such as pyrazoloazole dyes, anthraquinone dyes, azo dyes, azomethine dyes, oxonol dyes, carbocyanine dyes, styryl dyes, triphenylmethane dyes, indoaniline dyes, indophenol dyes and phthalocyanines. Preferred examples of the dye include anthraquinone dyes (e.g., Compounds 1 to 9 mentioned in JP-A-5-341441, Compounds 3–6 to 3–18 and 3–23 to 3–38 mentioned in JP-A-5-165147), azomethine dyes (e.g., Compounds 17 to 47 mentioned in JP-A-5-341441), indoaniline dyes (e.g., Compounds 11 to 19 mentioned in JP-A-5-289227, Compound 47 mentioned in JP-A-5-341441, Compounds 2–10 and 2–11 mentioned in JP-A-5-165147 and so forth) and azo dyes (Compounds 10 to 16 mentioned in JP-A-5-341441). These dyes may be added in any form, for example, as a solution, emulsion or solid microparticle dispersion, or as a polymer mordant mordanted with a dye. The amount of the dye or pigment may be determined depending on a desired amount of absorption. In general, the compound is preferably used in an amount of from 1 $\mu$g to 1 g per 1 m$^2$ of the photosensitive material.

The photothermographic material of the present invention is preferably a so-called single-sided photosensitive material comprising a support having on one side thereof at least one photosensitive layer (preferably, an image-forming layer) containing a silver halide emulsion and on the other side thereof a back layer.

The back layer preferably has a maximum absorption of from about 0.3 to 2.0 in a desired wavelength range. Where the desired range is 750–1,400 nm, the back layer may preferably have an optical density of 0.005 or more but less than 0.5 in the range of 360–750 nm, and more preferably act as an antihalation layer having optical density of 0.001 or more but less than 0.3. Where the desired range is less than 750 nm, the back layer may preferably be an antihalation layer having a maximum absorption of 0.3 or more but 2.0 or less in a desired range of wavelength before the formation of an image, and an optical density of 0.005 or more but less than 0.3 at 360–750 nm after the formation of an image. The method for decreasing the optical density after the formation of an image to the above-mentioned range is not particularly limited. For example, a method for reducing the density through decoloration of dye by heating as mentioned in Belgian Patent No. 733,706, or a method for reducing the density using decoloration by light irradiation mentioned in JP-A-54-17833 may be used.

When antihalation dyes are used, the dyes may be any compounds so long as they have an intended absorption in a desired wavelength region and sufficiently low absorption in a visible region after the development, and also provide an absorption spectral pattern desired for the aforementioned back layer. Examples of such dye include, as a single dye, the compounds mentioned in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the treatment, the compounds mentioned in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734 and U.S. Pat. Nos. 4,088,497, 4,283,487, 4,548,896 and 5,187,049. However, the scope of the present invention is not limited to these examples.

The binder suitable for the back layer may be transparent or translucent, and generally colorless. Examples include natural polymers and synthetic resins including homopolymers and copolymers, and other film-forming media. Specific examples include, for example, gelatin, gum arabic, poly(vinyl alcohol), hydroxyethylcellulose, cellulose acetate, cellulose acetate butyrate, poly(vinylpyrrolidone), casein, starch, poly(acrylic acid), poly(methyl methacrylate), poly(vinyl chloride), poly(methacrylic acid), copoly(styrene/maleic anhydride), copoly(styrene/acrylonitrile), copoly(styrene/butadiene), poly(vinyl acetal) (e.g., poly(vinyl formal), poly(vinyl butyral)), poly(ester), poly(urethane), phenoxy resin, poly(vinylidene chloride), poly(epoxide), poly(carbonate), poly(vinyl acetate), cellulose ester and poly(amide). The binder may be coated after being dissolved in water or an organic solvent or in the form of an emulsion.

The photothermographic material of the present invention may contain a matting agent in the surface protective layer for the photosensitive emulsion layer (preferably image-forming layer) and/or the back layer or in the surface protective layer for the back layer in order to improve transferability. The matting agent is, in general, a fine particle of a water-insoluble organic or inorganic compound. Any matting agent may be employed, and those well known in the art may be used, such as organic matting agents mentioned in U.S. Pat. Nos. 1,939,213, 2,701,245, 2,322,037, 3,262,782, 3,539,344 and 3,767,448, or inorganic matting agents mentioned in U.S. Pat. Nos. 1,260,772, 2,192,241, 3,257,206, 3,370,951, 3,523,022 and 3,769,020. Specific examples of the organic compound that can be used as the matting agent include, for example, water-dispersible vinyl polymers such as polymethyl acrylate, polymethyl methacrylate, polyacrylonitrile, acrylonitrile/α-methylstyrene copolymer, polystyrene, styrene/divinylbenzene copolymer, polyvinyl acetate, polyethylene carbonate and polytetrafluoroethylene; cellulose derivatives such as methyl cellulose, cellulose acetate and cellulose acetate propionate; starch derivatives such as carboxy starch, carboxynitrophenyl starch and urea/formaldehyde/starch reaction product; gelatin hardened with a known hardener and hardened gelatin in the form of a microcapsule hollow particle produced by coacervation hardening and so forth. Examples of the inorganic compound include, for example, silicon dioxide, titanium dioxide, magnesium dioxide, aluminum oxide, barium sulfate, calcium carbonate, silver chloride desensitized by a known method, silver bromide desensitized by a known method, glass, diatomaceous earth and so forth. The matting agent may be used as a mixture of different substances as required. The size and shape of the matting agent are not particularly limited and the matting agent may have any particle size. A matting agent having a particle size of from 0.1–30 μm may preferably used to carry out the present invention. The matting agent may have either a narrow or broad particle size distribution. However, since the matting agent may greatly affect the haze or surface gloss of the photosensitive material, the particle size, shape and particle size distribution is preferably controlled to meet a desired purpose at the preparation of the matting agent or by mixing several matting agents.

The matting agent may preferably be incorporated in the outermost surface layer or a layer which functions as the outermost surface layer of the photosensitive material, or alternatively, in a layer close to the outer surface or a layer which acts as a so-called protective layer. The matting degree on the surface protective layer for the emulsion layer can be freely chosen so long as the star dust troubles do not occur. The degree may preferably be within a range of 500–10,000 seconds, most preferably 500–2,000 seconds, in terms of Beck's smoothness.

According to the present invention, the photothermographic material that is a single-sided photosensitive material and has a back layer containing a matting agent constitutes a preferred embodiment. The matting degree of the back layer is 10–1,200 seconds, more preferably 50–700 seconds, in terms of Beck's smoothness.

The emulsion for photothermography used in the present invention is coated on a support to form one or more layers. In the case of a single layer, the layer must contain a silver salt of an organic acid, a silver halide, a developing agent, a binder, and materials to be optionally added such as a color tone adjustor, coating aid and other auxiliary agents. In the case of a double-layer structure, the first emulsion layer (usually a layer adjacent to the support) must contain a silver salt of an organic acid and a silver halide, and the second layer or both layers must contain some other components. However, a double-layer structure comprising a single emulsion layer containing all of the components and a protective topcoat may also be contemplated. A multi-color photosensitive photothermographic material may have a combination of the above-mentioned two layers for each of the colors, or as mentioned in U.S. Pat. No. 4,708,928, a structure comprising a single layer containing all components. In the case of a multi-dye multi-color photothermographic material, a functional or non-functional barrier layer is generally provided between respective emulsion layers (photosensitive layers) to keep the emulsion layer away from each other as mentioned in U.S. Pat. No. 4,460,681.

A backside resistive heating layer mentioned in U.S. Pat. Nos. 4,460,681 and 4,374,921 may also be used in the photothermographic image system.

In the photothermographic material of the present invention, a hardener may be added to the image-forming layer (photosensitive layer), protective layer, back layer and other layers. Examples of the hardener include polyisocyanates mentioned in U.S. Pat. No. 4,281,060 and JP-A-6-208193; epoxy compounds mentioned in U.S. Pat. No. 4,791,042; vinylsulfone compounds mentioned in JP-A-62-89048 and so forth.

In the photothermographic material of the present invention, a surface active agent may also be used to improve the coating property, electrostatic charge property and so forth. Examples of the surface active agent include nonionic, anionic, cationic and fluorocarbon surface active agents, which may be appropriately chosen and used. Specific examples thereof include fluorocarbon polymer surface active agents mentioned in JP-A-62-170950 and U.S. Pat. No. 5,380,644, fluorocarbon surface active agents mentioned in JP-A-60-244945 and JP-A-63-188135, polysiloxane surface active agents mentioned in U.S. Pat. No. 3,885,965, and polyalkylene oxides and anionic surface active agents mentioned in JP-A-6-301140.

The aforementioned photographic additives used for the photothermographic material of the present invention and so forth are mentioned in Research Disclosure (abbreviated as "RD" hereinafter) Nos. 17643 (December, 1978), 18716 (November, 1979) and 307105 (November, 1989), and the corresponding sections in these references are summarized below.

| Type of additive | RD17643 | RD18716 | RD307105 |
|---|---|---|---|
| Chemical sensitizer | Page 23 | Page 648, right column | Page 866 |
| Sensitivity enhancer | | Page 648, right column | |
| Spectral | Pages 23–24 | Page 648, | Pages 866–868 |

-continued

| Type of additive | RD17643 | RD18716 | RD307105 |
|---|---|---|---|
| sensitizer | | right column | |
| Supersensitizer | | -Page 649, right column | |
| Whitening agent | Page 24 | Page 648, right column | Page 868 |
| Antifoggant Stabilizer | Pages 24–26 | Page 649, right column | Pages 868–870 |
| Light absorber Filter dye | Pages 25–26 | Page 649, -Page 650, left column | Page 873 right column |
| Ultraviolet absorber | | | |
| Dye image stabilizer | Page 25 | Page 650, left column | Page 872 |
| Hardener | Page 26 | Page 651, left column | Pages 874–875 |
| Binder | Page 26 | Page 651, left column | Pages 873–874 |
| Plasticizer, Lubricant | Page 27 | Page 650, right column | Page 876 |
| Coating aid Surfactant | Pages 26–27 | Page 650, right column | Pages 875–876 |
| Antistatic agent | Page 27 | Page 650, right column | Pages 876–877 |
| Matting agent | | | Pages 878–879 |

Various types of supports may be used for the photothermographic material of the present invention. Typical examples of the support include polyester film, undercoated polyester film, poly(ethylene terephthalate) film, polyethylene naphthalate film, nitrocellulose film, cellulose ester film, poly(vinyl acetal) film, polycarbonate film, other related or resinous material, glass, paper, metal and so forth. A flexible substrate, particularly, a paper support coated with baryta and/or partially acetylated α-olefin polymer, in particular, a polymer of α-olefin having 2–10 carbon atoms, such as polyethylene, polypropylene or ethylene/butene copolymer may typically be used. The support may be either transparent or opaque, and preferably be transparent. Among them, a biaxially stretched polyethylene terephthalate (PET) having a thickness of approximately from 75–200 μm is particularly preferred.

When a plastic film is passed through a heat development apparatus and processed at 80° C. or higher, the film generally expands or contracts in the dimension. If the processed materials are used as printing plates, such expansion or contraction causes a serious problem at the time of precision multi-color printing. Accordingly, in the present invention, it is preferable to use a film designed to cause little change in the dimension by relaxing the internal strain remaining in the film during the biaxial stretching and thereby eliminating the heat shrinkage distortion that may be generated during the heat development. For example, polyethylene terephthalate heat-treated at 100–210° C. before a photothermographic emulsion is coated thereon is preferably used. A film having a high glass transition point is also preferred, and for example, a film of polyether ethyl ketone, polystyrene, polysulfone, polyether sulfone, polyarylate or polycarbonate may be used.

The photothermographic material of the invention may have, for antistatic purpose, for example, a layer containing soluble salts (e.g., chlorides and nitrates), a deposited metal layer, a layer containing ionic polymers as mentioned in U.S. Pat. Nos. 2,861,056 and 3,206,312, insoluble inorganic salts as mentioned in U.S. Pat. No. 3,428,451, or tin oxide microparticles as mentioned in JP-A-60-252349 and JP-A-57-104931, and so forth.

As the method for producing color images using the photothermographic material of the invention, there is mentioned the method described in JP-A-7-13295, page 10, left column, line 43 to page 11, left column, line 40. Stabilizers for color dye images are exemplified in British Patent No. 1,326,889, U.S. Pat. Nos. 3,432,300, 3,698,909, 3,574,627, 3,573,050, 3,764,337 and 4,042,394.

In the present invention, the photothermographic emulsion can be coated by various coating methods including dip coating, air knife coating, flow coating, and extrusion coating using a hopper of the type mentioned in U.S. Pat. No. 2,681,294. If desired, two or more layers may be simultaneously coated by the methods mentioned in U.S. Pat. No. 2,761,791 and British Patent No. 837,095.

The photothermographic material of the present invention may contain additional layers, for example, a dye accepting layer for accepting a mobile dye image, an opacifying layer when reflection printing is desired, a protective topcoat layer, and a primer layer well known in the art of photothermography. The photosensitive material of the invention is preferably able to form an image by only a single sheet of the photosensitive material. That is, it is preferred that a functional layer necessary to form an image such as an image-receiving layer does not constitute a separate member of the photosensitive material.

Although the photothermographic material of the present invention may be developed by any method, the development is usually performed by heating a photothermographic material exposed imagewise. As preferred embodiments of heat development apparatus to be used, there are heat development apparatuses in which a photothermographic material is brought into contact with a heat source such as heat roller or heat drum as disclosed in JP-B-5-56499, Japanese Patent No. 684453, JP-A-9-292695, JP-A-9-297385 and WO95/30934, and heat development apparatuses of non-contact type as disclosed in JP-A-7-13294, WO97/28489, WO97/28488 and WO97/28487. Particularly preferred embodiments are the heat development apparatuses of non-contact type. The temperature for the development is preferably 80–250° C., more preferably 100–140° C. The development time is preferably 1–180 seconds, more preferably 10–90 seconds.

As a method for preventing uneven development due to dimensional change of the photothermographic material during the heat development, it is effective to employ a method for forming images wherein the material is heated at a temperature of 80° C. or higher but lower than 115° C. (preferably 113° C. or lower) for 5 seconds or more so as not to develop images, and then subjected to heat development at 110° C. or higher (preferably 130° C. or lower) to form images (so-called multi-step heating method).

The photothermographic material of the present invention can be exposed in any manner. As light source of exposure, laser rays are preferred. As the laser used in the present invention, gas lasers, YAG lasers, dye lasers, semiconductor lasers and so forth are preferred. A combination of semiconductor laser and second harmonic generating device may also be used.

The photothermographic material of the present invention shows a low haze at the exposure, and is liable to incur generation of interference fringes. For preventing the generation of interference fringes, a technique of entering a laser ray obliquely with respect to the photosensitive material disclosed in JP-A-5-113548 and so forth and a method of using a multimode laser disclosed in WO95/31754 have been known, and these techniques are preferably used.

The photothermographic material of the present invention is preferably exposed such that the laser rays are overlapped and the scanning lines are not viewed as described in *SPIE,* vol. 169, "Laser Printing", pages 116 to 128 (1979), JP-A-4-51043, WO95/31754 and so forth.

An example of the structure of heat development apparatus used for the heat development of the photothermographic material of the present invention is shown in FIG. 1. FIG. 1 depicts a side view of a heat development apparatus. The heat development apparatus shown in FIG. 1 comprises carrying-in roller pairs 11 (lower rollers are heating rollers), which carry a photothermographic material 10 into the heating section while making the material in a flat shape and preheating it, and carrying-out roller pairs 12, which carry out the photothermographic material 10 after heat development from the heating section while maintaining the material to be in a flat shape. The photothermographic material 10 is heat-developed while it is conveyed by the carrying-in roller pairs 11 and then by the carrying-out roller pairs 12. A conveying means for carrying the photothermographic material 10 under the heat development is provided with multiple rollers 13 so that they should be contacted with the surface of the image-forming layer side, and a flat surface 14 adhered with non-woven fabric (composed of, for example, aromatic polyamide, Teflon etc.) or the like is provided on the opposite side so that it should be contacted with the opposite back surface. The photothermographic material 10 is conveyed by driving of the multiple rollers 13 contacted with the surface of the image-forming layer side, while the back surface slides on the flat surface 14. As heating means, heaters 15 are provided over the rollers 13 and under the flat surface 14 so that the photothermographic material 10 should be heated from the both sides. Examples of the heating means include panel heaters and so forth. While clearance between the rollers 13 and the flat surface 14 may vary depending on the material of the flat surface member, it is suitably adjusted to a clearance that allows the conveyance of the photothermographic material 10. The clearance is preferably 0–1 mm.

The materials of the surfaces of the rollers 13 and the member of the flat surface 14 may be composed of any materials so long as they have heat resistance and they should not cause any troubles in the conveyance of the photothermographic material 10. However, the material of the roller surface is preferably composed of silicone rubber, and the member of the flat surface is preferably composed of non-woven fabric made of aromatic polyamide or Teflon (PTFE). The heating means preferably comprises multiple heaters so that temperature of each heater can be adjusted freely.

The heating section is constituted by a preheating section A comprising the carrying-in roller pairs 11 and a heat development section B comprising the heaters 15. Temperature of the preheating section A locating upstream from the heat development section B is preferably controlled to be lower than the heat development temperature (for example, lower by about 10–30° C.), and it is desired that temperature and heat development time are adjusted so that they should be sufficient for evaporating moisture contained in the photothermographic material 10. The temperature is also preferably adjusted to be higher than the glass transition temperature (Tg) of the support of the photothermographic material 10 so that uneven development should be prevented.

Further, guide panels 16 are provided downstream from the heat development section B, and a gradual cooling section C having the carrying-out roller pairs 12 and the guide panels 16 is provided.

The guide panels 16 are preferably composed of a material of low heat conductivity, and it is preferred that the cooling is performed gradually.

The heat development apparatus was explained with reference to the example shown in the drawing. However, the apparatus is not limited to the example, and the heat development apparatus used for the present invention may have a variety of structures such as one disclosed in JP-A-7-13294. For the multi-stage heating method, which is preferably used for the present invention, the photothermographic material may be successively heated at different temperatures, which is provided with two or more heat sources at different temperatures.

The present invention will be further specifically explained with reference to the following examples. The materials, regents, ratios, procedures and so forth shown in the following examples can be optionally changed so long as such change does not depart from the spirit of the present invention. Therefore, the scope of the present invention is not limited by the following examples.

EXAMPLES

Example 1

Preparation of PET Support

Polyethylene terephthalate having intrinsic viscosity of 0.66 (measured in phenol/tetrachloroethane=6/4 (weight ratio) at 25° C.) was obtained in a conventional manner by using terephthalic acid and ethylene glycol. The product was pelletized, dried at 130° C. for 4 hours, melted at 300° C., then extruded from a T-die and rapidly cooled to form an unstretched film having such a thickness that the film should have a thickness of 175 $\mu$m after thermal fixation.

The film was stretched along the longitudinal direction by 3.3 times at 110° C. using rollers of different peripheral speeds, and then stretched along the transverse direction by 4.5 times at 130° C. using a tenter. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4 kg/cm$^2$. Thus, a roll of a film having a thickness of 175 $\mu$m was obtained.

Surface Corona Discharging Treatment

Using a solid state corona discharging treatment machine Model 6KVA manufactured by Piller Inc., both surfaces of the support were treated at room temperature at 20 m/minute. The readings of electric current and voltage during the treatment indicated that the support underwent the treatment of 0.375 kV·A·minute/m$^2$. The discharging frequency of the treatment was 9.6 kHz, and the gap clearance between the electrode and the dielectric roll was 1.6 mm.

Preparation of Support Having Undercoat Layers

Preparation of Undercoating Solution A 1 g of polystyrene microparticles (mean particle size: 0.2 $\mu$m) and 20 ml of Surface active agent 1 (1 weight %) were added to 200 ml of polyester copolymer aqueous dispersion, Pesresin A-515GB (30 weight %, Takamatsu Yushi K.K.), and the mixture was further added with distilled water to a volume of 1000 ml to form Undercoating solution A.

Preparation of Undercoating Solution B 200 ml of styrene/butadiene copolymer aqueous dispersion (styrene/butadiene/itaconic acid=47/50/3 (weight ratio), concentration: 30 weight %) and 0.1 g of polystyrene microparticles (mean particle size: 2.5 μm) were added to 680 ml of distilled water, and the mixture was further added with distilled water to a volume of 1000 ml to form Undercoating solution B.

Preparation of Undercoating Solution C 10 g of inert gelatin was dissolved in 500 ml of distilled water, and the mixture was added with 40 g of aqueous dispersion (40 weight %) of tin oxide/antimony oxide composite microparticles disclosed in JP-A-61-20033, and the mixture was further added with distilled water to a volume of 1000 ml to form Undercoating solution C.

Preparation of Support Having Undercoat Layers

On one surface of the aforementioned support subjected to the corona discharging treatment, Undercoating solution A was coated by a bar coater in a wet coating amount of 5 ml/m$^2$ and dried at 180° C. for 5 minutes. The dry thickness was about 0.3 μm. Then, the back surface thereof was subjected to the corona discharge treatment and then coated with Undercoating solution B by a bar coater in a wet coating amount of 5 ml/m$^2$ so that a dry thickness of about 0.3 μm should be obtained and the coated layer was dried at 180° C. for 5 minutes. This layer was further coated with Undercoating solution C by a bar coater in a wet coating amount of 3 ml/m$^2$ so that a dry thickness of about 0.03 μm should be obtained and the coated layer was dried at 180° C. for 5 minutes to prepare a support having undercoat layers.

Preparation of Organic Acid Silver Salt Dispersion

To a stirred mixture of 43.8 g of behenic acid (product name: Edenor C22 85R, Henkel Corp. ), 730 ml of distilled water and 60 ml of tert-butanol at 79° C., 117 ml of aqueous 1N NaOH solution was added over 55 minutes, and allowed to react for 240 minutes. Then, the mixture was added with 112.5 ml of aqueous solution of 19.2 g of silver nitrate over 45 seconds, and left for 20 minutes so that the temperature of the mixture should be lowered to 30° C. Thereafter, the solid content was separated by suction filtration, and washed with water until the conductivity of the filtrate became 30 μS/cm. The solid content obtained as mentioned above was not dried but handled as a wet cake. To this wet cake corresponding to 100 g of dry solid content, 7.4 g of polyvinyl alcohol (trade name: PVA205) and water were added to make the total amount of 385 g, and the resulting mixture was preliminarily dispersed in a homomixer.

Then, the preliminarily dispersed stock solution was treated three times in a dispersing machine (trade name: Microfluidizer M-110S-EH, manufactured by Microfluidex International Corporation, using G10Z interaction chamber) under a pressure controlled to be 1,750 kg/cm$^2$ to obtain Silver behenate dispersion B. The silver behenate particles contained in the silver behenate dispersion obtained as described above were acicular grains having a mean short axis length of 0.04 μm, average long axis length of 0.8 μm and variation coefficient of 30%. The grain size was measured by Master Sizer X manufactured by Malvern Instruments Ltd. During the cooling operation, a desired dispersion temperature was established by providing coiled heat exchangers fixed before and after the interaction chamber and controlling the temperature of the refrigerant.

Preparation of 25 Weight % Dispersion of Reducing Agent

To 80 g of a compound represented by the formula (1), (2), (23) or (24) (type is shown in Table 1) and 64 g of 20 weight % aqueous solution of denatured Poval MP-203 produced by Kuraray Co., Ltd., 176 g of water was added, and thoroughly stirred to obtain slurry. The slurry was introduced into a vessel together with 800 g of zirconia beads having a mean particle size of 0.5 mm, and dispersed in a dispersing machine (¼ G Sand Grinder Mill, manufactured by Imex) for 5 hours to prepare reducing agent dispersion. The reducing agent particles contained in the reducing agent dispersion obtained as described above had a mean particle size of 0.72 μm.

Preparation of 20 Weight % Dispersion of Mercapto Compound

To 64 g of 3-mercapto-4-phenyl-5-heptyl-1,2,4-triazole and 32 g of 20 weight % aqueous solution of denatured Poval MP-203 produced by Kuraray Co., Ltd., 224 g of water was added, and thoroughly stirred to obtain slurry. The slurry was introduced into a vessel together with 800 g of zirconia beads having a mean particle size of 0.5 mm, and dispersed in a dispersing machine (¼ G Sand Grinder Mill, manufactured by Imex) for 10 hours to obtain mercapto compound dispersion. The mercapto compound particles contained in the mercapto compound dispersion obtained as described above had a mean particle size of 0.67 μm.

Preparation of 30 Weight % Dispersion of Organic Polyhalogenated Compound 116 g of organic polyhalogenated compound P-2 as a compound represented by the formula (18), 48 g of 20 weight % aqueous solution of denatured Poval MP203 produced by Kuraray Co., Ltd. and 224 g of water were thoroughly stirred to obtain slurry. The slurry was introduced into a vessel together with 800 g of zirconia beads having a mean particle size of 0.5 mm, and dispersed in a dispersing machine (¼ G Sand Grinder Mill, manufactured by Imex) for 5 hours to obtain dispersion of organic polyhalogenated compound. The organic polyhalogenated compound particles contained in the dispersion of organic polyhalogenated compound obtained as described above had a mean particle size of 0.74 μm.

Preparation of 22 Weight % Dispersion of Compound G 10 kg of Compound G and 10 kg of 20 weight % aqueous solution of denatured polyvinyl alcohol (Poval MP203, produced by Kuraray Co. Ltd.) were added with 16 kg of water, and mixed sufficiently to form slurry. The slurry was fed by a diaphragm pump to a sand mill of horizontal type (UVM-2, produced by Imex Co.) containing zirconia beads having a mean particle size of 0.5 mm, and dispersed for 3 hours and 30 minutes. Then, the slurry was added with 0.2 g of benzothiazolinone sodium salt and water so that the concentration of Compound G should become 22 weight % to obtain dispersion. The particles of Compound G contained in the dispersion obtained as described above had a median particle size of 0.55 μm and maximum particle size of 2.0 μm or less. The obtained dispersion was filtered through a polypropylene filter having a pore size of 10.0 μm to remove dusts and so forth, and stored.

Preparation of 20 Weight % Dispersion of Coupler Compound 10 kg of a coupler compound (type is shown in Table 1) and 10 kg of 20 weight % aqueous solution of denatured polyvinyl alcohol (Poval MP203, produced by Kuraray Co.

Ltd.) were added with 16 kg of water, and mixed sufficiently to form slurry. The slurry was fed by a diaphragm pump to a sand mill of horizontal type (UVM-2, produced by Imex Co.) containing zirconia beads having a mean particle size of 0.5 mm, and dispersed for 3 hours and 30 minutes. Then, the slurry was added with 0.2 g of benzothiazolinone sodium salt and water so that the concentration of the coupler compound should become 22 weight % to obtain dispersion. The particles of Compound G contained in the dispersion obtained as described above had a median particle size of 0.55 μm and maximum particle size of 2.0 μm or less. The obtained dispersion was filtered through a polypropylene filter having a pore size of 10.0 μm to remove dusts and so forth, and stored.

Preparation of Methanol Solution of Phthalazine Compound 26 g of 6-isopropylphthalazine was dissolved in 100 ml of methanol and used.

Preparation of 20 Weight % Dispersion of Pigment

To 64 g of C.I. Pigment Blue 60 and 6.4 g of Demor N produced by Kao Corporation, 250 g of water was added, and thoroughly stirred to obtain slurry. The slurry was introduced into a vessel together with 800 g of zirconia beads having a mean particle size of 0.5 mm, and dispersed in a dispersing machine (¼ G Sand Grinder Mill, manufactured by Imex) for 25 hours to obtain pigment dispersion. The pigment particles contained in the pigment dispersion obtained as described above had a mean particle size of 0.21 μm.

Preparation of Silver Halide Grain 1

1421 ml of distilled water was added with 6.7 ml of 1 weight % potassium bromide solution, and further added with 8.2 ml of 1 N nitric acid and 21.8 g of phthalized gelatin. Separately, Solution al was prepared by adding distilled water to 37.04 g of silver nitrate to dilute it to 159 ml, and Solution b1 was prepared by diluting 32.6 g of potassium bromide with distilled water to a volume of 200 ml. To the aforementioned mixture maintained at 35° C. and stirred in a titanium-coated stainless steel reaction vessel, the whole volume of Solution al was added by the controlled double jet method over 1 minute at a constant flow rate while pAg was maintained at 8.1 (Solution b1 was also added by the controlled double jet method). Then, the mixture was added with 30 ml of 3.5 weight % aqueous hydrogen peroxide solution, and further added with 336 ml of 3 weight % aqueous solution of benzimidazole. Separately, Solution a2 was prepared by diluting Solution al with distilled water to a volume of 317.5 ml, and Solution 2 was prepared by dissolving dipotassium hexachloroiridate in Solution b1 in such an amount that its final concentration should become $1\times10^{-4}$ mole per mole of silver, and diluting the obtained solution with distilled water to a volume twice as much as the volume of Solution b1, 400 ml. The whole volume of Solution a2 was added to the mixture again by the controlled double jet method over 10 minutes at a constant flow rate while pAg was maintained at 8.1 (Solution b2 was also added by the controlled double jet method). Then, the mixture was added with 50 ml of 0.5 weight % solution of 2-mercapto-5-methylbenzimidazole in methanol. After pAg was raised to 7.5 with silver nitrate, the mixture was adjusted to pH 3.8 using 1 N sulfuric acid, and the stirring was stopped. Then, the mixture was subjected to precipitation, desalting and washing with water, added with 3.5 g of deionized gelatin and 1 N sodium hydroxide to be adjusted to pH 6.0 and pAg of 8.2 to form silver halide dispersion.

The grains in the obtained silver halide emulsion were pure silver bromide grains having a mean diameter as spheres of 0.031 μm and variation coefficient of 11% for diameter as spheres. The grain size and so forth were obtained from averages for 1000 grains by using an electron microscope. The [100] face ratio of these grains was determined to be 85% by the Kubelka-Munk method.

The aforementioned emulsion was warmed to 50° C. with stirring, added with 5 ml of 0.5 weight % solution of N,N-dihydroxy-N,N-diethylmelamine in methanol and 5 ml of 3.5 weight % solution of phenoxyethanol in methanol, and further added 1 minute later with sodium benzenethiosulfonate in an amount of $3\times10^{-5}$ mole per mole of silver. Further 2 minutes later, the emulsion was added with solid dispersion of Spectral sensitizing dye 1 (aqueous gelatin solution) in an amount of $5\times10^{-3}$ mol per mole of silver, added further 2 minutes later with a tellurium compound in an amount of $5\times10^{-5}$ mol per mole of silver, and ripened for 50 minutes. Immediately before the completion of the ripening, the emulsion was added with 2-mercapto-5-methylbenzimidazole in an amount of $1\times10^{-3}$ mole per mole of silver, and its temperature was lowered to finish the chemical sensitization. Thus, Silver halide grain 1 was formed.

Preparation of Silver Halide Grain 2

In 700 ml of water, 22 g of phthalized gelatin and 30 mg of potassium bromide were dissolved, and after adjusting the pH to 5.0 at a temperature of 35° C., 159 ml of aqueous solution containing 18.6 g of silver nitrate and 0.9 g of ammonium nitrate and an aqueous solution containing potassium bromide and potassium iodide at a molar ratio of 92:8 were added by the control double jet method over 10 minutes while pAg was maintained at 7.7. Subsequently, 476 ml of an aqueous solution containing 55.4 g of silver nitrate and 2 g of ammonium nitrate and an aqueous solution containing 1×1 mole of dipotassium hexachloroiridate and 1 mole of potassium bromide were added by the control double jet method over 30 minutes while pAg was maintained at 7.7, and then 1 g of 4-hydroxy-6-methyl-1,3,3a,7-tetrazaindene was added. Then, pH of the mixture was lowered to cause coagulation precipitation to effect desalting, and the mixture was added with 0.1 g of phenoxyethanol and adjusted to pH 5.9 and pAg of 8.2 to complete the preparation of silver iodobromide grains (cubic grains having a core iodine content of 8 mole %, mean iodine content of 2 mole %, mean grain size of 0.05 μm, variation coefficient of 8% for the projected area, and [100] face ratio of 88%).

The silver halide grains obtained above was warmed to 60° C., added with sodium thiosulfonate in an amount of 85 μmol per mole of silver and 2,3,4,5,6-pentafluorophenyldiphenylphosphine selenide in an amount of $1.1\times10^{-5}$ mole, a tellurium compound in an amount of $1.5\times10^{-5}$ mole, chloroauric acid in an amount of $3.5\times10^{-8}$ mole and thiocyanic acid in an amount of $2.7\times10^{-4}$ mole, ripened for 120 minutes, then quenched to 40° C., added with $1\times10^{-4}$ mole of Spectral sensitizing dye 1 and $5\times10^{-4}$ mole of 2-mercapto-5-methylbenzimidazole, and quenched to 30° C. to obtain Silver halide emulsion 2.

Preparation of Coating Solution for Emulsion Layer

Coating Solution for Emulsion Layer 103 g of the organic acid silver salt dispersion obtained above and 5 g of 20 weight % aqueous solution of polyvinyl alcohol (PVA205, Kraray Co., Ltd.) were mixed and maintained at 40° C. To this mixture, dispersion of coupler compound (type is shown in Table 1) in an amount of $1\times10^{-2}$ per mole of silver, the aforementioned 25 weight % reducing agent dispersion (type is shown in Table 1) in an amount of 23.2 g for a reducing agent represented by the formula (17) or (18) or in an amount of 0.5 time in mole of the reducing agent represented by the formula (17) or (18) for a reducing agent represented by the formula (1) or (2), 20.3 g of the dispersion of Compound G, 4.8 g of 5 weight % aqueous dispersion of pigment, C.I. Pigment Blue 60, 10.7 g of the 30 weight % dispersion of organic polyhalogenated compound and 3.1 g of the 20 weight % mercapto compound dispersion were added. Then, the mixture was added with 106 g of 40 weight % SBR latex subjected to UF purification and maintained at 40° C., and stirred sufficiently. The mixture was further added with 6 ml of the solution of phthalazine compound in methanol to obtain an organic acid silver salt solution. Further, 5 g of Silver halide grain 1 and 5 g of Silver halide grain 2 were sufficiently mixed beforehand, mixed with the organic acid silver salt dispersion by a static mixer immediately before coating and used as a coating solution for emulsion layer. This coating solution was fed to a coating die in such a feeding amount that a coated silver amount of 1.4 g/m$^2$ should be obtained.

The viscosity of the aforementioned coating solution for emulsion layer was measured by a Brookfield (B-type) viscometer of Tokyo Keiki, and found to be 85 [mPa·s] at 40° C. (No. 1 rotor).

The viscosity of the coating solution was measured at 25° C. by an RFS fluid spectrometer produced by Rheometric Far East Co., Ltd., and found to be 1500, 220, 70, 40 and 20 [mPa·s] at shear rates of 0.1, 1, 10, 100 and 1000 [1/second], respectively.

The SBR latex purified by UF (ultrafiltration) was obtained as follows. The following SBR latex diluted 10 times with distilled water was diluted and purified by using an UF purification module FS03,FC FUY03A1 (Daisen Membrane System Ltd.) until its ionic conductivity became 1.5 mS/cm and used. The latex concentration at that ionic conductivity was 40 weight %.

SBR latex: a latex of -St(68)-Bu(29)-AA(3)-, wherein the numerals in the parentheses indicate the contents in terms of weight %, St represents styrene, Bu represents butadiene and AA represents acrylic acid The latex had the following characteristics: mean particle size of 0.1 μm, concentration of 45 weight %, equilibrated moisture content of 0.6 weight % at 25° C. and relative humidity of 60%, and ion conductivity of 4.2 mS/cm (measured for the latex stock solution (40 weight %) at 25° C. by using a conductometer, CM-30S, manufactured by Toa Electronics, Ltd.), pH 8.2.

Preparation of Coating Solution for Intermediate Layer on Emulsion Layer Side

Coating Solution for Intermediate Layer

To 772 g of 10 weight % aqueous solution of polyvinyl alcohol PVA205 (Kuraray Co., Ltd.) and 226 g of 27.5 weight % latex solution of methyl methacrylate/styrene/2-ethylhexyl acrylate/hydroxyethyl methacrylate/acrylic acid copolymer (copolymerization weight ratio=59/9/26/5/1), 2 ml of 5 weight % aqueous solution of Aerosol OT (American Cyanamid Co.), 4 g of benzyl alcohol, 1 g of 2,2,4-trimethyl-1,3-pentanediol monoisobutyrate and 10 mg of benzisothiazolinone were added to form a coating solution for intermediate layer, which was fed to a coating die at such a feeding rate that its coating amount should be 5 ml/m$^2$.

The viscosity of the coating solution was measured by a B-type viscometer, and found to be 21 [mPa·s] at 40° C. (No. 1 rotor).

Preparation of Coating Solution for First Protective Layer for Emulsion Layer

Coating Solution for First Protective Layer 80 g of inert gelatin was dissolved in water, added with 138 ml of 10 weight % solution of phthalic acid in methanol, 28 ml of 1 N sulfuric acid, 5 ml of 5 weight % aqueous solution of Aerosol OT (American Cyanamid Co.) and 1 g of phenoxyethanol, and further added with water so that the total amount should become 1000 g to form a coating solution, which was fed to a coating die at such a feeding amount that its coating amount should become 10 mum$^2$.

The viscosity of the coating solution was measured by a B-type viscometer, and found to be 17 [mPa·s] at 40° C. (No. 1 rotor).

Preparation of Coating Solution for Second Protective Layer for Emulsion Layer

Coating Solution for Second Protective Layer 100 g of inert gelatin was dissolved in water, added with 20 ml of 5 weight % solution of N-perfluorooctylsulfonyl-N-propylalanine potassium salt, 16 ml of 5 weight % solution of Aerosol OT (American Cyanamid Co.), 25 g of polymethyl methacrylate microparticles (average particle size: 4.0 μm), 44 ml of 1 N sulfuric acid and 10 mg of benzisothiazolinone, and further added with water to a total amount of 1555 g. The mixture was mixed with 445 ml of an aqueous solution containing 4 weight % of chromium alum and 0.67 weight % of phthalic acid by a static mixer immediately before application and used as a coating solution for surface protective layer. The coating solution was fed to a coating die in such an amount that the coating amount should become 10 ml/m$^2$.

The viscosity of the coating solution was measured by a B-type viscometer, and found to be 9 [mPa·s] at 40° C. (No. 1 rotor).

Preparation of Coating Solution for Back Surface

Preparation of Base Precursor Solid Microparticle Dispersion 64 g of base precursor compound and 10 g of surface active agent (Demor N, Kao Corp. ) were mixed with 246 ml of distilled water, and the mixture was subjected to bead dispersion in a sand mill (¼ Gallon Sand Grinder Mill, manufactured by Imex) to obtain a solid microparticle dispersion of the base precursor having a mean particle size of 0.2 μm.

Preparation of Solid Microparticle Dispersion of Dye 9.6 g of cyanine dye compound and 5.8 g of sodium p-alkylbenzenesulfonate were mixed with 305 ml of distilled water, and the mixture was subjected to bead dispersion in a sand mill (¼ Gallon Sand Grinder Mill, manufactured by Imex) to obtain a solid microparticle dispersion of the dye having a mean particle size of 0.2 μm.

Preparation of Coating Solution for Antihalation Layer 17 g of gelatin, 9.6 g of polyacrylamide, 70 g of the aforementioned solid microparticle dispersion of base precursor, 56 g of the aforementioned solid microparticle dispersion of dye, 1.5 g of polymethyl methacrylate microparticles (average particle size of 6.5 μm), 2.2 g of sodium polyethylenesulfonate, 0.2 g of 1 weight % aqueous solution of coloring dye compound and 844 ml of water were mixed to prepare a coating solution for antihalation layer.

Preparation of Coating Solution for Protective Layer

In a container kept at 40° C., 50 g of gelatin, 0.2 g of sodium polystyrenesulfonate, 2.4 g of N,N-ethylenebis (vinylsulfonacetamide), 1 g of sodium t-octylphenoxyethoxyethanesulfonate, 30 mg of benzisothisazolinone, 32 mg of $C_8F_{17}SO_3K$, 64 mg of $C_8F_{17}SO_2N(C_3H_7)$ $(CH_2CH_2O)_4(CH_2)_4$—$SO_3Na$ and 950 ml of water mixed to form a coating solution for protective layer.

The compounds used for Example 1 are shown below.

Surface active agent 1

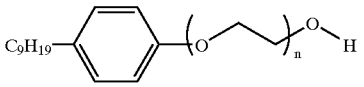

n = 8.5

Spectral sensitizing dye 1

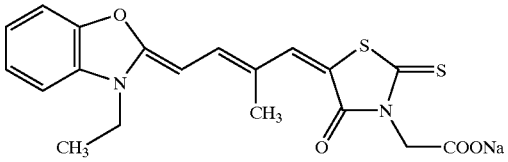

Tellurium compound

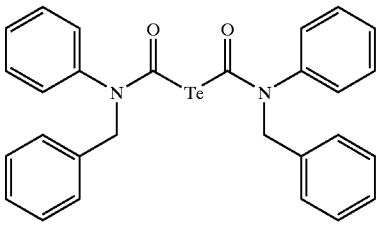

Base precursor compound

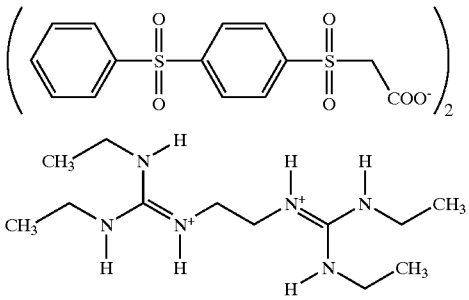

-continued

Cyanine dye compound

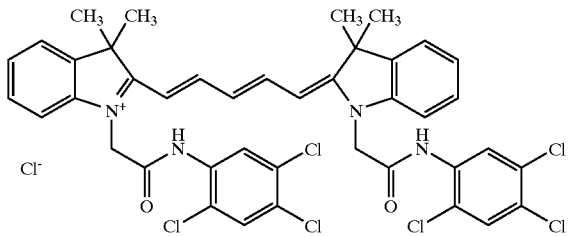

Coloring dye compound

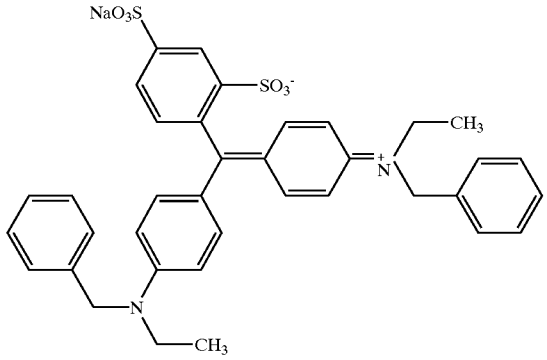

Compound G

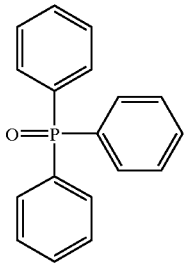

Production of Photothermographic Material

On the aforementioned support having undercoat layers, the coating solution for antihalation layer and the coating solution for protective layer were simultaneously applied as stacked layers so that the applied solid content amount of the solid microparticle dye in the antihalation layer should become 0.04 g/m$^2$, and the applied amount of gelatin in the protective layer should become 1 g/m$^2$, and dried to form an antihalation back layer. Then, on the surface opposite to the back surface, an emulsion layer, intermediate layer, first protective layer, and second protective layer were simultaneously applied in this order from the undercoated surface by the slide bead coating method as stacked layers to form each sample of photothermographic material (Table 1). After the application on the back surface, the emulsion layer was applied without winding the material.

The coating was performed at a speed of 160 m/min, and the gap between the tip of coating die and the support was set to be 0.18 mm. The pressure in the reduced pressure chamber was adjusted to be lower than the atmospheric pressure by 392 Pa. In the subsequent chilling zone, the material was blown with air showing a dry-bulb temperature of 18° C. and a wet-bulb temperature of 12° C. at a mean wind speed of 7 m/second for 30 seconds to cool the coating solutions. Then, in the floating type drying zone in a coiled shape, the material was blown with drying air showing a dry-bulb temperature of 30° C. and a wet-bulb temperature of 18° C. at a blowing wind speed of 20 m/second at nozzles for 200 seconds to evaporate the solvents in the coating solutions.

The results of the following evaluation for each photosensitive material sample are shown in Table 1.

Evaluation of Photographic Performance

Each photosensitive material was light-exposed by a 647 nm Kr laser sensitometer (maximum output: 500 mW) at an angle of 30° with respect to the normal, and treated (developed) at 120° C. for 15 seconds. The obtained image was evaluated by a densitometer. The measurement results were evaluated as Dmin (fog), Dmax and sensitivity (a reciprocal of ratio of exposure amount required for giving a density 1.0 higher than Dmin). The sensitivity was expressed with relative values to the sensitivity of Photothermographic material 101 shown in Table 1, which was taken as 100. Further, transmission spectrum of each film was determined by using a spectrophotometer provided with a film folder (UV-3100PC, SHIMADZU) to obtain absorption of produced dye.

TABLE 1

| Photothermographic | Reducing agent | | | Photographic property | | | Dye image |
|---|---|---|---|---|---|---|---|
| material | Type | Type | Coupler | Dmax | Fog | Sensitivity | density |
| 101 (Comparative) | I-1 | D-1 | None | 2.4 | 0.23 | 100 | — |
| 102 (Comparative) | I-1 | D-119 | None | 2.5 | 0.21 | 99 | — |
| 103 | I-1 | D-1 | A-110 | 2.6 | 0.21 | 99 | 0.05 |
| 104 | I-1 | D-1 | A-309 | 2.5 | 0.17 | 100 | 0.11 |
| 105 | I-1 | D-1 | A-409 | 2.6 | 0.15 | 105 | 0.12 |
| 106 | I-1 | D-1 | A-508 | 2.5 | 0.15 | 99 | 0.21 |
| 107 | I-1 | D-119 | A-309 | 2.5 | 0.19 | 99 | 0.23 |
| 108 | I-1 | D-119 | A-409 | 2.4 | 0.19 | 100 | 0.19 |
| 109 | I-1 | D-119 | A-508 | 2.5 | 0.17 | 102 | 0.14 |
| 110 | I-1 | D-119 | A-604 | 2.6 | 0.19 | 100 | 0.33 |
| 111 | I-1 | D-119 | A-906 | 2.7 | 0.20 | 99 | 0.10 |
| 112 | I-2 | D-1 | A-309 | 2.4 | 0.18 | 99 | 0.20 |
| 113 | I-2 | D-1 | A-409 | 2.5 | 0.16 | 99 | 0.16 |
| 114 | I-2 | D-119 | A-409 | 2.6 | 0.17 | 99 | 0.04 |
| 115 | I-2 | D-119 | A-508 | 2.6 | 0.15 | 100 | 0.09 |
| 116 | I-2 | D-119 | A-309 | 2.6 | 0.16 | 100 | 0.11 |
| 117 | I-2 | D-119 | A-604 | 2.5 | 0.19 | 99 | 0.22 |
| 118 | II-1 | D-1 | A-409 | 2.6 | 0.20 | 101 | 0.19 |
| 119 | II-1 | D-119 | A-409 | 2.5 | 0.19 | 100 | 0.15 |
| 120 | II-2 | D-1 | A-508 | 2.5 | 0.17 | 102 | 0.14 |
| 121 | I-1 | D-1 | B-103 | 2.6 | 0.19 | 105 | 0.09 |
| 122 | I-1 | D-1 | B-105 | 2.7 | 0.18 | 102 | 0.15 |
| 123 | I-1 | D-1 | B-108 | 2.8 | 0.18 | 105 | 0.05 |
| 124 | I-1 | D-1 | B-111 | 2.6 | 0.18 | 107 | 0.16 |
| 125 | I-1 | D-1 | B-203 | 2.7 | 0.17 | 100 | 0.18 |
| 126 | I-1 | D-1 | B-209 | 2.9 | 0.17 | 102 | 0.14 |
| 127 | I-1 | D-1 | B-211 | 2.6 | 0.18 | 102 | 0.19 |
| 128 | I-1 | D-119 | B-103 | 2.7 | 0.18 | 105 | 0.25 |
| 129 | I-1 | D-119 | B-105 | 2.8 | 0.19 | 107 | 0.28 |
| 130 | I-1 | D-119 | B-108 | 2.7 | 0.18 | 105 | 0.24 |
| 131 | I-1 | D-119 | B-209 | 2.8 | 0.17 | 100 | 0.27 |
| 132 | I-1 | D-119 | B-211 | 2.7 | 0.17 | 102 | 0.18 |
| 133 | I-2 | D-1 | B-108 | 2.7 | 0.16 | 105 | 0.07 |
| 134 | I-2 | D-1 | B-209 | 2.8 | 0.18 | 107 | 0.16 |
| 135 | I-2 | D-119 | B-108 | 2.9 | 0.17 | 105 | 0.05 |
| 136 | II-1 | D-1 | B-108 | 2.7 | 0.17 | 103 | 0.22 |
| 137 | II-1 | D-119 | B-108 | 2.9 | 0.18 | 106 | 0.25 |
| 138 | II-2 | D-1 | B-108 | 2.8 | 0.17 | 104 | 0.31 |

By taking Photothermographic materials 101 and 102 without a coupler compound as blanks, it was found that Photothermographic materials 103–138 formed dye images without reducing Dmax and sensitivity.

Example 2

Preparation of Organic Acid Silver Salt Emulsion A 933 g of behenic acid was added to 12 L of water, and added with 48 g of sodium hydroxide and 63 g of sodium carbonate dissolved in 1.5 L of water, while the mixture was maintained at 90° C. After the mixture was stirred for 30 minutes, the temperature of the mixture was lowered to 50° C., and the mixture was added with 1.1 L of 1 weight % N-bromosuccinimide aqueous solution, and then gradually added with 2.3 L of 17 weight % silver nitrate aqueous solution with stirring. Then, the temperature of the mixture was lowered to 35° C., and the mixture was added with 1.5 L of 2 weight % potassium bromide aqueous solutions over 2 minutes with stirring, then stirred for 30 minutes, and added with 2.4 L of 1 weight % N-bromosuccinimide aqueous solution. This aqueous mixture was added with 3300 g of 1.2 weight % polyvinyl acetate solution in butyl acetate with stirring, and then left standing for 10 minutes so that the mixture should be separated into two layers. Then, the aqueous layer was removed, and the remained gel was washed twice with water. The gel-like mixture of silver behenate and silver bromide obtained as described above was dispersed in 1800 g of 2.6 weight % solution of polyvinyl butyral (Denka Butyral #3000K, DENKI KAGAKU KOGYO K.K.) in 2-butanone, and further dispersed with 600 g of polyvinyl butyral (Butvar B-76, Monsanto Japan) and 300 g of isopropyl alcohol to obtain an organic acid silver salt emulsion (acicular grains having a mean short axis length of 0.05 μm, mean long axis length of 1.2 μm and variation coefficient of 25%).

Preparation of Coating Solution for Emulsion Layer A

The organic acid silver salt emulsion obtained above was added with the following reagents in the indicated amounts per 1 mole of silver. At 25° C., the emulsion was added with 520 mg of Sensitization dye A, 1.70 g of Compound (C-1), 21.5 g of 4-chlorobenzophenone-2-carboxylic acid (C-2), 0.90 g of calcium bromide dihydrate, 580 g of 2-butanone and 220 g of dimethylformamide with stirring, and left for 3 hours. Then, 32 g of a compound represented by the formula (1) or (2) (type is shown in Table 2), 160 g of a compound represented by the formula (23) or (24) (type is shown in Table 2), 2.1 g of Exemplary Compound B-42 as an ultrahigh contrast agent, a coupler compound (type is shown in Table 2) in an amount of $1\times10^{-2}$ mole per mole of silver, 1.11 g of Dye (C-3), 6.45 g of Sumidur N3500 (polyisocyanate, Sumitomo Bayer Urethane Co., Ltd.), 0.60 g of Megafax F-176P (fluorocarbon surface active agent, Dai-Nihon Ink Chemical Industry Co., Ltd.), 590 g of 2-butanone and 10 g of methyl isobutyl ketone were added with stirring.

Preparation of Coating Solution for Protective Layer for Emulsion Layer A 65 g of CAB171-15S (cellulose acetate butyrate, Eastman Chemical Products, Inc.), 5.6 g of phthalazine (C-4), 1.91 g of tetrachlorophthalic acid (C-5), 2.6 g of 4-methylphthalic acid (C-6), 0.67 g of tetrachlorophthalic acid anhydride (C-7), 0.36 g of Megafax F-176P and 2 g of Sildex H31 (spherical silica having a mean size of 3 μm, Dokai Chemical K.K.) were dissolved in 1050 g of 2-butanone and 50 g of dimethylformamide.

Preparation of Support with Back Layer 6 g of polyvinyl butyral (Denka Butyral #4000 2, DENKI KAGAKU KOGYO K.K.), 0.2 g of Sildex H121 (spherical silica having a mean size of 12 μm, Dokai Chemical K.K.), 0.2 g of Sildex H51 (spherical silica having a mean size of 5 μm, Dokai Chemical K.K.) and0.1 g of Megafax F-176P were added to64 g of 2-propanol with stirring, dissolved and mixed in the solvent. To this mixture, a mixed solution containing 420 mg of Dye A dissolved in 10 g of methanol and 20 g of acetone and a solution containing 0.8 g of 3-isocyanatomethyl-3,5,5-trimethylhexyl isocyanate dissolved in 6 g of ethyl acetate were added to form a coating solution.

On a polyethylene terephthalate film having moisture proof undercoat layers comprising polyvinylidene chloride on the both surfaces, the coating solution of back layer was applied in such an amount that an optical density at 780 nm should become 0.7.

On the support prepared as described above, the coating solution for emulsion layer was coated in such an amount that a coated silver amount of 1.6 g/m$^2$ should be obtained, and then the coating solution for protective layer for emulsion layer was coated on the emulsion layer surface in such an amount that a dry thickness of 2.3 μm should be obtained.

The compounds used for Example 2 are shown below.

Sensitizing dye A

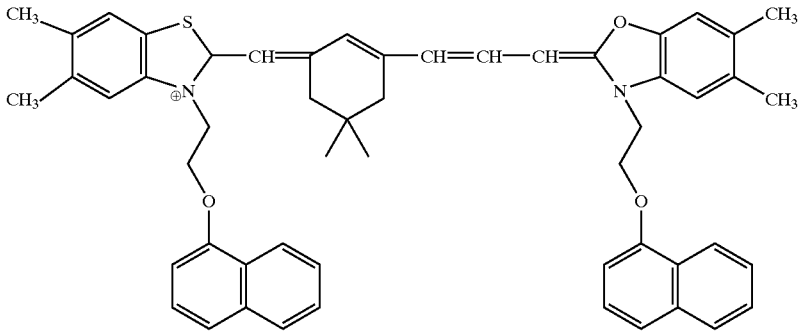

(C-1)

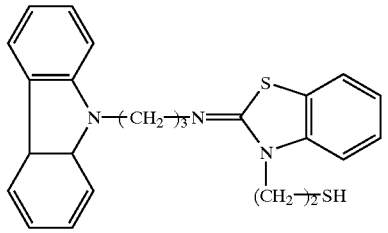

(C-2)

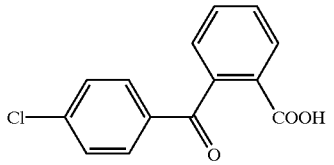

(C-3)

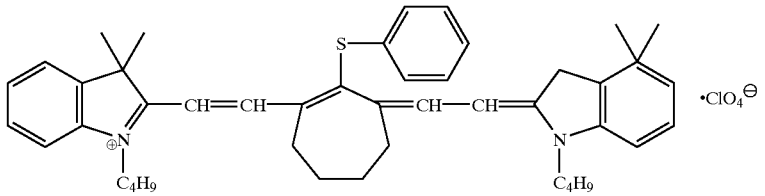

-continued (C-4)

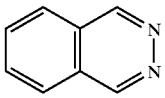

(C-5)

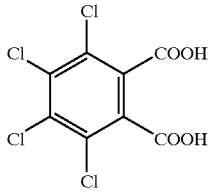

(C-6)

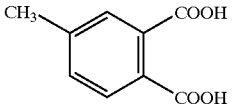

(C-7)

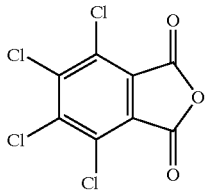

Dye A

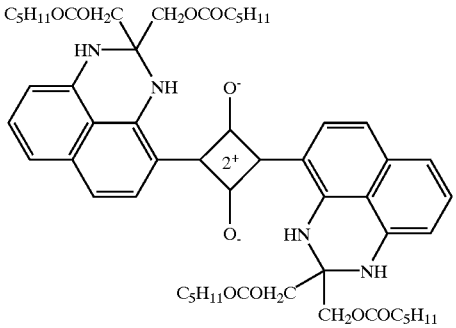

Evaluation of Photographic Performance

Each photothermographic material was light-exposed by a xenon flash light of an emission time of $10^{-4}$ seconds through an interference filter having a peak at 780 nm and a step wedge, and treated (developed) at 117° C. for 20 seconds and at 120° C. for 20 seconds. The obtained image was evaluated by a densitometer. The measurement results were evaluated as Dmax fog (Dmin), and sensitivity (a reciprocal of ratio of exposure amount required for giving a density 1.5 higher than Dmin). The sensitivity was expressed with relative values to the sensitivity of Photothermographic material 201 shown in Table 2, which was taken as 100. The results are shown in Table 2.

TABLE 2

| Photothermographic | Reducing agent | | | Photographic property | | | Dye image |
|---|---|---|---|---|---|---|---|
| material | Type | Type | Coupler | Dmax | Fog | Sensitivity | density |
| 201 (Comparative) | I-1 | D-1 | None | 4.1 | 0.18 | 100 | — |
| 202 (Comparative) | I-1 | D-119 | None | 4.5 | 0.16 | 101 | — |
| 203 | I-1 | D-1 | A-110 | 4.2 | 0.17 | 110 | 0.07 |
| 204 | I-1 | D-1 | A-309 | 4.3 | 0.14 | 106 | 0.15 |
| 205 | I-1 | D-2 | A-409 | 4.5 | 0.13 | 104 | 0.19 |
| 206 | I-1 | D-2 | A-508 | 4.6 | 0.12 | 102 | 0.25 |
| 207 | I-1 | D-101 | A-309 | 4.3 | 0.12 | 100 | 0.29 |
| 208 | I-1 | D-101 | A-409 | 4.8 | 0.10 | 103 | 0.23 |
| 209 | I-1 | D-119 | A-508 | 4.5 | 0.13 | 103 | 0.35 |
| 210 | I-1 | D-119 | A-604 | 4.7 | 0.15 | 105 | 0.35 |
| 211 | I-1 | D-119 | A-906 | 4.3 | 0.13 | 100 | 0.14 |
| 212 | I-2 | D-1 | A-309 | 4.5 | 0.16 | 103 | 0.15 |
| 213 | I-2 | D-1 | A-409 | 4.4 | 0.14 | 101 | 0.25 |
| 214 | I-2 | D-101 | A-409 | 4.7 | 0.13 | 103 | 0.11 |
| 215 | I-2 | D-101 | A-508 | 4.7 | 0.14 | 102 | 0.08 |
| 216 | I-2 | D-119 | A-309 | 4.4 | 0.15 | 102 | 0.22 |
| 217 | I-2 | D-119 | A-604 | 4.3 | 0.13 | 102 | 0.31 |
| 218 | II-1 | D-1 | A-409 | 4.5 | 0.11 | 103 | 0.15 |
| 219 | II-1 | D-119 | A-409 | 4.2 | 0.14 | 102 | 0.17 |
| 220 | II-22 | D-1 | A-508 | 4.3 | 0.13 | 104 | 0.19 |
| 221 | I-1 | D-1 | B-103 | 4.7 | 0.18 | 105 | 0.10 |
| 222 | I-1 | D-1 | B-105 | 4.8 | 0.16 | 107 | 0.17 |
| 223 | I-1 | D-1 | B-108 | 5.1 | 0.17 | 109 | 0.09 |
| 224 | I-1 | D-1 | B-111 | 4.6 | 0.16 | 105 | 0.15 |
| 225 | I-1 | D-1 | B-203 | 4.7 | 0.17 | 105 | 0.20 |

TABLE 2-continued

| Photothermographic material | Reducing agent Type | Type | Coupler | Photographic property Dmax | Fog | Sensitivity | Dye image density |
|---|---|---|---|---|---|---|---|
| 226 | I-1 | D-1 | B-209 | 4.9 | 0.16 | 105 | 0.18 |
| 227 | I-1 | D-1 | B-211 | 4.5 | 0.19 | 105 | 0.21 |
| 228 | I-1 | D-119 | B-103 | 4.6 | 0.14 | 107 | 0.24 |
| 229 | I-1 | D-119 | B-105 | 4.9 | 0.15 | 109 | 0.28 |
| 230 | I-1 | D-119 | B-108 | 4.9 | 0.15 | 111 | 0.25 |
| 231 | I-1 | D-119 | B-209 | 4.7 | 0.14 | 105 | 0.25 |
| 232 | I-1 | D-119 | B-211 | 4.4 | 0.16 | 102 | 0.19 |
| 233 | I-2 | D-1 | B-108 | 4.5 | 0.17 | 105 | 0.10 |
| 234 | I-2 | D-1 | B-209 | 4.5 | 0.15 | 105 | 0.14 |
| 235 | I-2 | D-119 | B-108 | 4.6 | 0.16 | 107 | 0.07 |
| 236 | II-1 | D-1 | B-108 | 4.6 | 0.15 | 103 | 0.20 |
| 237 | II-1 | D-119 | B-108 | 4.8 | 0.16 | 107 | 0.27 |
| 238 | 112 | D-1 | B-108 | 4.8 | 0.17 | 111 | 0.33 |

Even in the case of the photothermographic materials containing an ultrahigh contrast agent, the photothermographic materials 203–238, which corresponded to Comparative photosensitive materials 201 and 202 further added with a coupler compound, showed formation of dye without inhibiting nucleation.

Example 3

Preparation of Silver Halide Emulsion

Emulsion A

In 700 ml of water, 11 g of phthalized gelatin, 30 mg of potassium bromide and 10 mg of sodium benzenethiosulfonate were dissolved. After the solution was adjusted to pH 5.0 at a temperature of 55° C., 159 ml of an aqueous solution containing 18.6 g of silver nitrate and an aqueous solution containing 1 mol/L of potassium bromide were added by the control double jet method over 6 minutes and 30 seconds while pAg was maintained at 7.7. Then, 476 ml of an aqueous solution containing 55.5 g of silver nitrate and an aqueous solution of halide salt containing 1 mol/L of potassium bromide were added by the control double jet method over 28 minutes and 30 seconds while pAg was maintained at 7.7. Then, the pH was lowered to cause coagulation precipitation to effect desalting, 0.17 g of Compound A and 23.7 g of deionized gelatin (calcium content: 20 ppm or less) were added, and pH and pAg were adjusted to 5.9 and 8.0, respectively. The grains obtained were cubic grains having a mean grain size of 0.11 μm, variation coefficient of 8% for projected area and [100] face ratio of 93%.

The temperature of the silver halide grains obtained as described above was raised to 60° C., and the grains were added with sodium benzenethiosulfonate in an amount of 76 μmol per mole of silver. After 3 minutes, 154 μmol of sodium thiosulfate was further added, and the grains were ripened for 100 minutes.

Then, the grains were added with Sensitizing dye B and Compound B in amounts of $6.4\times10^{-4}$ mol/L and $6.4\times10^{-3}$ mol/L per 1 mole of silver halide, respectively, with stirring. After 20 minutes, the emulsion was quenched to 30° C. to complete the preparation of Silver halide emulsion A.

Preparation of Organic Acid Silver Salt Dispersion

Organic Acid Silver Salt A 6.1 g of arachic acid, 37.6 g of behenic acid, 700 ml of distilled water, 70 ml of tert-butanol and 123 ml of aqueous 1 N NaOH solution were mixed and allowed to react with stirring at 75° C. for 1 hour, and then the temperature of the mixture was lowered to 65° C. Subsequently, the mixture was added with 12.5 ml of an aqueous solution containing 22 g of silver nitrate over 45 seconds and left as it was for 5 minutes to lower the temperature to 30° C. Thereafter, the solid content was separated by suction filtration, and washed with water until the conductivity of the filtered water became 30 μS/cm. The solid content obtained as described above was not dried but handled as a wet cake. To this wet cake corresponding to 100 g of the dry solid content, 5 g of polyvinyl alcohol (PVA-205, trade name) and water were added to make the total amount 500 g, and the resulting mixture was preliminarily dispersed in a homomixer.

Then, the preliminarily dispersed stock solution was treated three times in a dispersing machine (Microfluidizer M-11OS-EH, trade name, manufactured by Microfluidex International Corporation, using G10Z interaction chamber) under a pressure controlled to 1,750 kg/cm$^2$ to obtain Organic acid silver salt dispersion A. The organic acid silver salt grains contained in the organic acid silver salt dispersion obtained as described above were acicular grains having an average short axis length of 0.04 μm, average long axis length of 0.8 μm and variation coefficient of 30%. The grain size was measured by Master Sizer X manufactured by Malvern Instruments Ltd. During the cooling operation, a desired dispersion temperature was established by providing coiled heat exchangers fixed before and after the interaction chamber and controlling the temperature of the refrigerant. Thus, Organic acid silver salt dispersion A with silver behenate content of 85 mole % was obtained.

Preparation of Solid Microparticle Dispersion of Compound Represented by the Formula (1), (2), (23) or (24)

To 70 g of a compound represented by the formula (1), (2), (23) or (24) (type is shown in Table 3), 14 g of MP polymer, MP-203, produced by Kuraray Co., Ltd., and 266 ml of water were added, thoroughly stirred and left for 3 hours as slurry. The slurry was introduced into a vessel together with 960 g of zirconia silicate beads having a mean particle size of 0.5 mm, and dispersed in a dispersing machine (¼ G Sand Grinder Mill, manufactured by Imex) for 5 hours to prepare reducing agent solid microparticle dispersion. As for the particle size, 80 weight % of the particles had a particle size of 0.3–1.0 μm.

Preparation of Solid Microparticle Dispersion of Polyhalogenated Compound

To 30 g of Polyhalogenated compound P-37 was added with 5.0 g of MP polymer, MP-203, produced by Kuraray Co., Ltd., 0.21 g of Compound C and 65 g of water were added, and thoroughly stirred to obtain slurry. The slurry was introduced into a vessel together with 200 g of zirconia silicate beads having a mean particle size of 0.5 mm, dispersed in a dispersing machine (1/16 G Sand Grinder Mill, manufactured by Imex) for 5 hours, added with 20 ml of water and Compound 2 in an amount of 100 ppm in terms of the amount in completed dispersion, and stirred for 10 minutes to prepare solid microparticle dispersion. The particles contained in the obtained dispersion had a mean particle size of 0.35 μm and maximum grain size of 1.85 μm.

Compound P-3 was dispersed in the same manner as described above to prepare solid microparticle dispersion.

Preparation of Solid Microparticle Dispersion of Ultrahigh Contrast Agent

To 10 g of the aforementioned Exemplary Compound B-42 was added with 2.5 g of Poval PVA-217, produced by Kuraray Co., Ltd., and 87.5 ml of water, and thoroughly stirred to form slurry. The slurry was treated in the same manner as the preparation of the dispersion of reducing agent to prepare solid microparticle dispersion. As for the particle size, 80 weight % of the particles had a particle size of 0.3–1.0 μm.

Preparation of Coating Solution for Emulsion Layer

Binder, raw materials and Silver halide grain A shown below were added to the organic acid silver salt microcrystal dispersion prepared above in the indicated amounts per mole of silver in the dispersion, and added with water to prepare a coating solution for emulsion layer.

| | |
|---|---|
| Binder: LACSTAR 3307B (SBR latex, produced by Dai-Nippon Ink & Chemicals, Inc., glass transition temperature: 17° C.) | 470 g as solid |
| Compound represented by the formula (1) or (2) (type is shown in Table 3) | 22 g as solid |
| Compound represented by the formula (23) or (24) (type is shown in Table 3) | 110 g as solid |
| Coupler compound (type is shown in Table 3) | $1 \times 10^{-2}$ mole per 1 mole of silver |
| 6-Methylbenzotriazole | 1.35 g |
| Polyvinyl alcohol (MP-203, produced by Kuraray Co., Ltd.) | 46 g |
| Solid dispersion of Compound P-37 | 44.8 g as Compound P-37 |
| Solid dispersion of Compound P-3 | 8.8 g as Compound P-3 |
| 6-isopropylphthalazine | 0.12 mol |
| Dye B | 0.62 g |
| Silver halide grain A | 0.05 mol as Ag |
| Ultrahigh contrast agent: Solid microparticle dispersion of Exemplary Compound B-42 | 8.5 g as B-42 |

Preparation of Coating Solution for Protective Layer for Emulsion Layer Side 109 g of polymer latex containing 27.5 weight % solid content (copolymer of methyl methacrylate/styrene/2-ethylhexyl acrylate/2-hydroxyethyl methacrylate/acrylic acid=59/9/26/5/1, glass transition temperature: 55° C.) was added with 3.75 g of water, 4.5 g of benzyl alcohol as a film-forming aid, 0.45 g of Compound D, 0.125 g of Compound E, 1.70 g of Compound F and 0.285 g of polyvinyl alcohol (PVA-217, produced by Kraray Co., Ltd.), and further added with water to make the total amount 150 g to form a coating solution.

Preparation of PET Support with Back Layer and Undercoat Layers

(1) Support

Polyethylene terephthalate having intrinsic viscosity of 0.66 (measured in phenol/tetrachloroethane=6/4 (weight ratio) at 25° C.) was obtained in a conventional manner by using terephthalic acid and ethylene glycol. The product was pelletized, dried at 130° C. for 4 hours, melted at 300° C., then extruded from a T-die and rapidly cooled to form an unstretched film having such a thickness that the film should have a thickness of 120 μm after thermal fixation.

The film was stretched along the longitudinal direction by 3.3 times at 110° C. using rollers of different peripheral speeds, and then stretched along the transverse direction by 4.5 times at 130° C. using a tenter. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$ to obtain a roll of a film having a width of 2.4 m, length of 3500 m, and thickness of 120 μm.

| | |
|---|---|
| (2) Undercoat layer (a) | |
| Polymer latex (1) (styrene/butadiene/hydroxyethyl methacrylate/divinylbenzene = 67/30/2.5/0.5 (weight %)) | 160 mg/m$^2$ |
| 2,4-Dichloro-6-hydroxy-s-triazine | 4 mg/m$^2$ |
| Matting agent (polystyrene, average particle size: 2.4 pm) | 3 mg/m$^2$ |
| (3) Undercoat layer (b) | |
| Alkali-treated gelatin ($Ca^{2+}$ content: 30 ppm, jelly strength: 230 g) | 50 mg/m$^2$ |
| Dye B | Amount affording optical density of 1.0 at 780 nm |
| (4) Electroconductive layer | |
| JURIMER ET-410 (Nippon Jun'yaku) | 96 mg/m$^2$ |
| Gelatin | 50 mg/m$^2$ |
| Compound A | 0.2 mg/m$^2$ |
| Polyoxyethylene phenyl ether | 10 mg/m$^2$ |
| SUMITEX RESIN M-3 (water-soluble melamine compound, Sumitomo Chemical) | 18 mg/m$^2$ |
| Dye B | amount affording optical density of 1.0 at 780 nm |
| $SnO_2$/Sb (9/1 by weight, acicular microparticles, long axis/short axis = 20 to 30, Ishihara Sangyo Kaisha Ltd.) | 120 mg/m$^2$ |
| Matting agent (polymethyl methacrylate, average particle size of 5 μm) | 7 mg/m$^2$ |
| (5) Protective layer | |
| Polymer Latex (2) (copolymer of methyl methacrylate/styrene/2-ethylhexyl acrylate/2-hydroxyethyl methacrylate/acrylic acid = 59/9/26/5/1 (weight %)) | 1,000 mg/m$^2$ |
| Polystyrenesulfonate (molecular weight: 1,000 to 5,000) | 2.6 mg/m$^2$ |
| CELLOSOL 524 (produced by Chukyo Yushi) | 30 mg/m$^2$ |

-continued

| | |
|---|---|
| SUMITEX RESIN M-3 (water-soluble melamine compound, Sumitomo Chemical) | 218 mg/m$^2$ |

On one side of the support, Undercoat layer (a) and Undercoat layer (b) were sequentially coated and individually dried at 180° C. for 4 minutes. Subsequently, on the surface opposite to the surface having the coated Undercoat layer (a) and Undercoat layer (b), the electro conductive layer and the protective layer were sequentially coated and individually dried at 180° C. for 30 seconds to prepare a PET support with back layer and undercoat layers.

The PET support with back layer and undercoat layers prepared as described above was introduced into a heat treatment zone set at 150° C. and having a total length of 30 m, and transported by gravity at a tension of 1.4 kg/cm$^2$ and a transportation speed of 20 m/min. Thereafter, the support was passed through a zone at 40° C. for 15 seconds, and taken up at a take-up tension of 10 kg/cm$^2$.

Preparation of Photothermographic Material

On the undercoat layers of the PET support with back layer and undercoat layers, the aforementioned coating solution for emulsion layer was coated so that the coated silver amount should be 1.6 g/m$^2$, and the coating solution for protective layer for emulsion surface was coated thereon so that the coated polymer latex amount of the protective layer should be 2.0 g/m$^2$ as a solid amount.

The compounds used in Example 3 are shown below.

Sensitizing dye B

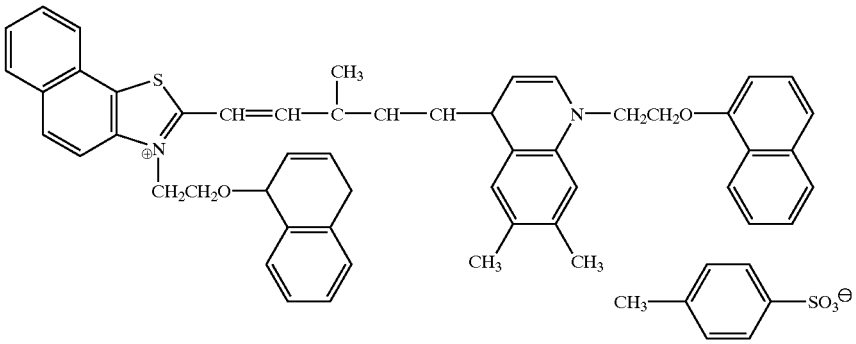

Compound A

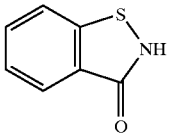

Compound B

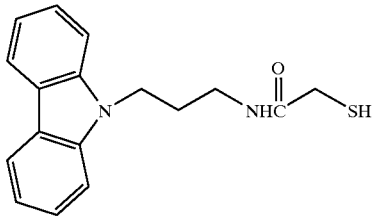

Compound C

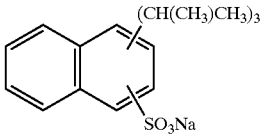

Compound P-37

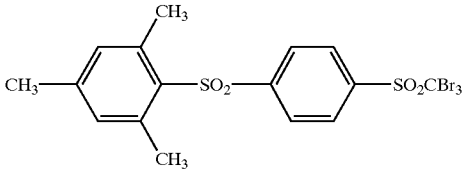

Compound P-3

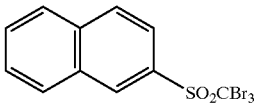

Dye B

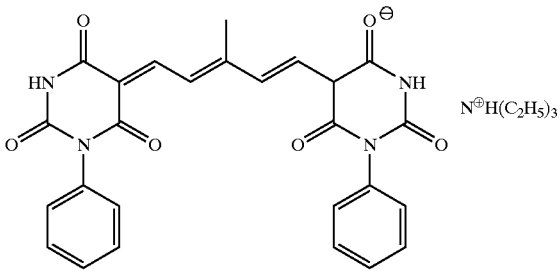

Compound D

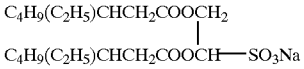

Compound E

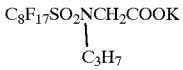

-continued

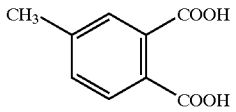

Compound F

Evaluation of Photographic Performance

Light Exposure

Each obtained coated sample was light-exposed by a xenon flash light of an emission time of $10^{-6}$ seconds through an interference filter having a peak at 780 nm and a step wedge.

Heat Development

The exposed photothermographic material was heat-developed by using such a heat development apparatus as shown in FIG. 1. The roller surface material of the heat development section was composed of silicone rubber, and the flat surface consisted of Teflon non-woven fabric. The heat development was performed at a transportation speed of 20 mm/second at 90–100° C. for 15 seconds in the preheating section, at 120° C. for 20 seconds in the heat development section, and for 15 seconds in the gradual cooling section. The temperature precision in the transverse direction was ±1° C.

Evaluation of Photographic Performance

The obtained image was evaluated by using a Macbeth TD904 densitometer (visible density). The measurement results were evaluated as Dmax, fog (Dmin) and sensitivity (a reciprocal of ratio of exposure amount required for giving a density 1.5 higher than Dmin). The sensitivity was expressed with relative values to the sensitivity of Photothermographic material 301 shown in Table 3, which was taken as 100. The results are shown in Table 3.

TABLE 3

| Photothermographic | Reducing agent | | | Photographic property | | | Dye image |
|---|---|---|---|---|---|---|---|
| material | Type | Type | Coupler | Dmax | Fog | Sensitivity | density |
| 301 (Comparative) | I-1 | D-1 | None | 4.3 | 0.18 | 100 | — |
| 302 (Comparative) | I-1 | D-119 | None | 4.5 | 0.15 | 101 | — |
| 303 | I-1 | D-1 | A-110 | 4.4 | 0.13 | 110 | 0.04 |
| 304 | I-1 | D-1 | A-309 | 4.3 | 0.12 | 106 | 0.13 |
| 305 | I-1 | D-2 | A-409 | 4.3 | 0.13 | 104 | 0.14 |
| 306 | I-1 | D-2 | A-508 | 4.5 | 0.14 | 102 | 0.19 |
| 307 | I-1 | D-101 | A-309 | 4.5 | 0.12 | 100 | 0.21 |
| 308 | I-1 | D-101 | A-409 | 4.4 | 0.13 | 103 | 0.18 |
| 309 | I-1 | D-119 | A-508 | 4.5 | 0.13 | 103 | 0.29 |
| 310 | I-1 | D-119 | A-604 | 4.6 | 0.14 | 105 | 0.31 |
| 311 | I-1 | D-119 | A-906 | 4.4 | 0.14 | 100 | 0.10 |
| 312 | I-2 | D-1 | A-309 | 4.5 | 0.14 | 103 | 0.12 |
| 313 | I-2 | D-1 | A-409 | 4.5 | 0.14 | 101 | 0.19 |
| 314 | I-2 | D-101 | A-409 | 4.6 | 0.15 | 103 | 0.15 |
| 315 | I-2 | D-101 | A-508 | 4.6 | 0.14 | 102 | 0.23 |
| 316 | I-2 | D-119 | A-309 | 4.4 | 0.13 | 102 | 0.26 |
| 317 | I-2 | D-119 | A-604 | 4.6 | 0.13 | 102 | 0.39 |
| 318 | II-1 | D-1 | A-409 | 4.5 | 0.12 | 103 | 0.12 |
| 319 | II-1 | D-119 | A-409 | 4.5 | 0.14 | 102 | 0.12 |
| 320 | II-2 | D-1 | A-508 | 4.4 | 0.12 | 104 | 0.27 |
| 321 | I-1 | D-1 | B-103 | 4.5 | 0.19 | 103 | 0.09 |
| 322 | I-1 | D-1 | B-105 | 4.3 | 0.18 | 105 | 0.19 |
| 323 | I-1 | D-1 | B-108 | 5.0 | 0.17 | 111 | 0.10 |
| 324 | I-1 | D-1 | B-111 | 4.5 | 0.16 | 105 | 0.15 |
| 325 | I-1 | D-1 | B-203 | 4.6 | 0.16 | 107 | 0.20 |
| 326 | I-1 | D-1 | B-209 | 4.8 | 0.16 | 107 | 0.20 |
| 327 | I-1 | D-1 | B-211 | 4.4 | 0.20 | 109 | 0.23 |
| 328 | I-1 | D-119 | B-103 | 4.3 | 0.16 | 107 | 0.29 |
| 329 | I-1 | D-119 | B-105 | 4.7 | 0.16 | 111 | 0.10 |
| 330 | I-1 | D-119 | B-108 | 4.5 | 0.17 | 109 | 0.25 |
| 331 | I-1 | D-119 | B-209 | 4.3 | 0.14 | 105 | 0.24 |
| 332 | I-1 | D-119 | B-211 | 4.5 | 0.16 | 105 | 0.10 |
| 333 | I-2 | D-1 | B-108 | 4.4 | 0.16 | 105 | 0.07 |
| 334 | I-2 | D-1 | B-209 | 4.5 | 0.16 | 107 | 0.15 |
| 335 | I-2 | D-119 | B-108 | 4.5 | 0.16 | 111 | 0.05 |
| 336 | II-1 | D-1 | B-108 | 4.6 | 0.14 | 105 | 0.18 |
| 337 | II-1 | D-119 | B-108 | 4.7 | 0.16 | 109 | 0.25 |
| 338 | II-2 | D-1 | B-109 | 4.9 | 0.16 | 109 | 0.03 |

Dye images were formed with good photographic performance including sensitivity and fog also in this example as in Examples 1 and 2.

Example 4

Preparation of High Sensitivity Silver Halide Emulsion 930 ml of the distilled water containing 0.37 g of gelatin with an average molecular weight of 15000, 0.37 g of oxidized gelatin and 0.7 g of potassium bromide was put in into a reaction vessel, and warmed to 38° C. To this solution, 30 ml of an aqueous solution containing 0.34 g of silver nitrate and 30 ml of an aqueous solution containing 0.24 g of potassium bromide were added over 20 seconds with vigorous stirring. After the addition was completed, the reaction solution was kept at 40° C. for 1 minute, and then the temperature of the reaction solution was raised to 75° C. The reaction solution was added with 27.0 g of gelatin of which amino groups were modified with trimellitic acid and 200ml of distilled waters, and added with 100 ml of an aqueous solution containing 23.36 g of silver nitrate and 80 ml of an aqueous solution containing 16.37 g of potassium bromide over 36 minutes with accelerating the addition flow rates. Then, the solution was added with 250 ml of an aqueous solution containing 83.2 g of silver nitrate and an aqueous solution containing potassium iodide and potassium bromide in a molar ratio of 3:97 (potassium bromide concentration was 26%) over 60 minutes with accelerating the addition flow rates so that silver electric potential of the reaction mixture should become −50 mV with respect to a saturated calomel electrode. Further, the reaction solution was added with 75 ml of an aqueous solution containing 18.7 g of silver nitrate and 21.9% aqueous solution of potassium bromide over 10 minutes, so that the silver electric potential of the reaction mixture should become 0 mV with respect to the saturated calomel electrode. After the addition was completed, the reaction solution was kept at 75° C. for 1 minute, and then the temperature of reaction solution was lowered to 40° C. Subsequently, the reaction solution was added with 100 ml of an aqueous solutions containing 10.5 g of sodium p-iodoacetamidobenzenesulfonate monohydrates, and pH of the reaction solution was adjusted to 9.0. Further, the reaction solution was added with 50 ml of an aqueous solution containing 4.3 g of sodium sulfite. After the addition was completed, the temperature of the reaction solution was kept at 40° C. for 3 minutes, and then raised to 55° C. The reaction solution was adjusted to pH 5.8, added with 0.8 mg of sodium benzenethiosulfinate, 0.04 mg g of potassium hexachloroiridate(IV) and 5.5 g of potassium bromide, then kept at 55° C. for 1 minute, and further added with 180 ml of an aqueous solutions containing 44.3g of silver nitrate and 160 ml of an aqueous solution containing 34.0 g of potassium bromide and 8.9 mg of potassium hexacyanoferrate(II) over 30 minutes. Then, the temperature was lowered, and desalting was performed in a conventional manner. After the desalting, the solution was added with gelatin to a concentration of 7 weight %,and adjusted to pH 6.2.

The obtained emulsion was an emulsion comprising hexagonal tabular grains with a mean grain size of 1.15 μm in terms of a diameter as spheres, mean grain thickness of 0.12 μm and mean aspect ratio of 24.0. This emulsion was designated as Emulsion A-1.

In the same manner as the preparation of Emulsion A-1 except that the amounts of silver nitrate and potassium bromide added in the early stage of the grain formation were changed to alter the number of nuclei to be formed, Emulsion A-2 comprising hexagonal tabular grains with a mean grain size of 0.75 μm in terms of a diameter as spheres, mean grain thickness of 0.11 μm and mean aspect ratio of 14.0, and Emulsion A-3 comprising hexagonal tabular grains with a mean grain size of 0.52 μm in terms of a diameter as spheres, mean grain thickness of 0.09 μm and mean aspect ratio of 11.3 were prepared. The amounts of potassium hexachloroiridate(IV) and potassium hexacyanoferrate(II) were also changed in inverse proportion to the grain volume, and the amount of sodium p-iodoacetamidobenzenesulfonate monohydrate was changed in proportion to the circumferential length of the grains.

Emulsion A-1 was added with 5.6 ml of 1% aqueous solution of potassium iodide at 40° C., and then subjected to spectral sensitization and chemical sensitization by adding $8.2\times10^{-4}$ mole of the following spectral sensitizing dye, Compound I, potassium thiocyanate, chloroauric acid, sodium thiosulfate and mono(pentafluorophenyl) diphenylphosphine selenide. After the completion of the chemical sensitization, the emulsion was added with $2\times10^{-4}$ mole of Stabilizer S1 and $8\times10^{-5}$ mole of Stabilizer S2. In this addition, the amount of the chemical sensitizer was adjusted so that the chemical sensitization degree of the emulsion should become optimum.

Compound 1

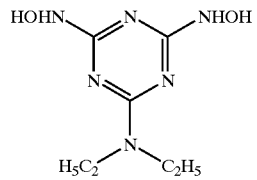

Stabilizer S1

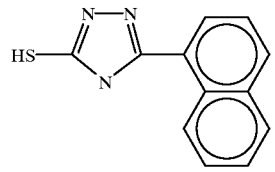

Stabilizer S2

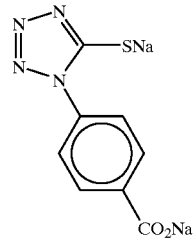

The blue sensitive emulsion prepared as described above was designated as Emulsion A-1b. Similarly, each emulsion was subjected to spectral sensitization and chemical sensitization to prepare Emulsions A-2b and A-3b. The amount of spectral sensitizing dye was changed according to the surface area of the silver halide grains in each emulsion. Further, amounts of the regents used for the chemical sensitization were also adjusted so that the chemical sensitization degree of each emulsion should become optimum.

Similarly, Green sensitive emulsions A-1g, A-2g and A-3g, Red sensitive emulsion A-1r, A-2r and A-3r were prepared by changing spectral sensitizing dye.

Sensitizing dye IV for green sensitive emulsion

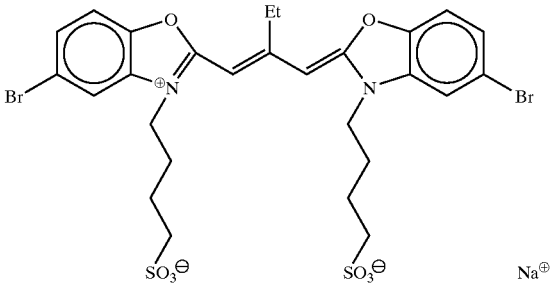

Sensitizing dye V for green sensitive emulsion

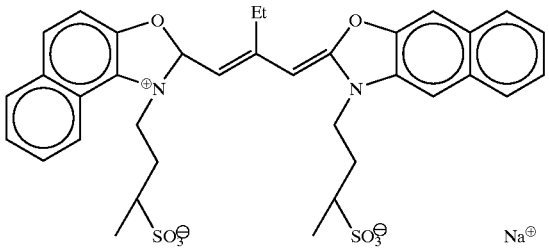

Sensitizing dye VI for green sensitive emulsion

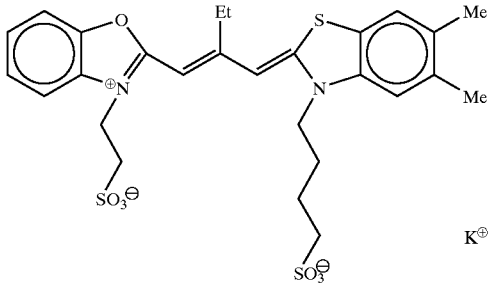

Ratio of Sensitizing dyes IV:V:VI for green sensitive emulsion = 77:20:3 (molar ratio)

Sensitizing dye VII for blue sensitive emulsion

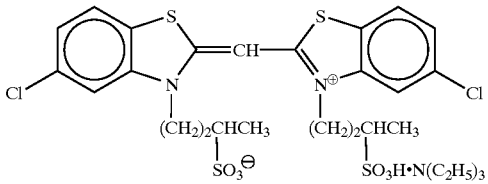

Sensitizing dye I for red sensitive emulsion

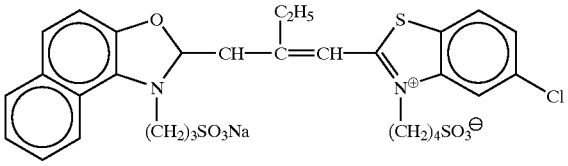

Sensitizing dye II for red sensitive emulsion

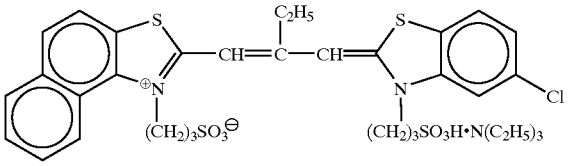

-continued

Sensitizing dye III for red sensitive emulsion

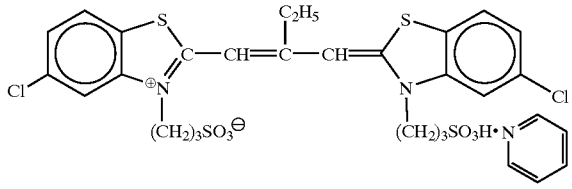

Ratio of Sensitizing dyes I:II:III for red sensitive emulsion = 40:2:58 (molar ratio)

Multilayer color photothermographic materials were prepared by using these emulsions.

The silver halide emulsions and couplers were used in the following amounts (the amounts of emulsions are indicated as coated amounts as silver) for each photosensitive emulsion layer. Couplers Y-Cp, M-Cp and C-Cp were Compound A-316, A-409 and A-609, which are disclosed in the present specification, respectively.

High sensitivity blue sensitive layer:
Emulsion A-1b: 0.52 g/m$^2$, Y-Cp: 0.27 mmol/m$^2$;
Medium sensitivity blue sensitive layer:
Emulsion A-2b: 0.24 g/m$^2$, Y-Cp: 0.22 mmol/m$^2$;
Low sensitivity blue sensitive layer:
Emulsion A-3b: 0.19 g/m$^2$, Y-Cp: 0.22 Mmol/m$^2$;
High sensitivity green sensitive layer:
Emulsion A-1g: 0.63 g/m$^2$, M-Cp: 0.24 mmol/m$^2$;
Medium sensitivity green sensitive layer:
Emulsion A-2g: 0.26 g/m$^2$, M-Cp: 0.24 mmol/m$^2$;
Low sensitivity green sensitive layer:
Emulsion A-3g: 0.22 g/m$^2$, M-Cp: 0.25 mmol/m$^2$;
High sensitivity red sensitive layer:
Emulsion A-1r: 0.66 g/m$^2$, C-Cp: 0.24 mmol/m$^2$;
Medium sensitivity red sensitive layer:
Emulsion A-2r: 0.27 g/m$^2$, C-Cp: 0.24 mmol/m$^2$;
Low sensitivity red sensitive layer:
Emulsion A-3r: 0.19 g/m$^2$, C-Cp: 0.22 mmol/m$^2$ Sample pieces were cut out from these photosensitive materials, and exposed for 1/100 second with 200 luxes through an optical wedge. Other sample pieces separately cut out were exposed stepwise for RMS granularity measurement.

After the light exposure, the materials were heat-developed at 120° C. for 15 seconds by using a heat drum.

The transmission density of the color-formed samples obtained after the heat development was measured to determine color formation and sensitivity.

As a result, good color formation property and sensitivity equivalent to ISO 250 were obtained even by the heat development at 120° C. for the short time, i.e., 15 seconds.

Example 5

The same photosensitive materials as Example 4 were similarly prepared except that A-102 was used as Coupler C-Cp, and subjected to light exposure, heat development and density measurement in the same manner as in Example 4 to determine color formation and sensitivity. As a result, good color formation property and sensitivity equivalent to ISO 250 even by the heat development at 120° C. for the short time, i.e., 15 seconds, as in Example 4.

According to the present invention, there can be provided a novel photothermographic material that shows good photographic properties including sensitivity, fog and so forth, and enables control of color tone of the photothermographic material so as to have absorption in an arbitrary wavelength region.

What is claimed is:

1. A monosheet type color photothermographic material comprising at least (a) a photosensitive silver halide, (b) a reducible silver salt, (c) a reducing compound represented by the following formula (1) or (2), (d) a binder, (e) a coupler compound on the same side of a support, (f) an organopolyhalogen compound represented by the formula (18) on the side of the support having the components (a) to (e), and (g) a compound that contains a substituent and is represented by the formula (19) on the side of the support having the components (a) to (e):

(1)

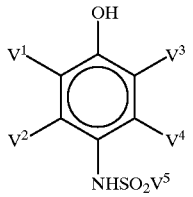

wherein, in the formula (1), $V^1$ to $V^4$ each independently represent hydrogen atom or a substituent, and $V^5$ represents a substituted or unsubstituted alkyl group, aryl group or heterocyclic group:

$$Q^1\text{—NHNH—}V^6 \quad (2)$$

wherein, in the formula (2) , $Q^1$ represents a 5- to 7-membered unsaturated ring bonding to NHNH—$V^6$ at a carbon atom, and $V^6$ represents a carbamoyl group, an acyl group, an alkoxycarbonyl group, an aryloxycarbonyl group, a sulfonyl group or a sulfamoyl group;

$$Q^2\text{-}(Y)_n\text{-}CZ^1Z^2X \quad (18)$$

wherein, in the formula (18), $Q^2$ represents a substituted alkyl group, an optionally substituted aryl group or an optionally substituted heterocyclic group, Y represents a divalent bridging group, n represents 0 or 1, $Z^1$ and $Z^2$ each independently represent a halogen atom, and X represents hydrogen atom or an electron-withdrawing group;

wherein the substituent for the alkyl group of $Q^2$ is at least one selected from the group consisting of alkenyl group, an alkynyl group, an aryl group, a heterocyclic group, an alkoxy-carbonyl group, an aryloxycarbonyl group, a carbamoyl group, an imino group, an imino group substituted at the N atom, a thiocarbonyl group, a carbazoyl group, a cyano group, a thiocarbamoyl group, an aryloxy group, a heterocyclyloxy group, an acyloxy group, an (alkoxy or aryloxy) carbonyloxy group, a sulfonyloxy group, an acylamino group, a sulfonamido group, a ureido group, a thioureido group, an imido group, an (alkoxy or aryloxy) carbonylamino group, a sulfamoylamino group, a semicarbazide group, a thiosemicarbazide group, an (alkyl or aryl) sulfonyl-ureido group, a nitro group, an (alkyl or aryl) sulfonyl group, a sulfamoyl group, a group containing phosphoric acid amide or phosphoric acid ester structure, a silyl group, a carboxyl group or a salt thereof, a sulfo group or a salt thereof, a phosphoric acid group, a hydroxyl group, and a quaternary ammonium group;

wherein when $Q^2$ is a heterocyclic 6-membered unsaturated monocycle, the monocycle is selected from the group consisting of pyridine, pyrimidine, pyrazine, and pyridazine;

(19)

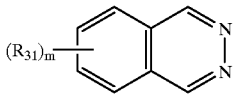

wherein, in the formula (19), $R^{31}$ represents a monovalent substituent, m represents an integer of 1 to 3, $(R^{31})m$ means that 1–3 of $R^{31}$ independently exist on the substituted phthalazine ring, and when m is 2 or more, adjacent two of $R^{31}$ may form an aliphatic ring or an aromatic ring.

2. The photothermographic material according to claim 1, wherein the reducing compound (c) is represented by the formula (2).

3. The photothermographic material according to claim 1, wherein the coupler compound is a compound represented by any one of the following formulas (3) to (17):

(3)

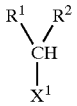

(4)

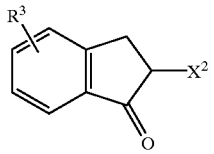

(5)

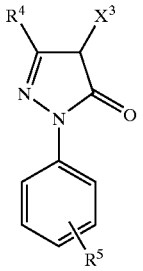

(6)

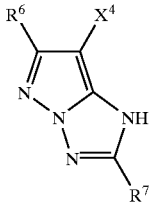

-continued (7)

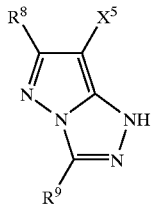

(8)

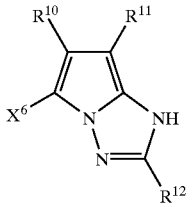

(9)

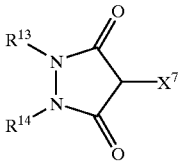

(10)

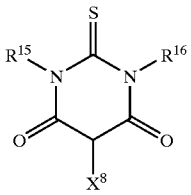

(11)

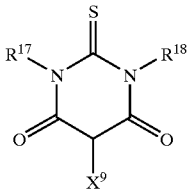

(12)

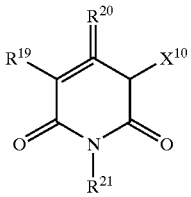

(13)

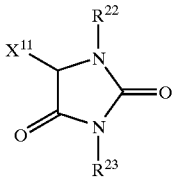

(14)

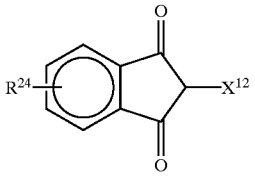

-continued (15)

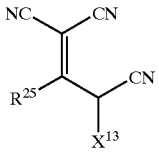

(16)

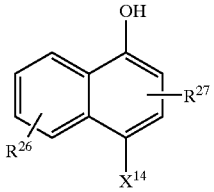

(17)

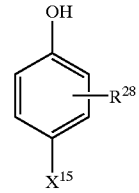

wherein, in the formulas (3) to (17), $X^1$ to $X^{15}$ each independently represent hydrogen atom or a substituent; in the formula (3), $R^1$ and $R^2$ each independently represent an electron-withdrawing group; and in the formulas (3) to (17), $R^3$ to $R^{28}$ each independently represent hydrogen atom or a substituent.

4. The photothermographic material according to claim 1, which further comprises (i) at least one kind of a compound represented by the formula (23) or (24) on the side of the support having the components (a) to (e):

(23)

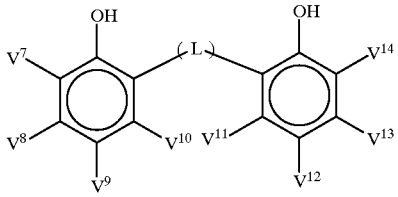

(24)

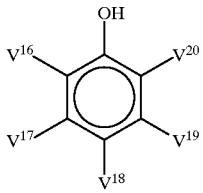

wherein, in the formula (23), $V^7$ to $V^{14}$ each independently represent hydrogen atom or a substituent, and L represents a bridging group consisting of —CH($V^{15}$)— or —S— where $V^{15}$ represents hydrogen atom or a substituent; and in the formula (24), $V^{16}$ to $V^{20}$ each independently represent hydrogen atom or a substituent.

5. The photothermographic material according to claim 1, wherein the coupler compound is a development inhibitor-releasing coupler.

6. A photothermographic material comprising at least (a) a photosensitive silver halide, (b) a reducible silver salt, (c)

a reducing compound represented by the following formula (1) or (2), (d) a binder and (e) a coupler compound on the same side of a support:

(1)

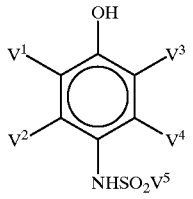

wherein, in the formula (1), $V^1$ to $V^4$ each independently represent hydrogen atom or a substituent, and $V^5$ represents a substituted or unsubstituted alkyl group, aryl group or heterocyclic group:

$$Q^1—NHNH—V^6 \quad (2)$$

wherein, in the formula (2), $Q^1$ represents a 5- to 7-membered unsaturated ring bonding to NHNH—$V^6$ at a carbon atom, and $V^6$ represents a carbamoyl group, an acyl group, an alkoxycarbonyl group, an aryloxycarbonyl group, a sulfonyl group or a sulfamoyl group, which further comprises (h) at least one kind of a compound represented by any of the formulas (20), (21) and (22) on the side of the support having the components (a) to (e):

(20)

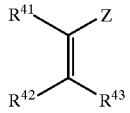

(21)

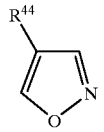

(22)

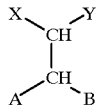

wherein, in the formula (20), $R^{41}$ to $R^{43}$ each independently represent hydrogen atom or a substituent, Z represents an electron-withdrawing group or a silyl group, and $R^{41}$ and Z, $R^{42}$ and $R^{43}$, $R^{41}$ and $R^{42}$, or $R^{43}$ and Z may combine with each other to form a ring structure;

in the formula (21), $R^{44}$ represents a substituent; and in the formula (22), X and Y independently represent hydrogen atom or a substituent, A and B each independently represent an alkoxy group, an alkylthio group, and alkylamino group, an aryloxy group, an arylthio group, an anilino group, a heterocyclyloxy group, a heterocyclylthio group or a heterocyclylamino group, and X and Y, or A and B may be combined with each other to form a ring structure.

7. A method for forming images, which comprises developing the photothermographic material according to claim 1 by heating.

8. A method for forming images, which comprises developing the photothermographic material according to claim 1 by heating to obtain a dye image.

9. A monosheet type photosensitive photothermographic material comprising at least (a) a photosensitive silver halide, (b) a reducible silver salt, (c) a reducing compound represented by the following formula (1) or (2), (d) a binder and (e) a coupler compound on the same side of a support:

(1)

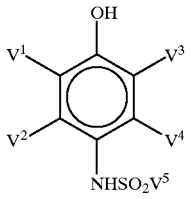

wherein, in the formula (1), $V^1$ to $V^4$ each independently represent hydrogen atom or a substituent, and $V^5$ represents a substituted or unsubstituted alkyl group, aryl group or heterocyclic group:

$$Q^1—NHNH—V^6 \quad (2)$$

wherein, in the formula (2), $Q^1$ represents a 5- to 7-membered unsaturated ring bonding to NHNH—$V^6$ at a carbon atom, and $V^6$ represents a carbamoyl group, an acyl group, an alkoxycarbonyl group, an aryloxycarbonyl group, a sulfonyl group or a sulfamoyl group, and wherein said photothermographic material further comprises a compound represented by formula (19):

(19)

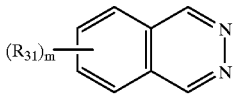

wherein, in the formula (19), $R^{31}$ represents a monovalent substituent, m represents an integer of 1 to 3, $(R^{31})m$ means that 1–3 of $R^{31}$ independently exist on the substituted phthalazine ring, and when m is 2 or more, adjacent two of $R^{31}$ may form an aliphatic ring or an aromatic ring.

10. A photothermographic material comprising at least (a) a photosensitive silver halide, (b) a reducible silver salt, (c) a reducing compound represented by the following formula (1) or (2), (d) a binder and (e) a coupler compound on the same side of a support:

(1)

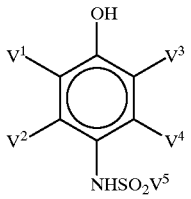

wherein, in the formula (1), $V^1$ to $V^4$ each independently represent hydrogen atom or a substituent, and $V^5$ represents a substituted or unsubstituted alkyl group, aryl group or heterocyclic group:

$$Q^1—NHNH—V^6 \quad (2)$$

wherein, in the formula (2), $Q^1$ represents a 5- to 7-membered unsaturated ring bonding to NHNH—$V^6$ at a carbon atom, and $V^6$ represents a carbamoyl group, an acyl group, an alkoxycarbonyl group, an aryloxycarbonyl group, a sulfonyl group or a sulfamoyl group, further comprising (j) a development inhibitor-releasing coupler represented by the following formula (24) on at least one same side of a support:

$$A\text{-}(TIME)_n\text{-}DI \quad (24)$$

wherein, in the formula (24), A represents a coupler residue which releases $(TIME)_n$-DI by a coupling reaction with an oxidized form of the compound represented by the formula (1) or (2), TIME represents a timing group which releases $(TIME)_{n-1}$-DI after being released from A by a coupling reaction or a timing group which releases $(TIME)_{n-2}$-DI after being released from TIME, n represents an integer of 0–3, and when n is 2 or more, plural TIMEs may be the same or different, and DI represents a group which functions as a development inhibitor after being released from A or TIME, and wherein said photothermographic material further comprises (f) an organopolyhalogen compound represented by the formula (18) on the side of the support having the components (a) to (e):

$$Q^2\text{-}(Y)_n\text{-}CZ^1Z^2X \quad (18)$$

wherein, in the formula (18), $Q^2$ represents alkyl group, aryl group or heterocyclic group, which may have one or more substituents, Y represents a divalent bridging group, n represents 0 or 1, $Z^1$ and $Z^2$ each independently represent a halogen atom, and X represents hydrogen atom or an electron-withdrawing group, and wherein said photothermographic material further comprises a compound represented by formula (19):

(19)

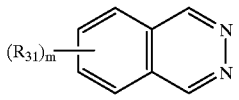

wherein, in the formula (19), $R^{31}$ represents a monovalent substituent, m represents an integer of 1 to 3, $(R^{31})m$ means that 1–3 of $R^{31}$ independently exist on the substituted phthalazine ring, and when m is 2 or more, adjacent two of $R^{31}$ may form an aliphatic ring or an aromatic ring.

11. The photothermographic material according to claim 10, wherein the coupler compound is a compound represented by any one of the formulas (3) to (17) as defined in claim 3.

12. The photothermographic material according to claim 10, which further comprises (i) at least one kind of a compound represented by the formula (23) or (24) as defined in claim 7 on the side of the support having the components (b), (c), (d) and (j).

13. A photothermographic material comprising at least (a) a photosensitive silver halide, (b) a reducible silver salt, (c) a reducing compound represented by the following formula (1) or (2), (d) a binder and (e) a coupler compound on the same side of a support:

(1)

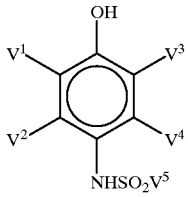

wherein, in the formula (1), $V^1$ to $V^4$ each independently represent hydrogen atom or a substituent, and $V^5$ represents a substituted or unsubstituted alkyl group, aryl group or heterocyclic group:

$$Q^1—NHNH—V^6 \quad (2)$$

wherein, in the formula (2), $Q^1$ represents a 5- to 7-membered unsaturated ring bonding to NHNH—$V^6$ at a carbon atom, and $V^6$ represents a carbamoyl group, an acyl group, an alkoxycarbonyl group, an aryloxycarbonyl group, a sulfonyl group or a sulfamoyl group, further comprising (j) a development inhibitor-releasing coupler represented by the following formula (24) on at least one same side of a support:

$$A\text{-}(TIME)_n\text{-}DT \quad (24)$$

wherein, in the formula (24), A represents a coupler residue which releases $(TIME)_n$-DI by a coupling reaction with an oxidized form of the compound represented by the formula (1) or (2), TIME represents a timing group which releases $(TIME)_{n-i}$-DI after being released from A by a coupling reaction or a timing group which releases $(TIME)_{n-2}$-DI after being released from TIME, n represents an integer of 0–3, and when n is 2 or more, plural TIMEs may be the same or different, and DI represents a group which functions as a development inhibitor after being released from A or TIME, wherein said photothermographic material further comprises (h) at least one kind of a compound represented by any of the formulas (20), (21) and (22) on the side of the support having the components (b), (c), (d) and (j);

(20)

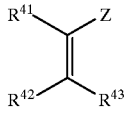

(21)

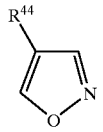

-continued (22)

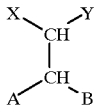

wherein, in the formula (20), $R^{41}$ to $R^{43}$ each independently represent hydrogen atom or a substituent, Z represents an electron-withdrawing group or a silyl group, and $R^{41}$ and Z, $R^{42}$ and $R^{43}$, $R^{41}$ and $R^{42}$, or $R^{43}$ and Z may combine with each other to form a ring structure;

in the formula (21), $R^{44}$ represents a substituent; and in the formula (22), X and Y independently represent hydrogen atom or a substituent, A and B each independently represent an alkoxy group, an alkylthio group, and alkylamino group, an aryloxy group, an arylthio group, an anilino group, a heterocyclyloxy group, a heterocyclylthio group or a heterocyclylamino group, and X and Y, or A and B may be combined with each other to form a ring structure.

14. A method for forming images, which comprises using the photothermographic material according to claim 1 to obtain an overlapped image of dye image and silver image.

15. The photothermographic material according to claim 6, wherein the reducing compound (c) is represented by the formula (2).

16. The photothermographic material according to claim 6, wherein the coupler compound is a compound represented by any one of the following formulas (3) to (17):

(3)

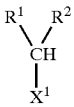

(4)

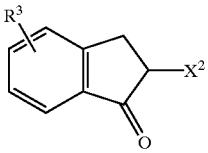

(5)

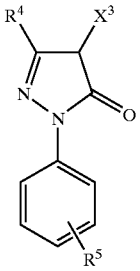

(6)

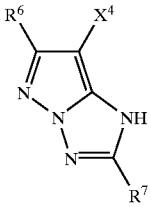

-continued (7)

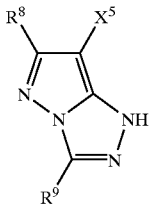

(8)

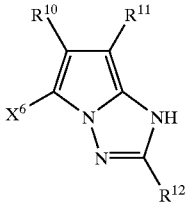

(9)

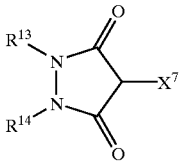

(10)

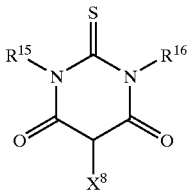

(11)

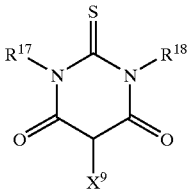

(12)

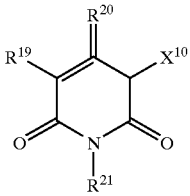

(13)

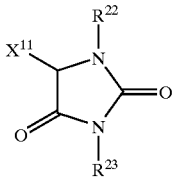

(14)

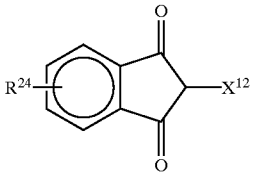

-continued (15)

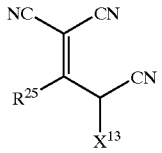

(16)

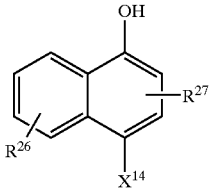

(17)

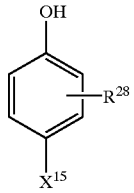

wherein, in the formulas (3) to (17) , $X^1$ to $X^{15}$ each independently represent hydrogen atom or a substituent; in the formula (3), $R^1$ and $R^2$ each independently represent an electron-withdrawing group; and in the formulas (3) to (17), $R^3$ to $R^{28}$ each independently represent hydrogen atom or a substituent.

17. The photothermographic material according to claim 6, which further comprises (i) at least one kind of a compound represented by the formula (23) or (24) on the side of the support having the components (a) to (e):

(23)

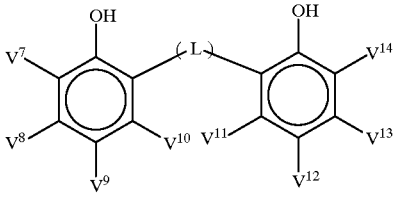

(24)

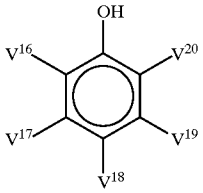

wherein, in the formula (23), $V^7$ to $V^{14}$ each independently represent hydrogen atom or a substituent, and L represents a bridging group consisting of —CH($V^{15}$)— or —S— where $V^{15}$ represents hydrogen atom or a substituent; and in the formula (24), $V^{16}$ to $V^{20}$ each independently represent hydrogen atom or a substituent.

18. The photothermographic material according to claim 6, wherein the coupler compound is a development inhibitor-releasing coupler.

19. A method for forming images, which comprises developing the photothermographic material according to claim 6 by heating.

20. A method for forming images, which comprises developing the photothermographic material according to claim 6 by heating to obtain a dye image.

21. A method for forming images, which comprises using the photothermographic material according to claim 6 to obtain an overlapped image of dye image and silver image.

22. The photothermographic material according to claim 9, wherein the reducing compound (c) is represented by the formula (2).

23. The photothermographic material according to claim 9, wherein the coupler compound is a compound represented by any one of the following formulas (3) to (17):

(3)

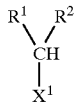

(4)

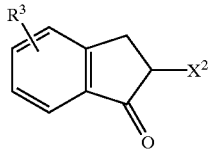

(5)

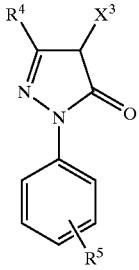

(6)

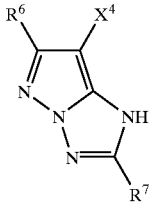

(7)

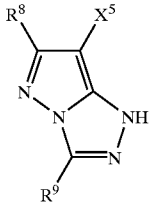

(8)

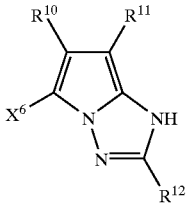

-continued (9)

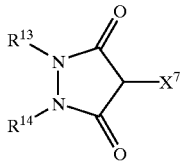

(10)

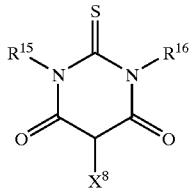

(11)

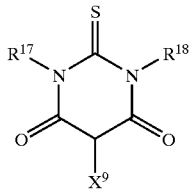

(12)

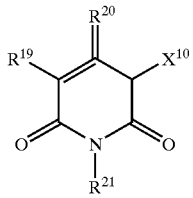

(13)

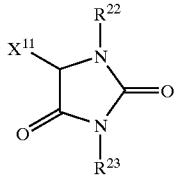

(14)

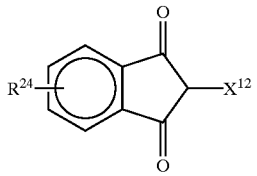

(15)

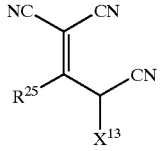

(16)

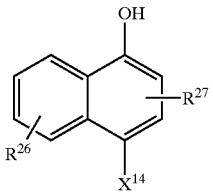

-continued (17)

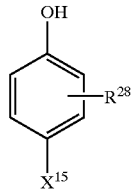

wherein, in the formulas (3) to (17), $X^1$ to $X^{15}$ each independently represent hydrogen atom or a substituent; in the formula (3), $R^1$ and $R^2$ each independently represent an electron-withdrawing group; and in the formulas (3) to (17), $R^3$ to $R^{28}$ each independently represent hydrogen atom or a substituent.

24. The photothermographic material according to claim 9, which further comprises (i) at least one kind of a compound represented by the formula (23) or (24) on the side of the support having the components (a) to (e):

(23)

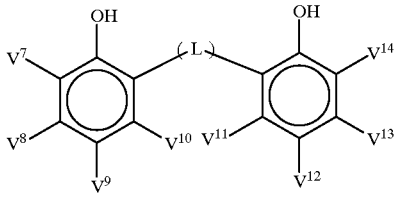

(24)

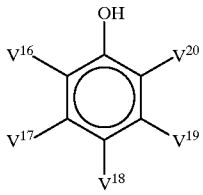

wherein, in the formula (23), $V^7$ to $V^{14}$ each independently represent hydrogen atom or a substituent, and L represents a bridging group consisting of —CH($V^{15}$)— or —S— where $V^{15}$ represents hydrogen atom or a substituent; and in the formula (24), $V^{16}$ to $V^{20}$ each independently represent hydrogen atom or a substituent.

25. The photothermographic material according to claim 9, wherein the coupler compound is a development inhibitor-releasing coupler.

26. A method for forming images, which comprises developing the photothermographic material according to claim 9 by heating.

27. A method for forming images, which comprises developing the photothermographic material according to claim 9 by heating to obtain a dye image.

28. A method for forming images, which comprises using the photothermographic material according to claim 9 to obtain an overlapped image of dye image and silver image.

29. The photothermographic material according to claim 6, which is a monosheet type photosensitive material.

30. The photothermographic material according to claim 1, wherein the photothermographic material further comprises a development inhibitor-releasing coupler represented by the following formula (24):

$$A\text{-}(TIME)_n\text{-}DI \quad (24)$$

wherein, in the formula (24), A represents a coupler residue which releases $(TIME)_n$-DI by a coupling reaction with an oxidized form of the compound represented by the formula (1) or (2), TIME represents a timing group which releases $(TIME)_{n-1}$-DI after being released from A by a coupling reaction or a timing group which releases $(TIME)_{n-2}$-DI after being released from TIME, n represents an integer of 0–3, and when n is 2 or more, plural TIMEs may be the same or different, and DI represents a group which functions as a development inhibitor after being released from A or TIME.

* * * * *

UNITED STATES PATENT AND TRADEMARK OFFICE

CERTIFICATE OF CORRECTION

PATENT NO. : 6,593,069 B2
DATED : July 15, 2003
INVENTOR(S) : Oya et al.

It is certified that error appears in the above-identified patent and that said Letters Patent is hereby corrected as shown below:

Title page,
Please add the following item:
-- [30] Foreign Application Priority Data

March 17, 2000 (JP)……..2000-076016
March 17, 2000 (JP)……..2000-076053
March 17, 2000 (JP)……..2000-076141
March 17, 2000 (JP)……..2000-076173
March 27, 2000 (JP)……..2000-085810
May 1, 2000 (JP)……..2000-132181
May 1, 2000 (JP)……..2000-132270 --

Signed and Sealed this

Sixth Day of April, 2004

JON W. DUDAS
*Acting Director of the United States Patent and Trademark Office*